US009987195B2

(12) United States Patent
Fangrow

(10) Patent No.: US 9,987,195 B2
(45) Date of Patent: Jun. 5, 2018

(54) PRESSURE-REGULATING VIAL ADAPTORS AND METHODS

(71) Applicant: ICU Medical, Inc., San Clemente, CA (US)

(72) Inventor: Thomas F. Fangrow, Mission Viejo, CA (US)

(73) Assignee: ICU Medical, Inc., San Clemente, CA (US)

( * ) Notice: Subject to any disclaimer, the term of this patent is extended or adjusted under 35 U.S.C. 154(b) by 1019 days.

(21) Appl. No.: 14/307,320

(22) Filed: Jun. 17, 2014

(65) Prior Publication Data

US 2015/0011963 A1 Jan. 8, 2015

Related U.S. Application Data

(63) Continuation of application No. PCT/US2013/021296, filed on Jan. 11, 2013.

(60) Provisional application No. 61/586,418, filed on Jan. 13, 2012.

(51) Int. Cl.

| | |
|---|---|
| ***A61J 1/00*** | (2006.01) |
| ***A61J 1/20*** | (2006.01) |
| ***A61J 1/14*** | (2006.01) |

(52) U.S. Cl.

CPC ..... *A61J 1/20* (2013.01); *A61J 1/1475* (2013.01); *A61J 1/1493* (2013.01); *A61J 1/2096* (2013.01); *A61J 1/201* (2015.05); *A61J 1/2003* (2015.05); *A61J 1/2055* (2015.05); *A61J 1/2075* (2015.05)

(58) Field of Classification Search

CPC ..... A61J 1/20–1/2086; A61J 1/1481; A61J 1/1475–1/1479

USPC ..... 604/411–414

See application file for complete search history.

(56) References Cited

U.S. PATENT DOCUMENTS

| | | | |
|---|---|---|---|
| 2,074,223 | A | 3/1937 | Horiuchi et al. |
| 2,409,734 | A | 10/1946 | Bucher et al. |
| 2,419,401 | A | 4/1947 | Hinds |
| 2,668,533 | A | 2/1954 | Evans |
| 2,673,013 | A | 3/1954 | Hester |

(Continued)

FOREIGN PATENT DOCUMENTS

| | | |
|---|---|---|
| AU | 2013200393 A1 | 2/2013 |
| EP | 0 829 250 | 3/1998 |

(Continued)

OTHER PUBLICATIONS

US 8,777,920, 07/2014, Warren et al. (withdrawn)

(Continued)

*Primary Examiner* — Susan Su

(74) *Attorney, Agent, or Firm* — Knobbe, Martens, Olson & Bear, LLP

(57) ABSTRACT

In certain embodiments, a vial adaptor comprises a housing member, a connector configured to couple the adaptor with a vial, a regulator channel, and an extractor channel formed in the housing member. The extractor channel is configured to facilitate withdrawal of fluid from the vial when the adaptor is coupled to the vial. The regulator channel is configured to facilitate flow of a regulating fluid to compensate for changes in volume of a medical fluid in the vial. In some embodiments, an expansion member is disposed on the housing member and is configured to expand and contract in accordance with changes in the volume of a medical fluid in the vial.

55 Claims, 20 Drawing Sheets

(56) References Cited

U.S. PATENT DOCUMENTS

| | | | |
|---|---|---|---|
| 2,852,024 | A | 7/1954 | Ryan |
| 2,999,499 | A | 7/1958 | Willet |
| 2,793,758 | A | 3/1961 | Murrish |
| 2,999,500 | A | 9/1961 | Schurer |
| 3,291,151 | A | 12/1966 | Loken |
| RE26,488 | E | 11/1968 | Bull |
| 3,542,240 | A | 11/1970 | Ida |
| 3,557,778 | A | 1/1971 | Hughes |
| 3,584,770 | A | 6/1971 | Taylor |
| 3,797,521 | A | 3/1974 | King |
| 3,822,700 | A | 7/1974 | Pennington |
| 3,844,283 | A | 10/1974 | Dabney |
| 3,853,157 | A | 12/1974 | Madaio |
| 3,923,058 | A | 12/1975 | Weingarten |
| 3,938,520 | A | 2/1976 | Scislowcz et al. |
| 3,940,003 | A | 2/1976 | Larson |
| 3,957,082 | A | 5/1976 | Fuson et al. |
| 3,980,082 | A | 9/1976 | Miller |
| 3,993,063 | A | 11/1976 | Larrabee |
| 4,046,291 | A | 9/1977 | Goda |
| 4,058,121 | A | 11/1977 | Choski et al. |
| 4,143,853 | A | 3/1979 | Abramson |
| 4,207,923 | A | 6/1980 | Giurtino |
| 4,219,021 | A | 8/1980 | Fink |
| 4,240,433 | A | 12/1980 | Bordow |
| 4,240,833 | A | 12/1980 | Myles |
| 4,253,459 | A | 3/1981 | Willis |
| 4,262,671 | A | 4/1981 | Kersten |
| 4,301,799 | A | 11/1981 | Pope, Jr. et al. |
| 4,312,349 | A | 1/1982 | Cohen |
| 4,314,586 | A | 2/1982 | Folkman |
| 4,334,551 | A | 6/1982 | Pfister |
| 4,349,035 | A | 9/1982 | Thomas et al. |
| 4,376,634 | A | 3/1983 | Prior et al. |
| 4,381,776 | A | 5/1983 | Latham, Jr. |
| 4,396,016 | A | 8/1983 | Becker |
| 4,410,321 | A | 10/1983 | Pearson et al. |
| 4,458,733 | A | 7/1984 | Lyons |
| 4,475,915 | A | 10/1984 | Sloane |
| 4,493,348 | A | 1/1985 | Lemmons |
| 4,505,709 | A | 3/1985 | Froning et al. |
| 4,534,758 | A | 8/1985 | Akers et al. |
| 4,564,054 | A | 1/1986 | Gustavsson |
| 4,573,993 | A | 3/1986 | Hoag et al. |
| 4,576,211 | A | 3/1986 | Valentini et al. |
| 4,588,403 | A | 5/1986 | Weiss et al. |
| 4,600,040 | A | 7/1986 | Naslund |
| 4,645,073 | A | 2/1987 | Homan |
| 4,673,404 | A | 6/1987 | Gustavsson |
| 4,730,635 | A | 3/1988 | Linden |
| 4,735,608 | A | 4/1988 | Sardam |
| 4,743,243 | A | 5/1988 | Vaillancourt |
| 4,768,568 | A | 9/1988 | Fournier et al. |
| 4,785,859 | A | 11/1988 | Gustavsson et al. |
| 4,798,578 | A | 1/1989 | Ranford |
| 4,857,068 | A | 8/1989 | Kahn |
| 4,929,230 | A | 5/1990 | Pfleger |
| 4,981,464 | A | 1/1991 | Suzuki |
| 5,006,114 | A | 4/1991 | Rogers |
| 5,060,704 | A | 10/1991 | Rohrbough |
| 5,169,393 | A | 12/1992 | Moorehead et al. |
| 5,176,673 | A | 1/1993 | Marrucchi |
| 5,334,163 | A | 8/1994 | Sinnett |
| 5,349,984 | A | 9/1994 | Weinheimer et al. |
| 5,405,331 | A | 4/1995 | Behnke et al. |
| 5,445,630 | A | 8/1995 | Richmond |
| 5,478,337 | A | 12/1995 | Okamoto et al. |
| 5,580,351 | A | 12/1996 | Helgren et al. |
| 5,660,796 | A | 8/1997 | Sheehy |
| 5,685,866 | A | 11/1997 | Lopez |
| 5,700,245 | A | 12/1997 | Sancoff et al. |
| 5,725,500 | A | 3/1998 | Micheler |
| 5,749,394 | A | 5/1998 | Boehmer et al. |
| 5,766,147 | A | 6/1998 | Sancoff et al. |
| 5,772,079 | A | 6/1998 | Gueret |
| 5,776,125 | A | 7/1998 | Dudar et al. |
| 5,803,311 | A | 9/1998 | Fuchs |
| 5,833,213 | A | 11/1998 | Ryan |
| 5,890,610 | A | 4/1999 | Jansen et al. |
| 6,003,553 | A | 12/1999 | Wahlberg |
| 6,071,270 | A | 6/2000 | Fowles et al. |
| 6,139,534 | A | 10/2000 | Niedospial et al. |
| 6,159,192 | A | 12/2000 | Fowles et al. |
| 6,358,236 | B1 | 3/2002 | DeFoggi et al. |
| 6,457,488 | B2 | 10/2002 | Loo |
| 6,544,246 | B1 | 4/2003 | Niedospial, Jr. |
| 6,551,299 | B2 | 4/2003 | Miyoshi et al. |
| 6,572,256 | B2 | 6/2003 | Seaton et al. |
| 6,679,290 | B2 | 1/2004 | Matthews et al. |
| 6,692,478 | B1 | 2/2004 | Paradis |
| 6,715,520 | B2 | 4/2004 | Andreasson et al. |
| 6,719,719 | B2 | 4/2004 | Carmel et al. |
| 6,832,994 | B2 | 12/2004 | Niedospial, Jr. et al. |
| 6,989,002 | B2 | 1/2006 | Guala |
| 6,997,910 | B2 | 2/2006 | Howlett et al. |
| 6,997,917 | B2 | 2/2006 | Niedospial, Jr. et al. |
| 7,004,926 | B2 | 2/2006 | Navia et al. |
| 7,048,720 | B1 | 5/2006 | Thorne, Jr. et al. |
| 7,086,431 | B2 | 8/2006 | D'Antonio et al. |
| 7,101,354 | B2 | 9/2006 | Thorne, Jr. et al. |
| 7,140,401 | B2 | 11/2006 | Wilcox et al. |
| 7,306,584 | B2 | 2/2007 | Wessman et al. |
| 7,192,423 | B2 | 3/2007 | Wong |
| 7,213,702 | B2 | 5/2007 | Takimoto et al. |
| 7,291,131 | B2 | 11/2007 | Call |
| 7,326,194 | B2 | 2/2008 | Zinger et al. |
| 7,354,427 | B2 | 4/2008 | Fangrow |
| 7,507,227 | B2 | 3/2009 | Fangrow |
| 7,510,547 | B2 | 3/2009 | Fangrow |
| 7,510,548 | B2 | 3/2009 | Fangrow |
| 7,513,895 | B2 | 4/2009 | Fangrow |
| 7,530,546 | B2 | 5/2009 | Ryan |
| 7,534,238 | B2 | 5/2009 | Fangrow |
| 7,547,300 | B2 | 6/2009 | Fangrow |
| 7,569,043 | B2 | 8/2009 | Fangrow |
| 7,618,408 | B2 | 11/2009 | Yandell |
| 7,632,261 | B2 | 12/2009 | Zinger et al. |
| 7,645,271 | B2 | 1/2010 | Fangrow |
| 7,654,995 | B2 | 2/2010 | Warren et al. |
| 7,658,733 | B2 | 2/2010 | Fangrow |
| 7,678,333 | B2 | 3/2010 | Reynolds et al. |
| 7,703,486 | B2 | 4/2010 | Costanzo |
| 7,731,678 | B2 | 6/2010 | Tennican et al. |
| 7,743,799 | B2 | 6/2010 | Mosler et al. |
| 7,744,580 | B2 | 6/2010 | Reboul |
| 7,758,560 | B2 | 7/2010 | Connell et al. |
| 7,789,871 | B1 | 9/2010 | Yandell |
| 7,799,009 | B2 | 9/2010 | Niedospial, Jr. et al. |
| D630,732 | S | 1/2011 | Lev et al. |
| 7,862,537 | B2 | 1/2011 | Zinger et al. |
| 7,879,018 | B2 | 2/2011 | Zinger et al. |
| 7,883,499 | B2 | 2/2011 | Fangrow |
| 7,887,528 | B2 | 2/2011 | Yandell |
| 7,900,659 | B2 | 3/2011 | Whitley et al. |
| D637,713 | S | 5/2011 | Nord et al. |
| 7,942,860 | B2 | 5/2011 | Horppu |
| 7,963,954 | B2 | 6/2011 | Kavazov |
| D641,080 | S | 7/2011 | Zinger et al. |
| 7,972,321 | B2 | 7/2011 | Fangrow |
| 7,975,733 | B2 | 7/2011 | Horppu et al. |
| 7,981,089 | B2 | 7/2011 | Weilbacher |
| 7,981,101 | B2 | 7/2011 | Walsh |
| 7,998,106 | B2 | 8/2011 | Thorne, Jr. et al. |
| 8,021,325 | B2 | 9/2011 | Zinger et al. |
| 8,025,653 | B2 | 9/2011 | Capitqaine et al. |
| 8,029,747 | B2 | 10/2011 | Helmerson |
| 8,074,964 | B2 | 12/2011 | Mansour et al. |
| 8,096,525 | B2 | 1/2012 | Ryan |
| 8,100,154 | B2 | 1/2012 | Reynolds et al. |
| 8,109,285 | B2 | 2/2012 | Ehrman et al. |
| 8,122,923 | B2 | 2/2012 | Kraus et al. |
| 8,123,736 | B2 | 2/2012 | Kraushaar et al. |
| 8,141,601 | B2 | 3/2012 | Fehr et al. |
| 8,156,971 | B2 | 4/2012 | Costanzo |

(56) References Cited

U.S. PATENT DOCUMENTS 8,162,006 B2 4/2012 Guala
8,162,013 B2 4/2012 Rosenquist et al.
8,162,914 B2 4/2012 Kraushaar et al.
8,167,863 B2 5/2012 Yow
8,167,864 B2 5/2012 Browne
8,177,768 B2 5/2012 Leinsing
8,196,614 B2 6/2012 Kriheli
8,197,459 B2 6/2012 Jansen et al.
8,206,367 B2 6/2012 Warren et al.
8,211,082 B2 7/2012 Hasegawa et al.
8,221,382 B2 7/2012 Moy et al.
8,225,826 B2 7/2012 Horppu et al.
8,231,567 B2 7/2012 Tennican et al.
8,241,265 B2 8/2012 Moy et al.
8,262,643 B2 9/2012 Tennican
8,267,127 B2 9/2012 Kriheli
8,267,913 B2 9/2012 Fangrow
8,281,807 B2 10/2012 Trombley, III et al.
8,286,936 B2 10/2012 Kitani et al.
8,287,513 B2 10/2012 Ellstrom et al.
8,336,587 B2 12/2012 Rosenquist et al.
8,356,644 B2 1/2013 Chong et al.
8,356,645 B2 1/2013 Chong et al.
8,357,137 B2 1/2013 Yandell
8,366,658 B2 2/2013 Davis et al.
8,381,776 B2 2/2013 Horppu
8,403,905 B2 3/2013 Yow
8,409,164 B2 4/2013 Fangrow
8,409,165 B2 4/2013 Niedsopial et al.
8,414,554 B2 4/2013 Garfield et al.
8,414,555 B2 4/2013 Garfield et al.
8,425,487 B2 4/2013 Beiriger et al.
8,449,521 B2 5/2013 Thorne, Jr. et al.
8,469,939 B2 6/2013 Fangrow
8,506,548 B2 8/2013 Okiyama
8,511,352 B2 8/2013 Kraus et al.
8,512,307 B2 8/2013 Fangrow
8,523,838 B2 9/2013 Tornqvist
8,540,692 B2 9/2013 Fangrow
8,602,067 B2 12/2013 Kuhni et al.
8,608,723 B2 12/2013 Lev et al.
8,622,985 B2 1/2014 Ellstrom
8,657,803 B2 2/2014 Helmerson et al.
8,667,996 B2 3/2014 Gonnelli et al.
8,684,992 B2 4/2014 Sullivan et al.
8,684,994 B2 4/2014 Lev et al.
8,701,696 B2 4/2014 Guala
8,702,675 B2 4/2014 Imai
8,720,496 B2 5/2014 Huwiler et al.
8,721,614 B2 5/2014 Takemoto et al.
8,753,325 B2 6/2014 Lev et al.
8,795,231 B2 8/2014 Chong et al.
8,801,678 B2 8/2014 Panian et al.
8,801,689 B2 8/2014 Moy et al.
8,821,436 B2 9/2014 Mosler et al.
8,827,977 B2 9/2014 Fangrow
8,864,725 B2 10/2014 Ranalletta et al.
8,864,737 B2 10/2014 Hasegawa et al.
8,870,832 B2 10/2014 Raday et al.
8,870,846 B2 10/2014 Davis et al.
8,882,738 B2 11/2014 Fangrow et al.
8,900,212 B2 12/2014 Kubo
8,910,919 B2 12/2014 Yow
8,926,554 B2 1/2015 Okuda et al.
8,945,084 B2 2/2015 Warren et al.
8,974,433 B2 3/2015 Fangrow
8,979,792 B2 3/2015 Lev et al.
8,986,262 B2 3/2015 Young et al.
8,992,501 B2 3/2015 Seifert et al.
9,005,179 B2 4/2015 Fangrow et al.
9,005,180 B2 4/2015 Seifert et al.
9,060,921 B2 6/2015 Seifert et al.
9,067,049 B2 6/2015 Panian et al.
9,072,657 B2 7/2015 Seifert et al.
9,089,474 B2 7/2015 Cederschiöld
9,089,475 B2 7/2015 Fangrow
9,101,717 B2 8/2015 Mansour et al.
9,107,808 B2 8/2015 Fangrow
9,107,809 B2 8/2015 Garfield et al.
9,132,062 B2 9/2015 Fangrow
9,132,063 B2 9/2015 Lev et al.
9,144,646 B2 9/2015 Barron, III et al.
9,198,832 B2 12/2015 Moy et al.
9,205,248 B2 12/2015 Wu et al.
9,211,231 B2 12/2015 Mansour et al.
9,237,986 B2 1/2016 Mansour et al.
9,345,641 B2 5/2016 Krause et al.
9,351,905 B2 5/2016 Fangrow et al.
9,358,182 B2 6/2016 Garfield et al.
9,370,466 B2 6/2016 Garfield et al.
9,381,135 B2 7/2016 Reynolds et al.
9,381,137 B2 7/2016 Garfield et al.
9,381,339 B2 7/2016 Wu et al.
9,572,750 B2 2/2017 Mansour et al.
9,610,217 B2 4/2017 Fangrow
9,615,997 B2 4/2017 Fangrow
9,662,272 B2 5/2017 Warren et al.
2002/0095133 A1* 7/2002 Gillis ..... A61M 25/0026 604/502
2002/0193777 A1 12/2002 Aneas
2003/0153895 A1 8/2003 Leinsing
2003/0216695 A1 11/2003 Yang
2004/0073169 A1 4/2004 Amisar et al.
2004/0073189 A1 4/2004 Wyatt et al.
2005/0087715 A1 4/2005 Doyle
2005/0131357 A1 6/2005 Denton et al.
2005/0148992 A1 7/2005 Simas, Jr. et al.
2005/0203481 A1 9/2005 Orlu et al.
2006/0025747 A1 2/2006 Sullivan et al.
2006/0106360 A1 5/2006 Wong
2006/0111667 A1 5/2006 Matsuura et al.
2006/0149309 A1 7/2006 Paul et al.
2006/0184103 A1 8/2006 Paproski et al.
2006/0184139 A1 8/2006 Quigley et al.
2007/0071243 A1 3/2007 Nanda
2007/0079894 A1 4/2007 Karus et al.
2007/0093775 A1 4/2007 Daly
2007/0112324 A1 5/2007 Hamedi-Sangsari
2007/0208320 A1 9/2007 Muramatsu et al.
2008/0045919 A1 2/2008 Jakob et al.
2008/0067462 A1 3/2008 Miller et al.
2008/0142388 A1* 6/2008 Whitley ..... A61J 1/2096 206/438
2008/0172003 A1 7/2008 Plishka et al.
2008/0172024 A1 7/2008 Yow
2008/0249498 A1* 10/2008 Fangrow ..... A61J 1/2096 604/411
2008/0312634 A1 12/2008 Helmerson et al.
2009/0036861 A1 2/2009 Moy et al.
2009/0057258 A1 3/2009 Tornqvist
2009/0177170 A1 7/2009 Kitani et al.
2009/0200504 A1 8/2009 Ryan
2009/0216212 A1 8/2009 Fangrow
2010/0059474 A1 3/2010 Brandenburger et al.
2010/0147402 A1 6/2010 Tornqvist
2010/0160889 A1 6/2010 Smith et al.
2010/0179506 A1 7/2010 Shemesh et al.
2010/0305548 A1 12/2010 Kraushaar
2011/0004183 A1 1/2011 Carrez et al.
2011/0062703 A1 3/2011 Lopez et al.
2011/0108158 A1 5/2011 Huwiler et al.
2011/0112501 A1 5/2011 Garfield et al.
2011/0125104 A1 5/2011 Lynn
2011/0125128 A1 5/2011 Nord et al.
2011/0175347 A1 7/2011 Okiyama
2011/0184382 A1 7/2011 Cady
2011/0190723 A1 8/2011 Fangrow
2011/0208128 A1 8/2011 Wu et al.
2011/0240158 A1 10/2011 Py
2011/0257621 A1 10/2011 Fangrow
2011/0264037 A1 10/2011 Foshee et al.
2012/0046636 A1 2/2012 Kriheli
2012/0059346 A1 3/2012 Sheppard et al.
2012/0065609 A1 3/2012 Seifert et al.

(56) References Cited

U.S. PATENT DOCUMENTS

2012/0065610 A1 3/2012 Seifert et al.
2012/0067429 A1 3/2012 Mosler et al.
2012/0078091 A1 3/2012 Suchecki
2012/0078214 A1 3/2012 Finke et al.
2012/0078215 A1 3/2012 Finke et al.
2012/0109077 A1 5/2012 Ryan
2012/0157960 A1 6/2012 Fangrow
2012/0157964 A1 6/2012 Haimi
2012/0165779 A1 6/2012 Seifert et al.
2012/0179129 A1 7/2012 Imai
2012/0215181 A1 8/2012 Lee
2012/0296306 A1 11/2012 Seifert et al.
2012/0298254 A1 11/2012 Brem et al.
2012/0302986 A1 11/2012 Brem et al.
2012/0330269 A1 12/2012 Fangrow et al.
2013/0030386 A1 1/2013 Panian et al.
2013/0033034 A1 2/2013 Trombley, III et al.
2013/0035668 A1 2/2013 Kitani et al.
2013/0053814 A1 2/2013 Mucientes et al.
2013/0053815 A1 2/2013 Mucientes et al.
2013/0060226 A1 3/2013 Fini et al.
2013/0066293 A1 3/2013 Garfield et al.
2013/0102974 A1 4/2013 Davis et al.
2013/0110053 A1* 5/2013 Yoshino ..... A61M 5/2425 604/201
2013/0130197 A1 5/2013 Jessop et al.
2013/0180618 A1 7/2013 Py
2013/0190684 A1 7/2013 Panian et al.
2013/0199669 A1 8/2013 Moy et al.
2013/0218121 A1 8/2013 Waller et al.
2013/0226128 A1 8/2013 Fangrow
2013/0228239 A1 9/2013 Cederschiöld
2013/0231630 A1 9/2013 Krause et al.
2013/0306169 A1 11/2013 Weibel
2014/0000738 A1 1/2014 Reynolds et al.
2014/0014210 A1 1/2014 Cederschiöld
2014/0020792 A1 1/2014 Kraus et al.
2014/0124087 A1 5/2014 Anderson et al.
2014/0124092 A1 5/2014 Gonnelli et al.
2014/0124528 A1 5/2014 Fangrow
2014/0150925 A1 6/2014 Sjogren et al.
2014/0261727 A1 9/2014 Mansour et al.
2014/0261860 A1 9/2014 Heath et al.
2014/0261877 A1 9/2014 Ivosevic et al.
2014/0276649 A1 9/2014 Ivosevic et al.
2014/0358073 A1 12/2014 Panian et al.
2015/0020920 A1 1/2015 Lev et al.
2015/0065987 A1 3/2015 Fangrow
2015/0068640 A1 3/2015 Garfield et al.
2015/0082746 A1 3/2015 Ivosevic et al.
2015/0123398 A1 5/2015 Sanders et al.
2015/0126958 A1 5/2015 Sanders et al.
2015/0157848 A1 6/2015 Wu et al.
2015/0202121 A1 7/2015 Seifert
2015/0209220 A1 7/2015 Garfield et al.
2015/0209230 A1 7/2015 Lev et al.
2015/0209233 A1 7/2015 Fukuoka
2015/0209235 A1 7/2015 Garfield et al.
2015/0209572 A1 7/2015 Garfield et al.
2015/0250680 A1 9/2015 Browka et al.
2015/0250681 A1 9/2015 Lev et al.
2015/0265500 A1 9/2015 Russo et al.
2015/0297451 A1 10/2015 Marici et al.
2015/0297453 A1 10/2015 Kim et al.
2015/0297454 A1 10/2015 Sanders et al.
2015/0297456 A1 10/2015 Marici et al.
2015/0297459 A1 10/2015 Sanders et al.
2015/0297461 A1 10/2015 Fangrow
2015/0297817 A1 10/2015 Guala
2015/0297839 A1 10/2015 Sanders et al.
2015/0320642 A1 11/2015 Fangrow
2015/0320992 A1 11/2015 Bonnet et al.
2015/0359709 A1 12/2015 Kriheli et al.
2015/0366758 A1 12/2015 Noguchi et al.
2016/0000653 A1 1/2016 Kramer
2016/0008534 A1 1/2016 Cowan et al.
2016/0038373 A1 2/2016 Ohlin
2016/0038374 A1 2/2016 Merhold et al.
2016/0051446 A1 2/2016 Lev et al.
2016/0058667 A1 3/2016 Kriheli
2016/0081878 A1 3/2016 Marks et al.
2016/0081879 A1 3/2016 Garfield et al.
2016/0101020 A1 4/2016 Guala
2016/0120753 A1 5/2016 Warren
2016/0120754 A1 5/2016 Fangrow
2016/0136051 A1 5/2016 Lavi
2016/0136412 A1 5/2016 McKinnon et al.
2016/0206511 A1 7/2016 Garfield et al.
2016/0206512 A1 7/2016 Chhikara et al.
2016/0213568 A1 7/2016 Mansour et al.
2016/0250102 A1 9/2016 Garfield et al.
2016/0262981 A1 9/2016 Carrez et al.
2016/0338911 A1 11/2016 Fangrow
2017/0095404 A1 4/2017 Fangrow
2017/0196772 A1 7/2017 Seifert
2017/0196773 A1 7/2017 Fangrow
2017/0202744 A1 7/2017 Fangrow
2017/0202745 A1 7/2017 Seifert
2017/0239140 A1 8/2017 Fangrow
2017/0296431 A1 10/2017 Fangrow
2017/0312176 A1 11/2017 Fangrow
2017/0333288 A1 11/2017 Fangrow

FOREIGN PATENT DOCUMENTS

GB 2 000 685 1/1979
JP H06-66682 9/1994
WO WO 97/002853 1/1997
WO WO 2000/035517 6/2000
WO WO 2005/065626 7/2005
WO WO 2010/069359 6/2010
WO WO 2010/093581 8/2010
WO WO 2013/025946 2/2013
WO WO 2013/106757 7/2013
WO WO 2013/142618 9/2013
WO WO 2014/122643 8/2014
WO WO 2014/181320 11/2014
WO WO 2015/029018 3/2015
WO WO 2015/009746 4/2015
WO WO 2016/147178 9/2016

OTHER PUBLICATIONS

U.S. Appl. No. 14/161,591, filed Jan. 22, 2014, Fangrow.
International Search Report dated Jan. 16, 2008, International Application No. PCT/US2007/008809, filed Apr. 4, 2007.
International Preliminary Report on Patentability dated Oct. 14, 2008, International Application No. PCT/US2007/008809, filed Apr. 4, 2007.
International Invitation to Pay Additional Fees and Communication Relating to the Results of the Partial International Search dated Nov. 6, 2007, International Application No. PCT/US2007/008809, filed Apr. 4, 2007.
International Search Report and Written Opinion dated Nov. 27, 2009, International Application No. PCT/US2009/054217, filed Aug. 18, 2009.
International Preliminary Report on Patentability dated Feb. 22, 2011, International Application No. PCT/US2009/054217, filed Aug. 18, 2009.
International Search Report and Written Opinion dated Mar. 26, 2013, International Application No. PCT/US2013/21296.
International Preliminary Report on Patentability dated Jul. 24, 2014, International Application No. PCT/US2013/21296.
International Search Report and Written Opinion dated Oct. 22, 2012, International Application No. PCT/US2012/051226, filed Aug. 16, 2012.
International Preliminary Report on Patentability and Written Opinion dated Feb. 28, 2014, International Application No. PCT/US2012/051226, filed Aug. 16, 2012.
International Search Report and Written Opinion dated Jun. 17, 2013, International Application Application No. PCT/US2013/33183.

(56) References Cited

OTHER PUBLICATIONS

International Search Report and Written Opinion dated Apr. 14, 2014, International Application No. PCT/US2014/012381.
OnGuard Contained Medication System with Tevadaptor Components, B. Braud Medical, Inc., Apr. 2007.
PhaSeal, The PhaSeal® Solution, http://www.phaseal.com/siteUS/page.asp?menuitem=145&right=0, dated Jan. 9, 2006.
PhaSeal, How to Use PhaSeal®, http://www.phaseal.com/siteUS/movies.asp?main=filmsmain&right=filmsright, dated Jul. 25, 2005.
"Protection Safey Products", IV Sets and Access Devices Medication Delivery Catalog, Chemo-Aide Dispensing Pin, Dec. 2002, pp. 7,21, Baxter Healthcare Corporation, Round Lake, IL.
Clave—NeedleFree Connector, 2-page brochure, 2012 ICU Medical, Inc. (M1-1065 Rev. 04).
Genie—Closed Vial Access Device, 2-page brochure, 2012 ICU Medical, Inc. (M1-1186 Rev. 11).
Spiros—Closed Male Luer, 2-page brochure, 2012 ICU Medical, Inc. (M1-1184 Rev. 11).
Equashield, Hazardous Drugs Closed System Transfer Device, two webpages from http:/www.equashield.com, downloaded Jul. 22, 2013.

* cited by examiner

PRESSURE-REGULATING VIAL ADAPTORS AND METHODS

RELATED APPLICATIONS

This application claims the benefit under 35 U.S.C. § 120 and 35 U.S.C. § 365(c) as a continuation of International Application No. PCT/US2013/021296, designating the United States, with an international filing date of Jan. 11, 2013, titled PRESSURE-REGULATING VIAL ADAPTORS AND METHODS, which claims the benefit of U.S. Provisional Application No. 61/586,418, filed Jan. 13, 2012, titled PRESSURE-REGULATING VIAL ADAPTORS AND METHODS, the entirety of each of which is incorporated by reference herein and made a part of this specification.

BACKGROUND

Field

Certain embodiments disclosed herein relate to adaptors for coupling with medicinal vials and methods to aid in regulating pressure changes within medicinal vials.

Description of the Related Art

It is a common practice to store medicines or other medically related fluids in vials. In some instances, the medicines or fluids in vials are therapeutic if injected into the bloodstream, but harmful if inhaled or if contacted by exposed skin. Certain known systems for extracting potentially harmful medicines from vials suffer from various drawbacks.

SUMMARY

In some embodiments, a vial adaptor includes a housing member comprising a piercing member comprising a proximal end and a distal end. The piercing member can be configured to pierce the septum of a vial. The adaptor can also include a connector configured to couple the housing member with the vial. Further, the adaptor can include an extractor channel formed in the housing member, the extractor channel configured to facilitate withdrawal of a medical fluid from the vial when the adaptor is coupled to the vial. The adaptor can additionally have a regulator channel formed in the piercing member, the regulator channel configured to facilitate a flow of a regulating fluid therethrough during withdrawal of the medical fluid. The adaptor can also have an expansion member connected with an external surface of the proximal end of the piercing member and in fluid communication with the regulator channel. The expansion member can be configured to expand to receive the flow of the regulating fluid as the medical fluid is withdrawn from the vial.

In some embodiments, the expansion member is configured to regulate pressure in the vial when fluid is withdrawn from the vial. In some variants, the expansion member comprises polyisoprene or silicone rubber.

In some embodiments, the piercing member comprises a terminal member. In some variants, the terminal member is detachable from a remainder of the piercing member. In some implementations, the terminal member comprises brass or aluminum or polypropelene or polycarbonate, or glass impregnated Valox™. In some variants, the terminal member is in airtight engagement with the expansion member.

In certain implementations, the piercing member is configured to have a total axial length that is about equal to a total axial length of the vial. In some variants, a distal-most end of the piercing member is configured to be positioned adjacent a distal end of the vial. Sometimes, a distal end of the piercing member is closed. In some embodiments, the piercing member comprises a vent in fluid communication with the regulator channel. In certain implementations, the piercing member comprises a plurality of perforations in fluid communication with the regulator channel. In some embodiments, the piercing member comprises a plurality of annular ribs.

In some embodiments, the adaptor also includes a lubricant applied to at least one of the piercing member and the expansion member. The lubricant can be, for example, fluorosilicone oil. In some embodiments, the expansion member is bonded to the piercing member with an adhesive. The adhesive can be, for example, a RTV silicone adhesive.

In some embodiments, the expansion member is connected with a proximal-most end of the piercing member. In some embodiments, the expansion member is connected with the piercing member a distance from a proximal-most end of the piercing member. In certain embodiments, the distance is at least about 10% of an axial length of the piercing member.

In certain implementations, the expansion member further comprises a proximal portion that does not include a proximal-most end of the expansion member. In some variants, the expansion member further comprises a distal portion that does not include a distal-most end of the expansion member.

In some embodiments, the external surface of the proximal end of the piercing member is positioned radially outward of the piercing member with respect to an axial center of the piercing member.

In some embodiments, a pressure-regulating vial adaptor includes a body comprising a connector and a piercing member, the connector configured to couple with a vial, the piercing member configured to pierce a septum of the vial. The adaptor can also include an extractor channel formed in the body, the extractor channel configured to allow withdrawal of a medical fluid from the vial when the adaptor is coupled to the vial. The adaptor can further include a regulator channel formed in the piercing member, the regulator channel configured to allow a flow of ambient air therethrough during withdrawal of the medical fluid. The adaptor can also include an expansion member in fluid communication with the regulator channel and configured to expand to receive the flow of ambient air, a first portion of the expansion member in airtight engagement with a first region of the piercing member, a second portion of the expansion member in airtight engagement with a second region of the piercing member, the first region being spaced apart from the second region. In some variants, the expansion member is configured to regulate a pressure in the vial.

In some embodiments, the first portion comprises a proximal end of the expansion member and the second portion comprises a distal end of the expansion member. In some variants, the first region is located on an outside surface of the piercing member. In some variants, a distal end of the piercing member is closed.

In certain implementations, the piercing member comprises a sidewall, the sidewall comprising a vent, the vent in fluid communication with the regulator channel and the expansion member. In some implementations, the expansion member comprises polyisoprene or silicone rubber. In some embodiments, the piercing member is configured to have a total axial length that is about equal to a total axial length of the vial.

In certain implementations, a distal-most end of the piercing member is configured to be positioned adjacent a distal end of the vial. In some implementations, the vent comprises a plurality of apertures. In some variants, the piercing member comprises a plurality of annular ribs.

In some embodiments, the adaptor also includes a lubricant applied to at least one of the piercing member and the expansion member. In some variants, the lubricant is fluorosilicone oil.

In some embodiments, the expansion member is bonded to the piercing member with an adhesive. In some variants, the adhesive comprises a RTV silicone adhesive.

In some embodiments, a vial adaptor comprises a housing member comprising a piercing member, the piercing member having an axial length and configured to pierce the septum of a vial. The adaptor can further include a connector configured to couple the housing member with the vial. The adaptor can also have an extractor channel formed in the housing member, the extractor channel configured to facilitate withdrawal of a medical fluid from the vial when the adaptor is coupled to the vial. Additionally, the adaptor can include a regulator channel formed in the piercing member, the regulator channel configured to facilitate a flow of a regulating fluid therethrough during withdrawal of the medical fluid. Further, the adaptor can have an expansion member in fluid communication with the regulator channel, the expansion member comprising at least one aperture and containing a cylindrical or spheroidal volume. In some implementations, the expansion member is configured to receive through the aperture and into the volume a substantial portion of the axial length of the piercing member. The expansion member can also be configured to expand to receive the flow of the regulating fluid as the medical fluid is withdrawn from the vial.

In some embodiments, the expansion member is configured to receive at least 50% of the axial length of the piercing member. In some implementations, the expansion member encompasses a prolate or oblate spheroid volume. In some embodiments, the expansion member further comprises an axial intermediate region in contact with the piercing member.

In certain embodiments, the expansion member is connected with the external surface of the piercing member. In some variants, the expansion member is configured to regulate a pressure in the vial. In some embodiments, the expansion member is connected to an external surface of the piercing member. In some implementations, the expansion of the expansion member regulates a pressure in the vial. In some embodiments, the piercing member comprises a terminal member. The terminal member can be detachable from a remainder of the piercing member. The terminal member can be, e.g., brass, aluminum, polypropelene, polycarbonate, or glass impregnated Valox™. The terminal member can be in airtight engagement with the expansion member. In some embodiments, the expansion member comprises polyisoprene or silicone rubber.

In some embodiments, the piercing member is configured to have a total axial length that is about equal to a total axial length of the vial. In some embodiments, a distal-most end of the piercing member is configured to be positioned adjacent a distal end of the vial. In certain implementations, a distal end of the piercing member is closed. In some embodiments, the piercing member comprises a vent in fluid communication with the regulator channel. In some embodiments, the piercing member comprises a plurality of perforations in fluid communication with the regulator channel. In some embodiments, the piercing member comprises a plurality of annular ribs.

In certain implementations, the adaptor also includes a lubricant applied to at least one of the piercing member and the expansion member. The lubricant can be, e.g., fluorosilicone oil. In some embodiments, the expansion member is bonded to the piercing member with an adhesive, such as a RTV silicone adhesive.

In some embodiments, a method of maintaining a substantially constant pressure within a vial includes providing a housing member comprising a piercing member and configured to couple with a vial; permitting a medical fluid to flow through an extractor channel formed in the housing member, the extractor channel configured to facilitate withdrawal of a medical fluid from the vial when the adaptor is coupled to the vial; and permitting a regulating fluid to flow through a regulator channel during withdrawal of the medical fluid, the regulator channel formed in the piercing member, the regulating fluid being received in an expansion member connected to a proximal end of the piercing member, the expansion member being configured to expand in as the medical fluid is withdrawn.

In some embodiments, the expansion member is connected to the external surface of the piercing member. In certain embodiments, the expansion member is configured to regulate a pressure in the vial.

In some embodiments, the piercing member comprises a tip member. The tip member can be detachable from the remainder of the piercing member. In some variants, the tip member comprises polypropelene, polycarbonate, or glass impregnated Valox™. In some aspects, the tip member is in airtight engagement with the expansion member.

In some embodiments, the expansion member comprises polyisoprene or silicone rubber. In some embodiments, the piercing member is configured to have a total axial length that is about equal to a total axial length of the vial.

In some embodiments, a distal-most end of the piercing member is configured to be positioned adjacent a distal end of the vial. In certain implementations, a distal end of the piercing member is closed. In certain variants, the piercing member comprises a vent in fluid communication with the regulator channel. In some embodiments, the piercing member comprises a plurality of perforations in fluid communication with the regulator channel. In some embodiments, the piercing member comprises a plurality of annular ribs.

In certain implementations, the method further includes applying a lubricant to at least one of the piercing member and the expansion member. In some embodiments, the lubricant comprises fluorosilicone oil. In some variants, the expansion member is bonded to the piercing member with an adhesive. In some variants, the adhesive comprises a RTV silicone adhesive.

In some embodiments, a method of manufacturing a pressure-regulating vial adaptor includes providing a body comprising a connector, an extractor channel, and a piercing member, the connector configured to couple with a vial, the extractor channel configured to allow withdrawal of a medical fluid from the vial when the adaptor is coupled to the vial, the piercing member configured to pierce a septum of the vial. In some embodiments, the piercing member includes a first region, a second region spaced apart from the first region, and a regulator channel configured to allow a flow of ambient air therethrough during withdrawal of the medical fluid. The method can also include providing an expansion member configured to expand to receive the flow of ambient air, the expansion member comprising a first portion and a second portion. Further, the method can include connecting the first portion of the expansion member with the first region of the piercing member. Additionally, the method can include connecting the second portion of the expansion member with the second region of the piercing member. In certain implementations, the method further includes lubricating the expansion member. In some embodiments, the first region is located on an outside surface of the piercing member.

In certain embodiments, a pressure regulating vial adaptor includes a housing adapted to couple with a vial, the housing comprising a piercing member, the piercing member configured to pass through a septum of the vial when the housing is coupled with the vial. The adaptor can further have an expansion member connected with the piercing member, the expansion member configured to contact the septum when the piercing member is passed through the septum.

In some embodiments, at least one of the piercing member and the expansion member comprises a texture element configured to promote friction between the piercing member and the expansion member and thereby inhibit movement of expansion member relative to the piercing member when the piercing member is passed through the septum. In some variants, the texture element comprises a plurality of annular ribs. In certain embodiments, the texture element comprises a plurality of grooves. In certain implementations, the texture element comprises a plurality of dimples. In some implementations, the texture element comprises a plurality of perforations in the piercing member. In some embodiments, the piercing member further comprises an outside surface and an inside surface, the inside surface forming a fluid flow channel in the piercing member, the textured element disposed on the outside surface. In some implementations, the piercing member further comprises a smooth region.

In some embodiments, a pressure regulating vial adaptor includes a housing adapted to couple with a vial configured to contain a volume of medical fluid, the housing comprising a piercing member configured to pierce a septum of the vial when the housing is coupled with the vial, the piercing member comprising an axial length, an outer surface, and an expansion member, the expansion member connected with the outer surface and configured to expand from a first state to a second state at least partly in response to a change in the volume of medical fluid contained the vial, wherein the axial length of the piercing member is substantially the same when the expansion member is in the first state and the second state.

In some embodiments, the expansion member expands substantially transverse to the axial length of the piercing member. In certain embodiments, the piercing member further comprises a plurality of apertures. In some implementations, the adaptor is configured to couple with a vial having a vial width that is greater than a vial height, the vial height being measured from a base of the vial to the septum, the vial width being measured transverse to the height.

In some embodiments, a pressure regulating vial adaptor includes a housing adapted to couple with a vial configured to contain a volume of medical fluid, the housing comprising a piercing member configured to pierce a septum of the vial when the housing is coupled with the vial, the piercing member comprising a longitudinal axis, a sheath, and an expansion member, the expansion member connected with an outside of the sheath and configured to expand substantially orthogonal to the longitudinal axis at least partly in response to a change in the volume of medical fluid contained the vial. In some embodiments, the expansion member is further configured to expand toward a base of the vial positioned opposite the septum, and wherein the expansion of the expansion member is not impeded by the base.

BRIEF DESCRIPTION OF THE DRAWINGS

Various embodiments are depicted in the accompanying drawings for illustrative purposes, and should in no way be interpreted as limiting the scope of the embodiments. In addition, various features of different disclosed embodiments can be combined to form additional embodiments, which are part of this disclosure.

DETAILED DESCRIPTION

Figure 1:
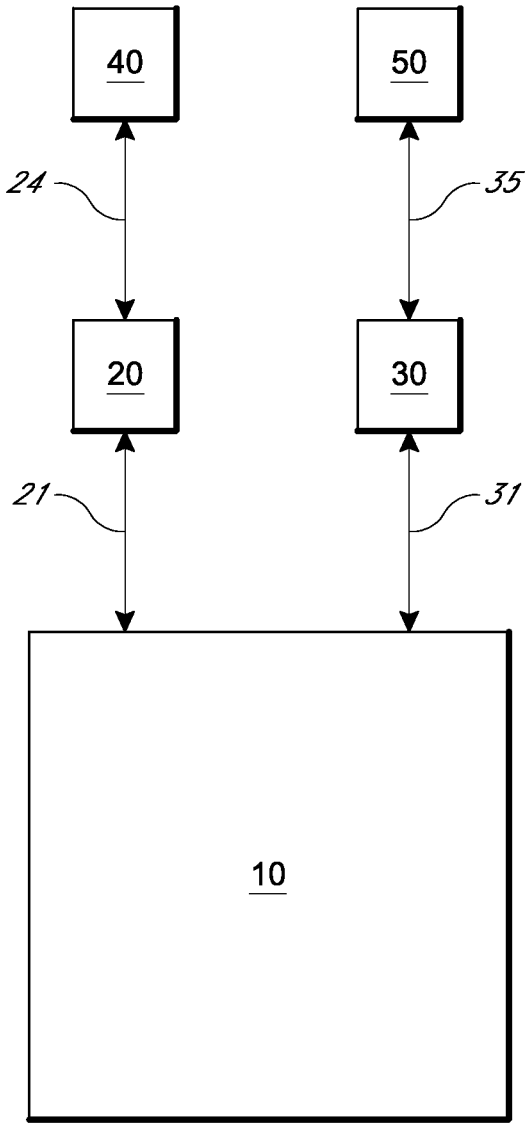
FIG. 1 is a schematic illustration of a system for removing fluid from and/or injecting fluid into a vial.

Numerous medicines and other therapeutic fluids are stored and distributed in medicinal vials of various shapes and sizes. These vials are often hermetically sealed to prevent contamination or leaking of the stored fluid. The pressure differences between the interior of the sealed vials and the particular atmospheric pressure in which the fluid is later removed often give rise to various problems.

For instance, introducing the piercing member of a vial adaptor through the septum of a vial can cause the pressure within the vial to rise sharply. This pressure increase can cause fluid to leak from the vial at the interface of the septum and piercing member or at the attachment interface of the adaptor and a medical device, such as a syringe. Also, it can be difficult to withdraw an accurate amount of fluid from a sealed vial using an empty syringe, or other medical instrument, because the fluid may be naturally urged back into the vial once the syringe plunger is released. As the syringe is decoupled from the vial, pressure differences can sometimes cause a small amount of fluid to spurt from either the syringe or the vial. Additionally, in many instances, air bubbles are drawn into the syringe as fluid is withdrawn from the vial. To rid a syringe of bubbles after removal from the vial, medical professionals often flick the syringe, gathering all bubbles near the opening of the syringe, and then force the bubbles out. In so doing, a small amount of liquid usually is expelled from the syringe as well. Medical personnel generally do not take the extra step to re-couple the syringe with the vial before expelling the bubbles and fluid. In some instances, this may even be prohibited by laws and regulations. Such laws and regulations may also necessitate expelling overdrawn fluid at some location outside of the vial in certain embodiments. Moreover, even if extra air or fluid were attempted to be reinserted in the vial, pressure differences can sometimes lead to inaccurate measurements of withdrawn fluid.

To address these problems caused by pressure differentials, medical professionals frequently pre-fill an empty syringe with a precise volume of ambient air corresponding to the volume of fluid that they intend to withdraw from the vial. The medical professionals then pierce the vial and expel this ambient air into the vial, temporarily increasing the pressure within the vial. When the desired volume of fluid is later withdrawn, the pressure differential between the interior of the syringe and the interior of the vial is generally near equilibrium. Small adjustments of the fluid volume within the syringe can then be made to remove air bubbles without resulting in a demonstrable pressure differential between the vial and the syringe. However, a significant disadvantage to this approach is that ambient air, especially in a hospital setting, may contain various airborne viruses, bacteria, dust, spores, molds, and other unsanitary and harmful debris. The pre-filled ambient air in the syringe may contain one or more of these harmful substances, which may then mix with the medicine or other therapeutic fluid in the vial. If this contaminated fluid is injected directly into a patient's bloodstream, it can be particularly dangerous because it circumvents many of the body's natural defenses to airborne pathogens. Moreover, patients who receive the medicine and other therapeutic fluids are more likely to be suffering from a diminished infection-fighting capacity.

Some of these problems can arise in the context of oncology drugs and some embodiments of the inventions are contemplated for use in administering oncology drugs. Such drugs, although therapeutic when injected into the bloodstream of a patient, can be extremely harmful if inhaled or touched. Accordingly, such drugs can be dangerous if allowed to spurt unpredictably from a vial due to pressure differences. Antineoplastic drugs can be volatile and may aerosolize when exposed to ambient air. Accordingly, expelling a small amount of such drugs in order to clear a syringe of bubbles or excess fluid, even in a controlled manner, is generally not a viable option, especially for medical personnel who may repeat such activities numerous times each day. In some embodiments, a vial adaptor is configured to mitigate or eliminate one or more of the above-noted problems.

Certain devices exist that allow air to be drawn into a vial as fluid is removed therefrom. These devices generally use filters. Although filters remove a large number of contaminants from air as it enters the vial, the filters are not perfect. In some instances, the filters are hydrophobic membranes comprising Gortex® or Teflon®. Multiple problems arise from such assemblies. For example, the hydrophobic nature of the filters prevents a user from returning overdrawn fluid to the vial. For example, in some instances, air is allowed into the vial through a channel as the user withdraws fluid from the vial. However, if the user forces fluid back into the vial, fluid is also forced through the channel until it contacts the filter. Because the filter is a barrier to fluid, the pressure within the vial will increase as the medical professional continues to force fluid into the vial. As stated above, such pressure increases are prohibited by law in some instances, and in any event, can make it difficult for the user to obtain an accurate dosage. In addition, pressure differences can easily damage the thin and delicate membranes, causing the filters to occasionally leak and permit harmful liquids to escape.

Gortex® or Teflon® membranes that are used in filters are typically sterilized with ethylene oxide (EtO), which is expensive and inconvenient for medical device manufacturers. Preferred alternative methods of sterilization, such as gamma sterilization and electron beam sterilization, generally ruin such filters. In some instances, the latter forms of sterilization degrade the Teflon® membranes, making the filters prone to leakage.

In addition, some existing devices are difficult or complicated to couple with a vial and can require specialized connectors or apparatus to effectuate such coupling. Complicated procedures can become overly burdensome to medical personnel who repeat the procedures numerous times each day. Certain complicated devices are bulky and unbalanced. Coupling such a device with a vial generally creates a top-heavy, metastable system that is prone to being tipped over and possibly spilled.

Disclosed herein are numerous embodiments of vial adaptors that reduce, minimize, or eliminate many of the above-noted problems. These embodiments are only illustrative and not intended in any way to restrict the scope of this disclosure and the various aspects and features presented herein. For example, although embodiments and examples are provided herein in the medical field, uses of embodiments disclosed herein are not confined exclusively to the medical field and certain embodiments can be used in other fields. The phraseology and terminology used herein is for the purpose of description and should not be regarded as limiting. No feature, structure, or step disclosed herein is essential or indispensible. Further details and examples regarding some embodiments of vial adaptors are provided in U.S. Patent Application Publication No. 2010/0049157, the entirety of which is incorporated herein by reference and is made a part of this specification.

FIG. 1 is a schematic illustration of a container 10, such as a medicinal vial, that can be coupled with an extractor 20 and a regulator 30. In certain embodiments, the regulator 30 allows the removal of some or all of the contents of the container 10 via the extractor 20 without a significant change of pressure within the container 10.

In general, the container 10 is hermetically sealed to preserve the contents of the container 10 in a sterile environment. The container 10 can be evacuated or pressurized upon sealing. In some instances, the container 10 is partially or completely filled with a liquid, such as a drug or other medical fluid. In such instances, one or more gases can also be sealed in the container 10. Although embodiments and examples are provided herein in the medical field, uses of the embodiments are not confined to the medical field only and certain embodiments can be used in many other fields.

The extractor 20 generally provides access to contents of the container 10 such that the contents may be removed or added to. In certain embodiments, the extractor 20 comprises an opening between the interior and exterior of the container 10. The extractor 20 can comprise a passageway between the interior and exterior of the container 10. In some implementations, the passageway of the extractor 20 can be selectively opened and closed. In some variants, the extractor 20 comprises a conduit extending through a surface of the container 10. The extractor 20 can be integrally formed with the container 10 prior to the sealing thereof or introduced to the container 10 after the container 10 has been sealed.

In some implementations, the extractor 20 is in fluid communication with the container 10, as indicated by an arrow 21. In certain of these implementations, when the pressure inside the container 10 varies from that of the surrounding environment, the introduction of the extractor 20 to the container 10 causes a transfer through the extractor 20. For example, in some embodiments, the pressure of the environment that surrounds the container 10 exceeds the pressure within the container 10, which may cause ambient air from the environment to ingress through the extractor 20 upon insertion of the extractor 20 into the container 10. In some variants, the pressure inside the container 10 exceeds that of the surrounding environment, causing the contents of the container 10 to egress through the extractor 20.

In some implementations, the extractor 20 is coupled with an exchange device 40. In certain instances, the extractor 20 and the exchange device 40 are separable. In some instances, the extractor 20 and the exchange device 40 are integrally formed. The exchange device 40 is configured to accept fluids and/or gases from the container 10 via the extractor 20, to introduce fluids and/or gases to the container 10 via the extractor 20, or to do some combination of the two. In some embodiments, the exchange device 40 is in fluid communication with the extractor 20, as indicated by an arrow 24. In certain implementations, the exchange device 40 comprises a medical instrument, such as a syringe.

In some instances, the exchange device 40 is configured to remove some or all of the contents of the container 10 via the extractor 20. In certain embodiments, the exchange device 40 can remove the contents independent of pressure differences, or lack thereof, between the interior of the container 10 and the surrounding environment. For example, in instances where the pressure outside of the container 10 exceeds that within the container 10, an exchange device 40 comprising a syringe can remove the contents of the container 10 if sufficient force is exerted to extract the plunger from the syringe. The exchange device 40 can similarly introduce fluids and/or gases to the container 10 independent of pressure differences between the interior of the container 10 and the surrounding environment.

In certain implementations, the regulator 30 is coupled with the container 10. The regulator 30 generally regulates the pressure within the container 10. As used herein, the term "regulate", or any derivative thereof, is a broad term used in its ordinary sense and includes, unless otherwise noted, any active, affirmative, or positive activity, or any passive, reactive, respondent, accommodating, or compensating activity that tends to effect a change. In some instances, the regulator 30 substantially maintains a pressure difference, or equilibrium, between the interior of the container 10 and the surrounding environment. As used herein, the term "maintain", or any derivative thereof, is a broad term used in its ordinary sense and includes the tendency to preserve an original condition for some period, whether or not that condition is ultimately altered. In some instances, the regulator 30 maintains a substantially constant pressure within the container 10. In certain instances, the pressure within the container 10 varies by no more than about 1 psi, no more than about 2 psi, no more than about 3 psi, no more than about 4 psi, or no more than about 5 psi. In some instances, the regulator 30 equalizes pressures exerted on the contents of the container 10. As used herein, the term "equalize", or any derivative thereof, is a broad term used in its ordinary sense and includes the movement toward equilibrium, whether or not equilibrium is achieved. In some implementations, the regulator 30 is coupled with the container 10 to allow or encourage equalization of a pressure difference between the interior of the container 10 and some other environment, such as the environment surrounding the container 10 or an environment within the exchange device 40. In some embodiments, a single device comprises the regulator 30 and the extractor 20, while in certain embodiments, the regulator 30 and the extractor 20 are separate units.

The regulator 30 is generally in communication with the container 10, as indicated by an arrow 31, and a reservoir 50, as indicated by another arrow 35. In some implementations, the reservoir 50 comprises at least a portion of the environment surrounding the container 10. In some implementations, the reservoir 50 comprises a container, canister, bag, or other holder dedicated to the regulator 30. As used herein, the term "bag" is a broad term used in its ordinary sense and includes, without limitation, any sack, balloon, bladder, receptacle, reservoir, enclosure, diaphragm, or membrane capable of expanding and/or contracting, including structures comprising a flexible, supple, pliable, resilient, elastic, and/or expandable material. In some embodiments, the reservoir 50 comprises a gas and/or a liquid.

In certain embodiments, the regulator 30 provides fluid communication between the container 10 and the reservoir 50. In certain of such embodiments, it is preferred that the reservoir 50 comprise mainly gas so as not to dilute any liquid contents of the container 10. In some embodiments, the regulator 30 comprises a filter to purify gas or liquid entering the container 10, thereby reducing the risk of contaminating the contents of the container 10. In certain variants, the filter is hydrophobic such that air can enter the container 10 but fluid cannot escape therefrom.

In certain embodiments, the regulator 30 prevents fluid communication between the container 10 and the reservoir 50. In certain of such embodiments, the regulator 30 serves as an interface between the container 10 and the reservoir 50. In some implementations, the regulator 30 comprises a substantially impervious bag for accommodating ingress of gas and/or liquid to the container 10 or egress of gas and/or liquid from the container 10.

Figure 2:
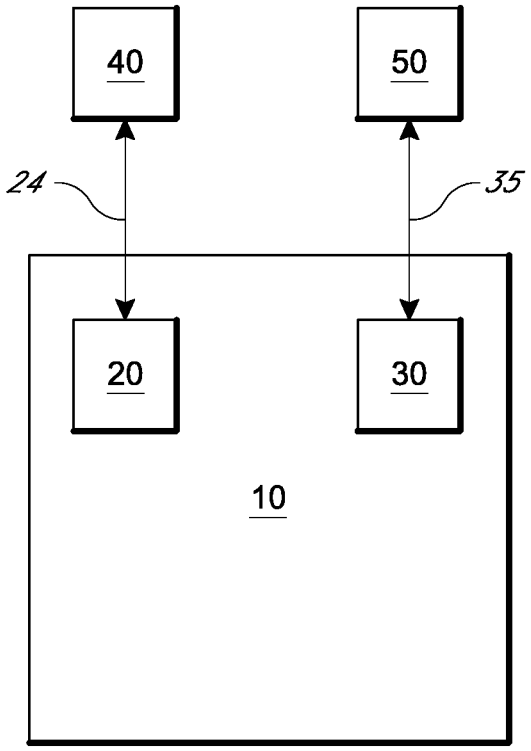
FIG. 2 is a schematic illustration of another system for removing fluid from and/or injecting fluid into a vial.

As schematically illustrated in FIG. 2, in certain embodiments, the extractor 20, or some portion thereof, is located within the container 10. As detailed above, the extractor 20 can be integrally formed with the container 10 or separate therefrom. In some embodiments, the regulator 30, or some portion thereof, is located within the container 10. In such embodiments, the regulator 30 can be placed in the container 10 prior to the sealing thereof or it can be introduced to the container 10 thereafter. In some variants, the regulator 30 is integrally formed with the container 10. It is possible to have any combination of the extractor 20, or some portion thereof, entirely within, partially within, or outside of the container 10 and/or the regulator 30, or some portion thereof, entirely within, partially within, or outside of the container 10.

In certain embodiments, the extractor 20 is in fluid communication with the container 10. In some embodiments, the extractor 20 is in fluid communication with the exchange device 40, as indicated by the arrow 24.

The regulator 30 can be in fluid or non-fluid communication with the container 10. In some embodiments, the regulator 30 is located entirely within the container 10. In certain of such embodiments, the regulator 30 comprises a closed bag configured to expand or contract within the container 10 to maintain a substantially constant pressure within the container 10. In certain embodiments, the regulator 30 is in communication, either fluid or non-fluid, with the reservoir 50, as indicated by the arrow 35.

Figure 3:
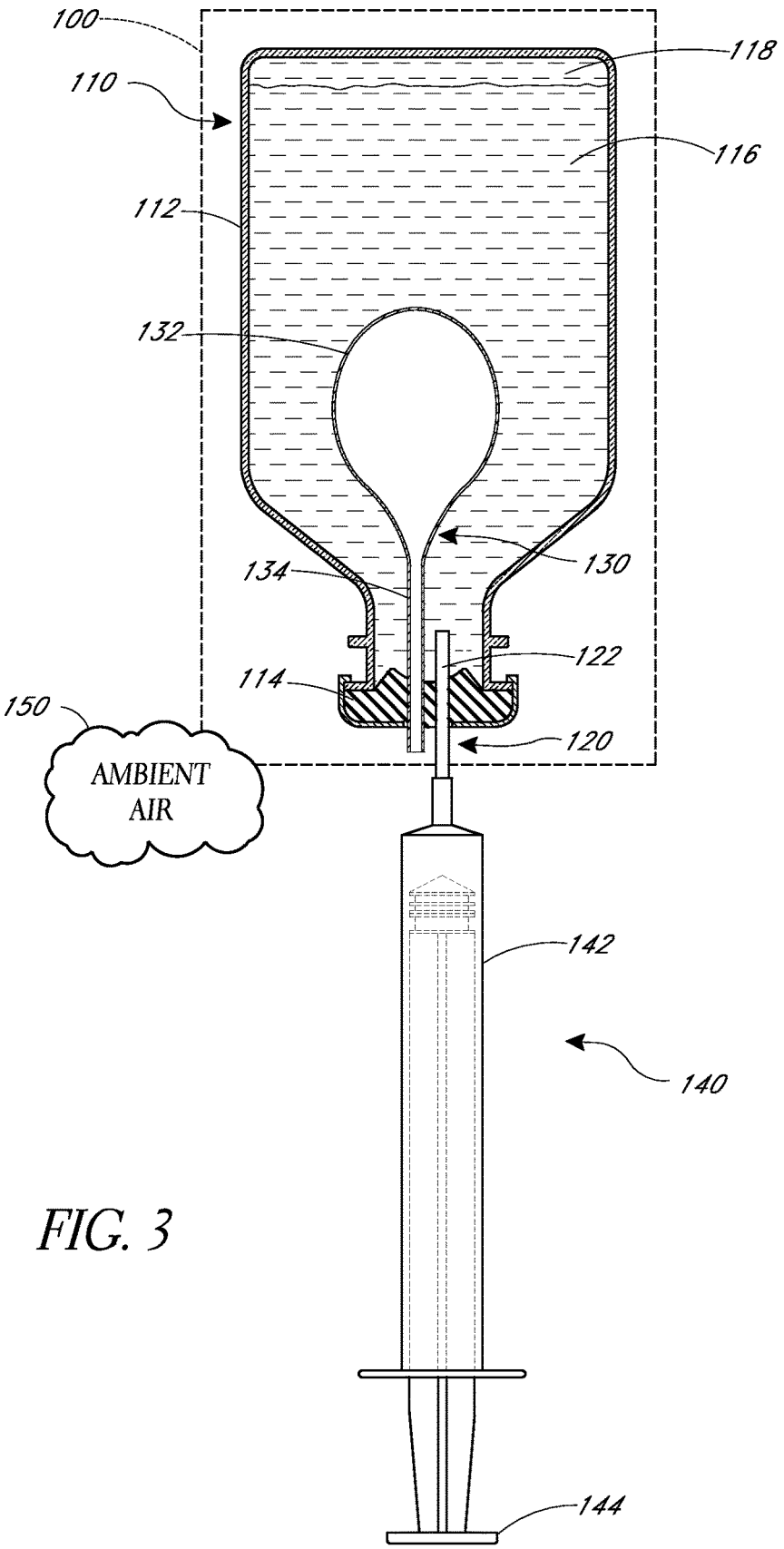
FIG. 3 is an illustration of another system for removing fluid from and/or injecting fluid into a vial.

FIG. 3 illustrates an embodiment of a system 100 comprising a vial 110, an extractor 120, and a regulator 130. The vial 110 comprises a body 112 and a cap 114. In the illustrated embodiment, the vial 110 contains a medical fluid 116 and a relatively small amount of sterilized air 118. In certain embodiments, the fluid 116 is removed from the vial 110 when the vial 110 is oriented with the cap 114 facing downward (e.g., the cap 114 is between the fluid and the ground). The extractor 120 comprises a conduit 122 fluidly connected at one end to an exchange device 140, which comprises a standard syringe 142 with a plunger 144. The conduit 122 extends through the cap 114 and into the fluid 116. The regulator 130 comprises a bag 132 and a conduit 134. The bag 132 and the conduit 134 are in fluid communication with a reservoir 150, which comprises the ambient air surrounding both the system 100 and the exchange device 140. The bag 132 comprises a substantially impervious material such that the fluid 116 and the air 118 inside the vial 110 do not contact the ambient air located at the interior of the bag 132.

In the illustrated embodiment, areas outside of the vial 110 are at atmospheric pressure. Accordingly, the pressure on the syringe plunger 144 is equal to the pressure on the interior of the bag 132, and the system 100 is in equilibrium. The plunger 144 can be withdrawn to fill the syringe 142 with the fluid 116. Withdrawing the plunger 144 increases the effective volume of the vial 110, thereby decreasing the pressure within the vial 110. A decrease of pressure within the vial 110 increases the difference in pressure between the interior and exterior of the bag 132, which causes the bag 132 to expand and force fluid into the syringe 142. In effect, the bag 132 expands within the vial 110 to a new volume that compensates for the volume of the fluid 116 withdrawn from the vial 110. Thus, once the plunger 144 ceases from being withdrawn from the vial 110, the system is again in equilibrium. Advantageously, the system 100 operates near equilibrium, facilitating withdrawal of the fluid 116. When the system 100 is in general equilibrium soon or immediately after withdrawal of the fluid 116, the plunger 144 remains at the position to which it is withdrawn, thereby allowing removal of an accurate amount of the fluid 116 from the vial 110.

In certain embodiments, the increased volume of the bag 132 is approximately equal to the volume of liquid removed from the vial 110. In some variants, the volume of the bag 132 increases at a slower rate as greater amounts of fluid are withdrawn from the vial 110 such that the volume of fluid withdrawn from the vial 110 is greater than the increased volume of the bag 132.

In some implementations, the bag 132 can stretch to expand beyond a resting volume. In some instances, the stretching gives rise to a restorative force that effectively creates a difference in pressure between the inside of the bag 132 and the inside of the vial 110. For example, a slight vacuum inside the vial 110 can be created when the bag 132 is stretched.

In certain instances, more of the fluid 116 than desired initially might be withdrawn inadvertently. In some instances, some of the air 118 in the vial 110 initially might be withdrawn, creating unwanted bubbles within the syringe 142. It may thus be desirable to inject some of the withdrawn fluid 116 and/or air 118 back into the vial 110, which can be accomplished by depressing the plunger 144. Depressing the plunger 144 increases the pressure inside the vial 110 and causes the bag 132 to contract. When the manual force applied to the plunger 144 ceases, the plunger 144 is again exposed to atmospheric pressure alone, as is the interior of the bag 132. Accordingly, the system 100 is again at equilibrium. Because the system 100 operates near equilibrium as the fluid 116 and/or the air 118 are injected into the vial 110, the pressure within the vial 110 does not significantly increase as the fluid 116 and/or air 118 is returned to the vial 110.

Figure 4:
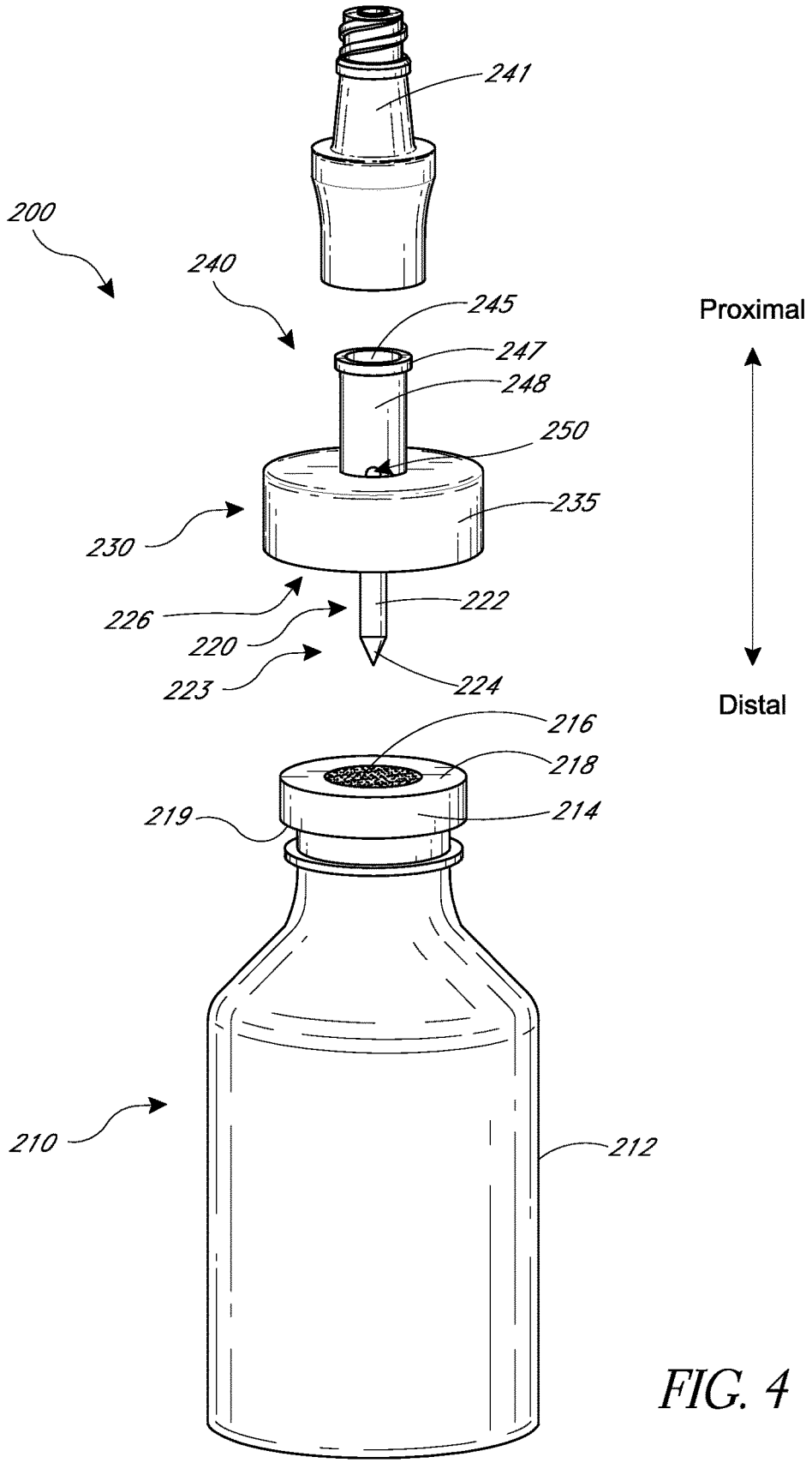
FIG. 4 is a perspective view of a vial adaptor and a vial.

FIG. 4 illustrates an embodiment of a vial adaptor 200 for coupling with a vial 210. The vial 210 can comprise any suitable container for storing medical fluids. In some instances, the vial 210 comprises any of a number of standard medical vials known in the art, such as those produced by Abbott Laboratories of Abbott Park, Ill. Preferably, the vial 210 is capable of being hermetically sealed. In some implementations, the vial 210 comprises a body 212 and a cap 214. The body 212 preferably comprises a rigid, substantially impervious material, such as plastic or glass.

The vial 210 can be of various sizes and dimensions. For example, in some implementations the internal volume of the vial 210 can be in a range of at least about 2 mL and/or less than or equal to about 10 mL. In certain implementations, the vial 210 has an axial length that can be in a range of at least about 0.5 inches and/or less than or equal to 1.5 inches. In certain implementations, the vial 210 has an outer cap diameter of at least about 0.25 inches and/or less than or equal to about 0.75 inches. Other sizes and ranges of volume, axial length, and diameter of the vial 210 can be used.

In some embodiments, the cap 214 comprises a septum 216 and a casing 218. The septum 216 can comprise an elastomeric material capable of deforming in such a way when punctured by an item that it forms a substantially airtight seal around that item. For example, in some instances, the septum 216 comprises silicone rubber or butyl rubber. The casing 218 can comprise any suitable material for sealing the vial 210. In some instances, the casing 218 comprises metal that is crimped around the septum 216 and a proximal portion of the body 212 in order to form a substantially airtight seal between the septum 216 and the vial 210. In certain embodiments, the cap 214 defines ridge 219 that extends outwardly from the top of the body 212.

In certain embodiments, the adaptor 200 comprises a piercing member 220. In some embodiments, the piercing member 220 comprises any portion of the adaptor 200 that is inserted into the vial 210 when the adaptor 200 is connected with the vial 210. In certain implementations, the piercing member 220 includes a distal end 223 and a proximal end 226. As used herein the term, "proximal," or any derivative thereof, refers to a direction along the axial length of the piercing member 220 that is toward the cap 214 when the adaptor 200 is inserted in the vial 210; the term "distal" indicates the opposite direction. In certain embodiments, the piercing member 220 includes a midpoint located about half-way along the axial length of the piercing member 220. In some embodiments, the proximal end 226 includes the portion of the piercing member 220 that is proximal of the midpoint and the distal end 223 includes the portion of the piercing member 220 that is distal of the midpoint.

In some implementations, the piercing member 220 comprises a sheath 222. The sheath 222 can be substantially cylindrical, as shown, or it can have other geometric implementations. In some embodiments, the sheath 222 has an outside diameter the can range from at least about 2 mm and/or less or equal to about 4 mm. In some instances, the sheath 222 tapers toward the distal end 223. In some embodiments, the distal end 223 defines a point that can be centered with respect to an axis of the piercing member 220 or offset therefrom. In certain embodiments, the distal end 223 is angled from one side of the sheath 222 to the opposite side. The sheath 222 can comprise a rigid material, such as metal (e.g., aluminum, brass, or stainless steel), or a polymer such as a plastic, that is suitable for insertion through the septum 216. In some embodiments, the sheath 222 comprises glass impregnated polybutylene terephthalate material, which is available under the trade name Valox™. In some variants, the sheath 222 comprises polypropelene plastic. In certain embodiments, the sheath 222 comprises polycarbonate plastic.

In some implementations, the piercing member 220 comprises a tip 224. The tip 224 can have a variety of shapes and implementations. In some instances, the tip 224 is configured to facilitate insertion of the sheath 222 through the septum 216. As illustrated, the tip 224, or a portion thereof, can be substantially conical, coming to a point at or near the axial center of the piercing member 220. In some embodiments, the tip 224 has a different geometric configuration, e.g., frustoconical, rounded, star-shaped, or otherwise. In some embodiments, the tip 224 angles from one side of the piercing member 220 to the other. In certain embodiments, a portion of the tip 224 has about the same outside diameter as the sheath 222. In some instances, the tip 224 is separable from the sheath 222. In certain instances, the tip 224 and the sheath 222 are permanently joined, and can be integrally formed. In various embodiments, the tip 224 comprises a metal (e.g., aluminum, brass, or stainless steel) or a plastic (e.g., acrylic plastic, ABS plastic, or polycarbonate plastic). In certain embodiments, the tip 224 comprises glass impregnated polybutylene terephthalate, which is available under the trade name Valox™.

In some embodiments, the adaptor 200 comprises a cap connector 230. As illustrated, the cap connector 230 can substantially conform to the shape of the cap 214. In certain implementations, the cap connector 230 comprises a rigid material, such as plastic or metal, that substantially maintains its shape after minor deformations. In some embodiments, the cap connector 230 comprises polycarbonate plastic. In some embodiments, the cap connector 230 comprises a sleeve 235 configured to snap over the ridge 219 and tightly engage the cap 214. As more fully described below, in some instances, the cap connector 230 comprises a material around an interior surface of the sleeve 235 for forming a substantially airtight seal with the cap 214. The cap connector 230 can be or can include adhesive tape, as known to those of skill in the art. In some embodiments, the cap connector 230 comprises an elastic material that is stretched over the ridge 219 to form a seal around the cap 214. In some embodiments, the cap connector 230 resembles the structures shown in FIGS. 6 and 7 of and described in the specification of U.S. Pat. No. 5,685,866, the entire contents of which are hereby incorporated by reference herein and are made a part of this specification.

In certain embodiments, the adaptor 200 comprises a medical connector interface 240 for coupling the adaptor 200 with a medical connector 241, another medical device (not shown), or any other instrument used in extracting fluid from or injecting fluid into the vial 210. In certain embodiments, the medical connector interface 240 comprises a sidewall 248 that defines a proximal portion of an extractor channel 245 through which fluid may flow. The extractor channel 245 can have any suitable configuration that permits withdrawal of fluid from the vial 210, including, for example, any configuration described in U.S. Patent Application Publication No. 2010/0049157, the entirety of which is incorporated herein by reference and is made a part of this specification. In some instances, the extractor channel 245 extends through the cap connector 230 and through a portion of the piercing member 220 such that the medical connector interface 240 is in fluid communication with the piercing member 220. The sidewall 248 can assume any suitable configuration for coupling with the medical connector 241, a medical device, or another instrument. In the illustrated embodiment, the sidewall 248 is substantially cylindrical and extends generally proximally from the cap connector 230.

In certain implementations, the medical connector interface 240 comprises a flange 247 to aid in coupling the adaptor 200 with the medical connector 241, a medical device, or another instrument. The flange 247 can be configured to accept any suitable medical connector 241, including connectors capable of sealing upon removal of a medical device therefrom. In some instances, the flange 247 is sized and configured to accept the Clave® connector, available from ICU Medical, Inc. of San Clemente, Calif. Certain features of the Clave® connector are disclosed in U.S. Pat. No. 5,685,866. Connectors of many other varieties, including other needle-less connectors, can also be used. The connector 241 can be permanently or separably attached to the medical connector interface 240. In some embodiments, the flange 247 is threaded, configured to accept a Luer connector, or otherwise shaped to attach directly to a medical device, such as a syringe, or to other instruments.

In certain embodiments, the medical connector interface 240 is advantageously centered on an axial center of the adaptor 200. Such a configuration provides stability to a system comprising the adaptor 200 coupled with the vial 210, thereby making the coupled system less likely to tip over. Accordingly, the adaptor 200 is less likely to cause dangerous leaks or spills occasioned by accidental bumping or tipping of the adaptor 200 or the vial 210.

In some embodiments, the piercing member 220, the cap connector 230, and the medical connector interface 240 are monolithic and/or integrally formed of a unitary piece of material, such as aluminum, brass, polypropylene plastic, polycarbonate plastic, or glass impregnated Valox™. In various embodiments, one or more of the piercing member 220, the cap connector 230, and the medical connector interface 240 comprise a separate piece. The separate pieces can be permanently joined in any suitable manner, such as by glue, epoxy, ultrasonic welding, etc. Connections between joined pieces can create substantially airtight bonds between the pieces. In some embodiments, any of the piercing member 220, the cap connector 230, or the medical connector interface 240 can comprise more than one piece.

In certain embodiments, the adaptor 200 comprises a regulator aperture 250. In many embodiments, the regulator aperture 250 is located at a position on the adaptor 200 that remains exposed to the exterior of the vial 210 when the piercing member 220 is inserted in the vial 210. In the illustrated embodiment, the regulator aperture 250 is located at a junction of the cap connector 230 and the medical connector interface 240. In certain embodiments, the regulator aperture 250 allows fluid communication between the environment surrounding the vial 210 and a regulator channel 225 (see FIG. 5) which extends through the cap connector 230 and through the piercing member 220.

Figure 5:
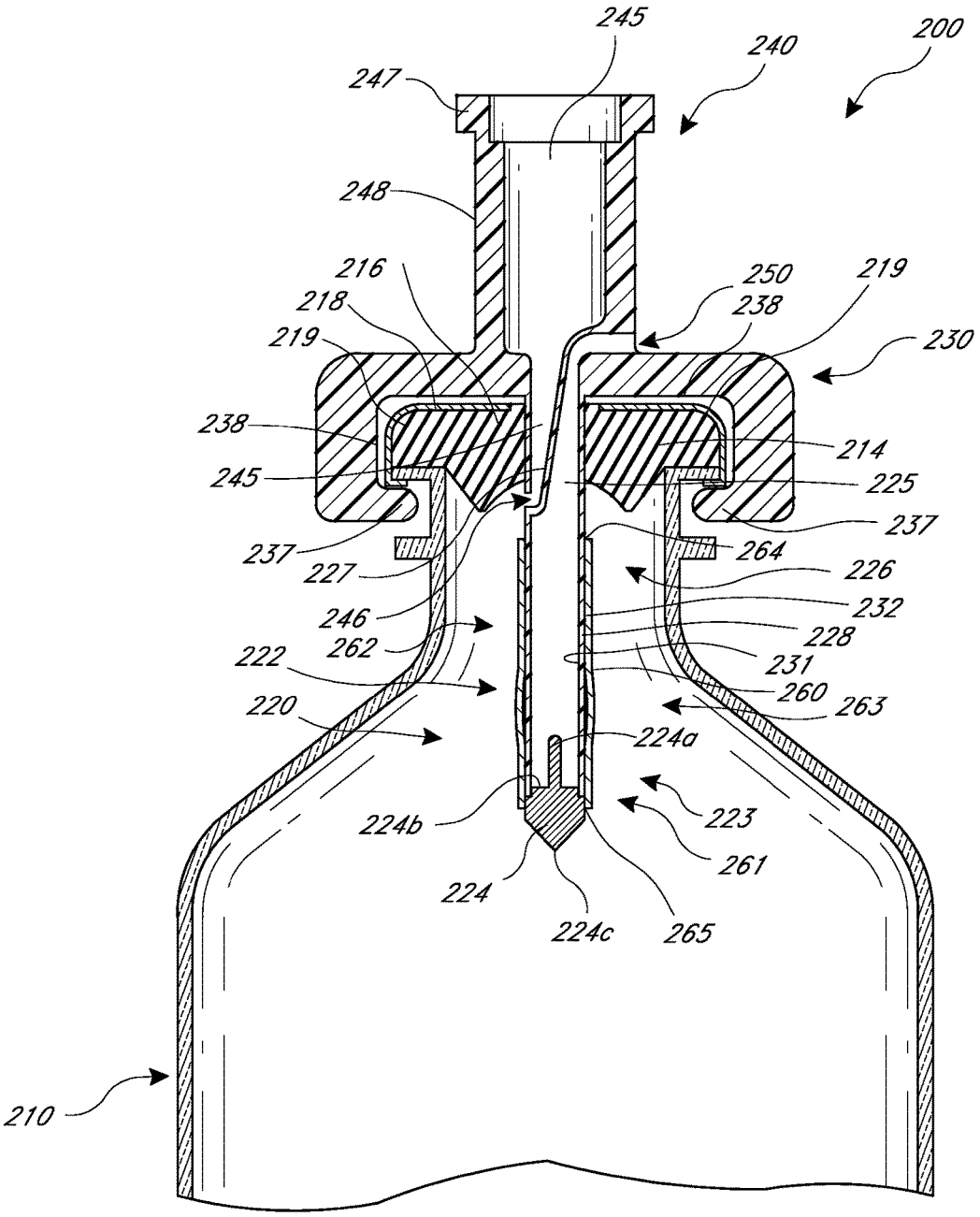
FIG. 5 is a partial cross-sectional view of the vial adaptor of FIG. 4 coupled with a vial in an initial stage.

FIG. 5 illustrates a cross-section of the vial adaptor 200 coupled with the vial 210. In the illustrated embodiment, the cap connector 230 firmly secures the adaptor 200 to the cap 214 and the piercing member 220 extends through the septum 216 into the interior of the vial 210. In some embodiments, the piercing member 220 is oriented substantially perpendicularly with respect to the cap 214 when the adaptor 200 and the vial 210 are coupled. Other implementations are also possible. As shown, in some embodiments, the piercing member 220 comprises a bag 260.

In certain embodiments, the cap connector 230 comprises one or more projections 237 that aid in securing the adaptor 200 to the vial 210. The one or more projections 237 extend toward an axial center of the cap connector 230. In some implementations, the one or more projections 237 comprise a single circular flange extending around the interior of the cap connector 230. The cap connector 230 can be sized and configured such that an upper surface of the one or more projections 237 abuts a lower surface of the ridge 219, helping secure the adaptor 200 in place.

The one or more projections 237 can be rounded, chamfered, or otherwise shaped to facilitate the coupling of the adaptor 200 and the vial 210. For example, as the adaptor 200 having rounded projections 237 is introduced to the vial 210, a lower surface of the rounded projections 237 abuts a top surface of the cap 214. As the adaptor 200 is advanced onto the vial 210, the rounded surfaces cause the cap connector 230 to expand radially outward. As the adaptor 200 is advanced further onto the vial 210, a resilient force of the deformed cap connector 220 seats the one or more projections 237 under the ridge 219, securing the adaptor 200 in place.

In some embodiments, the cap connector 230 is sized and configured such that an inner surface 238 of the cap connector 230 contacts the cap 214. In some embodiments, a portion of the cap connector 230 contacts the cap 214 in substantially airtight engagement. In certain embodiments, a portion of the inner surface 238 surrounding either the septum 216 or the casing 218 is lined with a material, such as rubber or plastic, to ensure the formation of a substantially airtight seal between the adaptor 200 and the vial 210.

The piercing member 220 can comprise the tip 224 and the sheath 222, as noted above. In some embodiments, the tip 224 is configured to pierce the septum 216 to facilitate passage therethrough of the sheath 222. In some instances, the tip 224 comprises a proximal extension 224*a*, which can, for example, facilitate securing the tip 224 to the sheath 222. In various embodiments, the proximal extension 224*a* comprises polycarbonate plastic, silicone rubber, butyl rubber, or closed cell foam. The proximal extension 224*a* can be attached to the tip 224 by any suitable means, or it can be integrally formed therewith.

In some embodiments, the tip 224 can be adhered to, friction fit within, snapped into, or otherwise attached in a temporary fashion to the sheath 222. As discussed below, in some embodiments, the tip 224 disengages from the sheath 222 and/or the bag 260 as fluid is withdrawn from the vial 210. In some embodiments, the tip 224 disengages from the sheath 222 and/or the bag 260 upon passing through the septum 216, such as when atmospheric pressure within the sheath 222 is sufficiently higher than the pressure within the vial 210. In some instances, a volume of air between the tip 224 and the bag 260 is pressurized to achieve the same result. In certain implementations, the tip 224 does not separate from the sheath 222.

In some embodiments, the tip 224 comprises a shoulder 224*b*. In some instances, the outer perimeter of the shoulder 224*b* is shaped to conform to the interior perimeter of the sheath 222. Accordingly, the shoulder 224*b* can center the tip 224 with respect to the sheath 222 and keep the tip 224 oriented properly for insertion through the septum 216. In some instances, the outer perimeter of the shoulder 224*b* is slightly smaller than the interior perimeter of the sheath 222, allowing the tip 224 to easily disengage or slide from the sheath 222 as the bag 260 is deployed. In certain embodiments, the tip 224 comprises the shoulder 224*b*, but does not comprise the proximal extension 224*a*.

In certain embodiments, the proximal extension 224*a* serves to maintain a proper orientation of the tip 224 with respect to the sheath 222 for insertion of the tip 224 through the septum 216. In some instances, the tip 224 rotates with respect to the sheath 222 as the tip 224 contacts the septum 216 such that the proximal extension 224*a* is angled with respect to the axial center of the sheath 222. In some embodiments, the proximal extension 224*a* is sufficiently long that an end thereof contacts the interior surface of the sheath 222. This contact can prevent the tip 224 from rotating too far, such that a distal end 224*c* thereof is not directed at an angle that is relatively perpendicular to the septum 216.

The sheath 222 is generally sized and dimensioned to be inserted through the septum 216 without breaking and, in some instances, with relative ease. In some embodiments, the sheath 222 can have a cross-sectional area of at least about 0.025 and/or less than or equal to about 0.075 square inches. In some embodiments, the cross-sectional area can be less than about 0.075 square inches.

The sheath 222 can comprise any of a number of cross-sectional geometries, such as generally: oval, ellipsoidal, square, rectangular, hexagonal, or diamond-shaped. The cross-sectional geometry of the sheath 222 can vary along a length thereof in size and/or shape. In some embodiments, the sheath 222 has substantially circular cross-sections along a substantial portion of a length thereof. A circular geometry provides the sheath 222 with substantially equal strength in all radial directions, thereby preventing bending or breaking that might otherwise occur upon insertion of the sheath 222. The symmetry of an opening created in the septum 216 by the circular sheath 222 prevents pinching that might occur with angled geometries, allowing the sheath 222 to more easily be inserted through the septum 216. The matching circular symmetries of the piercing member 220 and the opening in the septum 216 can ensure a tight fit between the piercing member 220 and the septum 216, even if the adaptor 200 is inadvertently twisted. Accordingly, the risk of dangerous liquids or gases escaping the vial 210, or of impure air entering the vial 210 and contaminating the contents thereof, can be reduced in some instances with a circularly symmetric configuration.

In some embodiments, the sheath 222 is hollow. In the illustrated embodiment, the inner and outer surfaces of the sheath 222 substantially conform to each other such that the sheath 222 has a substantially uniform thickness. In some embodiments, the thickness is very thin, such as less than or equal to about 0.01 inches, or at least about 0.005 inches and/or less than or equal to about 0.150 inches. In some embodiments, the thickness is larger, such at least about 0.025 inches and/or less than or equal to about 0.075 inches.

The sheath 222 can comprise a sidewall 228 that extends between the distal and proximal ends 223, 226. In some embodiments, the sidewall 228 extends linearly, such as in embodiments in which the sheath 222 has a conical, frustoconical, or cylindrical configuration. In some embodiments, the sidewall 228 extends between the distal end 223 and proximal end 226 non-linearly. For example, in some embodiments the sidewall 228 extends between the distal and proximal ends 223, 226 in an undulating, wavy, zigzagging, curved, stepped, or similar configuration.

The sidewall 228 can include an inner surface 231 and an outer surface 232. As shown, inner surface 231 faces toward the center of the sheath 222; the outer surface 232 faces away from the center of the sheath 222. In some implementations, at least a portion of the inner surface 231 and/or outer surface 232 is textured, e.g., rough, dimpled, perforated, knobbed, scratched, grooved, ridged, bumped, and the like. In certain implementations, the outer surface 232 comprises one or more projections, e.g., annular ribs. As will be discussed below, an outer surface 232 including texture or projections can facilitate, for example, inhibiting bunching or tearing of the bag 260 during insertion through the septum 216. In some implementations, however, at least a portion or the inner surface 231 and/or outer surface 232 is smooth (e.g., not textured), which can, e.g., facilitate movement of the bag 260 relative to the sidewall 228 (such as during expansion of the bag 260). In some embodiments, the sidewall 228 includes a combination of smooth and textured portions. For example, the distal end 223 can be textured and the proximal end 226 can be smooth, or vice versa. In another example, the inner surface 231 is smooth and the outer surface 232 is textured.

In some embodiments, the inner surface 231 of the sheath 222 varies in configuration from that of the outer surface 232 of the sheath 222. Accordingly, in some embodiments, the thickness varies along the length of the sheath 222. In various embodiments, the thickness at one end, such as a proximal end, of the sheath is between about 0.015 inches and about 0.050 inches, between about 0.020 inches and about 0.040 inches, or between about 0.025 inches and about 0.035 inches, and the thickness at another end, such as the distal end 223, is between about 0.015 inches and 0.040 inches, between about 0.020 inches and 0.030 inches, or between about 0.023 inches and about 0.027 inches. In certain embodiments, the thickness at one end of the sheath 222 is greater than about 0.015 inches, greater than about 0.020 inches, or greater than about 0.025 inches, and the thickness at another end thereof is greater than about 0.015 inches, greater than about 0.020 inches, or greater than about 0.025 inches. In some embodiments, the thickness at one end of the sheath 222 is less than about 0.050 inches, less than about 0.040 inches, or less than about 0.035 inches, and the thickness at another end thereof is less than about 0.045 inches, less than about 0.035 inches, or less than about 0.030 inches. In some embodiments, the thickness at a proximal end of the sheath 222 is about 0.030 inches and the thickness at the distal end 223 is about 0.025 inches. In some embodiments, the cross-section of the inner surface 231 of the sheath 222 is shaped differently from that of the outer surface 232. The shape and thickness of the sheath 222 can be altered to optimize the strength of the sheath 222.

In some instances, the length of the sheath 222, as measured from a distal surface of the cap connector 230 to the distal end 223 is at least about 0.6 inches and/or less than about 1.4 inches. In some instances, the combined length of the sheath 222 and the tip 224 is at least about 25% and/or equal to or less than about 90% of the length of the vial 210. In some implementations, the combined length of the sheath 222 and the tip 224 is about equal to the length of the vial 210.

In certain embodiments, the sheath 222 at least partially encloses one or more channels. In the illustrated embodiment, the sheath 222 defines the outer boundary of a distal portion of a regulator channel 225 and the outer boundary of a distal portion of the extractor channel 245. An inner wall 227 extending from an inner surface of the sheath 222 to a distal portion of the medical connector interface 240 defines an inner boundary between the regulator channel 225 and the extractor channel 245. The regulator channel 225 extends from the proximal end 226 of the piercing member 220, through the cap connector 230, between the cap connector 230 and the medical connector interface 240, and terminates at a regulator aperture 250. In some embodiments, the regulator channel also extends through all or part of the sheath 222, e.g., to the distal end 223. The extractor channel 245 extends from an extractor aperture 246 formed in the piercing member 220, through the cap connector 230, and through the medical connector interface 240.

In certain embodiments, the sheath 222 is coupled with the bag 260. The bag 260 is generally configured to unfold, expand, compress, and/or contract, and can comprise any of a wide variety of materials, including Mylar® material, polyester, polyethylene, polypropylene, saran, latex rubber, polyisoprene, silicone rubber, and polyurethane. In certain embodiments, the bag 260 comprises a thermoplastic elastomer. In some embodiments, the bag 260 comprises a material capable of forming a substantially airtight seal with the sheath 222. In some embodiments, the bag 260 comprises a material that can be adhered to the sheath 222 in substantially airtight engagement. In many instances, the bag 260 comprises a material that is generally impervious to liquid and air. In certain embodiments, it is preferred that the bag 260 comprise a material that is inert with respect to the intended contents of the vial 210. In some embodiments, the bag 260 comprises latex-free silicone having a durometer between about 10 and about 40.

The bag 260 comprises a distal portion 261 and a proximal portion 262. In certain embodiments, the bag 260 includes an intermediate point located about half-way along the axial length of the bag 260. In some embodiments, the distal portion 261 includes the region of the bag 260 member 220 that is distal of the intermediate point and the proximal portion 262 includes the region of the bag 260 that is proximal of the intermediate point. In some embodiments, the distal portion 261 comprises a distal-most end of the bag 260 and/or the proximal portion 262 comprises a proximal-most end of the bag 260. In some embodiments, the distal portion 261 does not include the distal-most end of the bag 260 and/or the proximal portion 262 does not include the proximal-most end of the bag 260.

In some implementations, at least part of the bag 260 connects with the sheath 222 in substantially airtight engagement. In certain implementations, the proximal portion 262 of the bag connects with the sheath 222 in substantially airtight engagement. In some embodiments, the distal portion 261 of the bag 260 connects with the sheath 222 and/or the tip 224 in substantially airtight engagement. In some embodiments, the proximal portion 262 of the bag 260 is connected with a proximal-most end of the sheath 222. In some embodiments, the distal portion 261 of the bag 260 connects with a distal-most end of the sheath 222. In certain implementations, the distal portion 261 of the bag 260 connects to the inner surface 231 of the sheath 222. In some instances, the distal portion 261 of the bag 260 connects to the outer surface 232 of the sheath 222. In certain embodiments, the distal portion 261 is connected with the sheath 222 a distance from the distal-most end of sheath 222 and/or the proximal portion 262 is connected with the sheath 222 a distance from the proximal-most end of sheath 222. For example, in some embodiments the distance is at least 1% and/or equal to or less than 49% of the axial length of the sheath 222. For instance, in some embodiments the distance is about 1%, about 2%, about 3%, about 5%, about 10%, or about 25% of the axial length of the sheath 222. As another example, in some variants the distance is least 0.05 inches and/or equal to or less than 0.50 inches. In some embodiments, the distal portion 261 of the bag 260 is substantially free, e.g., unconnected to the sheath 222 and the tip 224. In some instances, the substantially airtight engagement is achieved when one or both of the distal and proximal portions 261, 262 is thicker than other portions of the bag 260 and fits more snugly against the sheath 222. In some embodiments, one or both of the distal and proximal portions 261, 262 is tapered. As used herein, the term "taper", or any derivative thereof, is used in its ordinary sense and includes, unless otherwise noted, any gradual diminution, reduction, decreasing, or thinning of a dimension (e.g., thickness) of an object. Various forms of taper can be used, such as linear, non-linear, and curved. In some embodiments, the taper comprises a series of steps.

Various implementations can be used to achieve the connection between the bag 260 and the sheath 222 and/or the tip 224. In some embodiments, the connection is achieved with a friction-fit. In some embodiments, the connection is achieved with welding, heating, or with one or more fasteners (e.g., sleeves, grommets, snap rings, or similar). In certain implementations, the bag 260 is received in a slot, notch, groove, or similar feature in the sheath 222 to form the connection.

In some embodiments, the connection is a sliding connection. For example, in some embodiments, a portion of the bag 260 is configured to axially slide along a portion of the sheath 222. A sliding connection can facilitate, for example, expansion of the bag 260 in elongated but radially narrow vials.

In certain implementations, the connection between the bag 260 and the sheath 222 and/or the tip 224 is achieved with an adhesive. Various forms of adhesives can be used, such as epoxies, cyanoacrylates, urethanes, and acrylics. Generally, the adhesive is chemically inert and non-leaching. In certain embodiments, the adhesive is cured with, for example, ultraviolet light, heat, and/or exposure to moisture (e.g., moisture in ambient air). In certain embodiments, the adhesive can cure at about room temperature (e.g., about 72 degrees Fahrenheit). For example, some embodiments use a room temperature vulcanizing (RTV) silicone adhesive, such as a rapid curing NuSil Med2-4013 material, to bond the bag 260 to the sheath 222 and/or the tip 224. In some embodiments, the adhesive cures into a rubbery state. In some aspects, the adhesive has a glass transition temperature that is less than about room temperature. In certain embodiments, the adhesive is re-adherable. In some implementations, the adhesive bonds without the use of a primer. In some embodiments, the adhesive adheres and seals (e.g., air-tight) the connection between the bag 260 and the sheath 222 and/or the tip 224. Generally, the adhesive has a high resistance to shear force (e.g., the axial force that the bag 260 experiences during insertion into the vial 210) but does not substantially inhibit expansion of the bag 260. In some embodiments, the adhesive can resist more shear force than normal force (e.g., a force normal to the axial axis of the sheath 222). The adhesive can be applied to the bag 260, the sheath 222, the tip 224, and combinations thereof. In certain embodiments, the adhesive is disposed on the inside of the bag 260. In some embodiments, the adhesive is disposed on the exterior surface of the sheath 222. For example, the adhesive can be disposed on the outer surface 232 of the sidewall 228. In some embodiments, the adhesive is positioned between the bag 260 and the sheath 222.

The adhesive can be uniformly or non-uniformly distributed. For example, the adhesive can be uniformly distributed on the sheath 222 and/or on the bag 260. In certain embodiments, the adhesive is disposed on only the proximal end 226 of the piercing member 220. In other embodiments, the adhesive is disposed on only the proximal portion 261 of the bag 260. In some embodiments, the adhesive is disposed on only the distal end 223 of the piercing member 220. In still other embodiments, the adhesive is disposed on only the distal portion 261 of the bag 260.

Certain embodiments of the piercing member 220 comprise an adhesive portion and a textured portion. For example, in some embodiments, one end of the sheath 222 is textured and the other end includes an adhesive. Similarly, in certain variants, one end of the bag 260 (e.g., the distal portion 261) is textured and the other end includes an adhesive. In certain embodiments, the adhesive portion can provide more resistance to shear force (such as the shear force that occurs during insertion of the piercing member 220 through the septum 216) than the textured portion. Certain embodiments of the textured and adhesive portions assist in controlling expansion of the bag 260. Some implementations of the textured and adhesive portions inhibit bunching of the bag 260 during insertion into the vial 210.

In certain embodiments, the bag 260 expands in more than one stage. In some instances, the bag 260 expands in 2, 3, 4, 5, or 6 stages. In certain embodiments, one or more adhesive portions facilitate controlling the order of expansion of the stages. In certain of such embodiments, the adhesive force of the one or more adhesive portions can be configured to be overcome by the expansion force during expansion of the bag 260. For example, in some embodiments, an adhesive portion adheres a medial portion 263 of the bag 260 with the sheath 222, such that initially only a first portion of the bag 260 expands, with the remainder of the bag 260 being sealed-off by the adhesive portion. In certain of such embodiments, as the bag 260 continues to expand, the adhesive force of the adhesive portion can be overcome, thereby freeing a second portion of the bag 260. In some of such embodiments, the freeing of the second portion of the bag 260 can allow air to flow into, and the expansion of, the second portion of the bag 260.

In certain implementations, the bag 260 comprises multiple folds, layers, or the like, at least two of which are adhered to each other. In certain of such embodiments, the folds, layers, or the like can be configured to expand in a serial configuration or in a parallel configuration. For instance, in a serial configuration, a first fold and a second fold can be adhered, and the adhesive can be configured to be overcome and permit expansion of the second fold only after the first fold has at least partly expanded. In another example, in a parallel configuration, a first fold and a second fold can be adhered, and the adhesive can be configured to be overcome and permit substantially concurrent expansion of the first and second folds.

In certain embodiments, the bag 260 includes a bag aperture 264. In some instances, the bag aperture 264 allows fluid communication between the interior of the bag 260 and the regulator channel 225. In certain embodiments, the bag aperture 264 extends along an axial center of the distal portion 261. In certain embodiments, a lower portion of the interior wall 227 is angled (as shown), offset, or positioned away from the center of the sheath 222 so as not to obstruct the bag aperture 264. In certain embodiments, at least some of the piercing member 220 is received by the bag aperture 264. For example, in some embodiments, the proximal end 223 of the piercing member 220 is received by the bag aperture 264.

In certain variants, the entire bag 260 is located generally outside the sheath 222. For example, in the illustrated embodiment, the bag 260 is positioned radially outward (with respect to the axial center) of the sheath 222. Positioning the bag 260 outside the sheath 222 can facilitate, for example, the pressure-regulating functionality in a variety of sizes of the vial 210, as discussed below. In some implementations, the bag 260 contains an elongate volume, such as a volume generally shaped as cylindrical, conical, or spheroidal (e.g., prolate or oblate). In certain embodiments, the bag 260 is configured to receive a substantial portion of the axial length of the piercing member 220 in the volume. For example, the bag 260 can be configured to receive at least about 25% and/or equal to or less than about 100% of the axial length of the piercing member 220. In certain embodiments, the bag 260 is configured to receive at least about 50% or at least about 70% of the axial length of the piercing member 220.

Some embodiments of the adaptor 200 have a portion of the bag 260 that is located within the sheath 222. For example, in some embodiments the distal portion 261 of the bag 260 is positioned inside the sheath 222 and the proximal portion 262 of the bag 260 is disposed outside the sheath 222. In some embodiments, the distal portion 261 generally wraps around (e.g., from the inside to the outside) the distal-most end of the sheath 222.

In certain embodiments, the bag 260 connects with the piercing member 220. For example, in some implementations the bag 260 connects with the outer surface 232 of the sidewall 228 of the sheath 222. In some instances, such a connection is at the proximal end 226 of the piercing member 220. In some embodiments, connecting the bag 260 with the proximal end 226 of the piercing member 220 provides one or more advantages over other configurations, for example, when the bag 260 is connected with the proximal end 226 of the piercing member 220 the adaptor 200 may be more suitable for use with small volume vials (e.g., about 1 to about 5 mL). In certain embodiments, the proximal end 226 includes, for example, the portion of the sheath 222 near the cap connector 230. In some embodiments, the proximal end 226 comprises the region of the sheath 222 adjacent to the extractor channel 245. In certain embodiments, connecting the bag 260 with the proximal end 226 facilitates, for example, maintaining the axial position of the bag 260 (with respect to the sheath 222) during expansion of the bag 260, as discussed below. Generally, the connection between the bag 260 and the proximal end 226 provides an air-tight seal, thereby inhibiting movement of fluid (e.g., oncology medication) between the vial 210 and the interior of the bag 260. In certain instances, the connection between the bag 260 and the piercing member 220 is at the distal end 223 of the piercing member 220. As discussed above, the connection can be airtight. In some embodiments, a portion of the bag 260, e.g., the distal portion 261, connects with the tip 224.

In some embodiments, a portion of the bag 260 connects with the inner surface 231 of the sidewall 228 of the sheath 222. For example, in some embodiments, the distal portion 261 of the bag 260 is connected with the inner surface 231. In some such embodiments, the distal portion 261 is at least partly disposed between the sheath 222 and the tip 224. Such a configuration can, for example, inhibit movement or tearing of the bag 260 during insertion into the vial 210. In some embodiments, the tip 224 acts as a shield to inhibit the bag 260 from snagging on the septum 216 during insertion into the vial 210.

Some implementations of the bag 260 include a portion that is unconnected with the sheath 222. Such an unconnected portion can facilitate expansion and/or influence the direction of expansion of the bag 260. In some instances, the distal portion 261 of the bag 260 is unconnected to the sheath 222 and/or the tip 224. In certain instances, the proximal portion 262 of the bag 260 is unconnected to the sheath 222. In some embodiments, the medial portion 263 of the bag 260 is unconnected with the sheath 222. The portion of the bag 260 unconnected can be slack, loose, baggy, wrinkled, folded, or similar.

In some instances, a lubricant is applied to the sheath 222 and/or the bag 260 to facilitate the insertion thereof into the vial 210. As used herein, the term "lubricant" is a broad term used in its ordinary sense and includes, without limitation, any substance or material used to permit substantially unimpeded relative movement of surfaces in close proximity, including, without limitation: gels, liquids, powders, and/or coatings applied to one or more of the surfaces; materials, compounds, or substances embedded within one or more of the surfaces; and substances or materials placed between the surfaces. In some embodiments, the lubricant is a liquid, a gel, or a powder. The lubricant can inhibit, prevent, or lessen the occurrence of rips or tears in the bag 260 by decreasing the friction with the septum 216 during insertion of the bag 260 and the sheath 222 into the vial 210. For example, applying lubricant to the outer surface of the bag 260 can inhibit the bag 260 from catching or snagging on the septum 216. In some embodiments, the lubricant can also inhibit relative movement of the bag 260 and the sheath 222 (e.g., bunching of the bag 260 on the sheath 222) during insertion into the vial 210. In certain implementations, the lubricant can facilitate expansion of the bag 260 by, for example, decreasing the friction between the sheath 222 and the bag 260 as the bag 260 moves relative to the sheath 222. In certain embodiments, the lubricant is applied to the outer surface of the bag 260, the inner surface of the bag 260, the tip 224, the sheath 222 (e.g., the outer surface 232 of the sidewall 228), and/or combinations thereof. In some embodiments, the lubricant is isopropyl alcohol, which desirably is sterile, readily evaporates, and provides sufficient lubrication to allow relatively simple insertion of the bag 260. In some embodiments, the lubricant comprises fluorosilicone oil. Other lubricants having the same or different properties can also be employed.

In some embodiments, a lubricant is applied to the interior surface of the bag 260 to encourage a relatively unimpeded deployment of the bag 260. Any suitable variety of lubricant is possible. In some embodiments, the lubricant comprises a liquid or a gel. In some embodiments, the lubricant comprises fluorosilicone oil. In some embodiments, the lubricant comprises a powder, such as talcum powder. In some embodiments, powder lubricants are more effective than liquid or gel lubricants over extended storage periods. For example, certain liquids and gels can migrate from between two proximate surfaces of the bag 260, whereas certain powders can be less prone to migrate therefrom. Accordingly, in some embodiments, some powder lubricants can provide an adaptor 200 with a relatively longer shelf-life than some liquid or gel lubricants. In some embodiments, liquids (e.g., oils) are preferred.

In some embodiments, the lubricant comprises a coating that is adhered to, integrally formed with, or otherwise applied to the bag 260. The coating can comprise any suitable material that can permit relatively unimpeded movement between surfaces of the bag 260. For example, some embodiments can comprise a coating of friction-reducing material, such as Teflon®. In certain embodiments, the lubricant is embedded in the bag 260.

In some embodiments, a portion of the bag 260 is folded or doubled-back on itself. In some embodiments, one or more portions of the bag 260 are folded multiple times. In certain embodiments, the bag 260 comprises a material that does not readily cling to itself, thereby allowing portions of the bag 260 in close proximity (e.g., adjacent to each other) to slide past each other and away from each other with relative ease, thus allowing the bag 260 to be deployed easily. A bag 260 comprising a material that does not readily cling to itself can also facilitate insertion of the bag 260 through the vial 210 without ripping or tearing of the bag 260. In certain of such embodiments, a lubricant can be applied to portions of the interior and/or exterior surfaces of the bag 260 to allow relatively easy deployment of the bag 260.

Figure 6C:
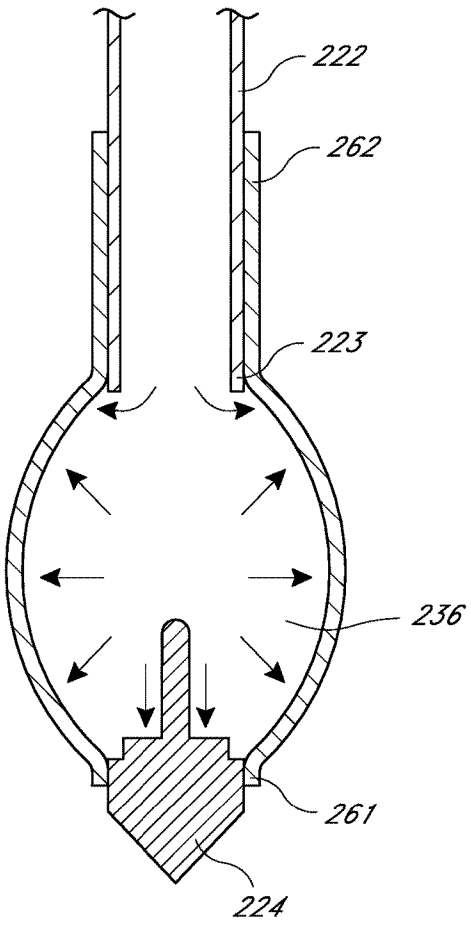
FIG. 6C is a cross-sectional view depicting the distal portion of the piercing member of the vial adaptor for FIG. 5 in a subsequent stage.
Figure 6B:
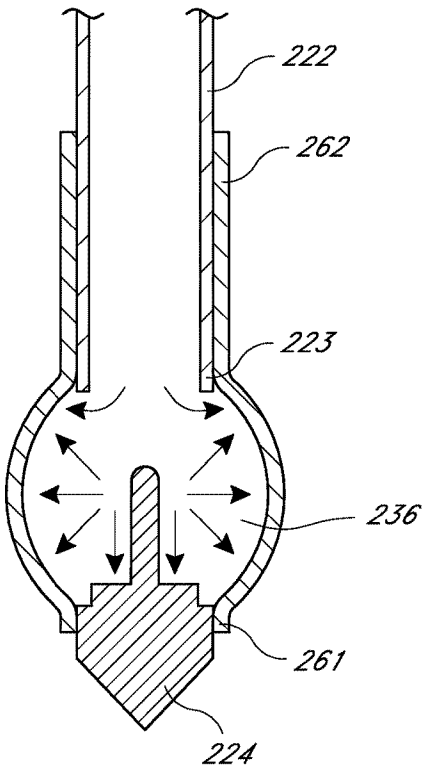
FIG. 6B is a cross-sectional view depicting the distal portion of the piercing member of the vial adaptor for FIG. 5 in a subsequent stage.
Figure 6A:
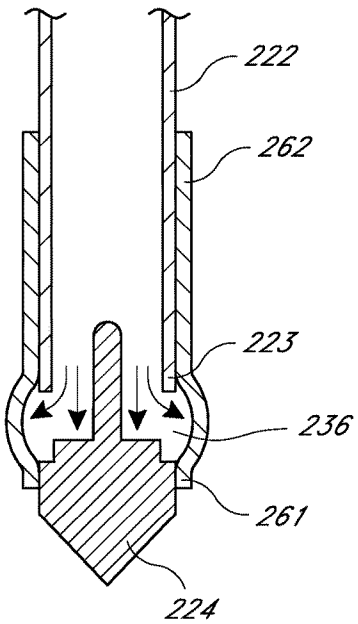
FIG. 6A is a cross-sectional view depicting a distal portion of a piercing member of the vial adaptor for FIG. 5 in a subsequent stage.

FIGS. 6A-6C illustrate a distal portion of the sheath 222 of the adaptor 200 in various stages of deployment (e.g., expansion) of the bag 260. In certain scenarios, the adaptor 200 is coupled with a partially evacuated vial 210 (not shown) such that the pressure outside the vial 210 (e.g., atmospheric pressure) is higher than the pressure inside the vial 210. Accordingly, one side of the bag 260 can be exposed to the higher pressure outside the vial 210 and the other side of the bag 260 can be exposed to the lower pressure inside the vial 210. As a result of the pressure difference, the ambient air can be drawn through the regulator aperture 250 and through the regulator channel 225. In certain embodiments, the pressure difference can force the tip 224 distally, thereby opening a passage 236 between the sheath 222 and the tip 224. In such embodiments, the ambient air can flow through the passage 236 into the bag 260 to expand the bag 260, as schematically depicted by various arrows. As shown, in certain embodiments, the expansion of the bag 260 by the ambient air can move the tip 224 in the direction of the distal end of the vial 210, thereby increasing the size of the passage 236. In some embodiments, the proximal portion 262 of the bag 260 expands prior to and/or more rapidly than the distal portion 261 of the bag 260. In some variants, the distal portion 261 of the bag 260 expands prior to and/or more rapidly than the proximal portion 262 of the bag 260. In some embodiments, the distal and proximal portions 261, 262 of the bag 260 expand substantially uniformly.

Figure 7:
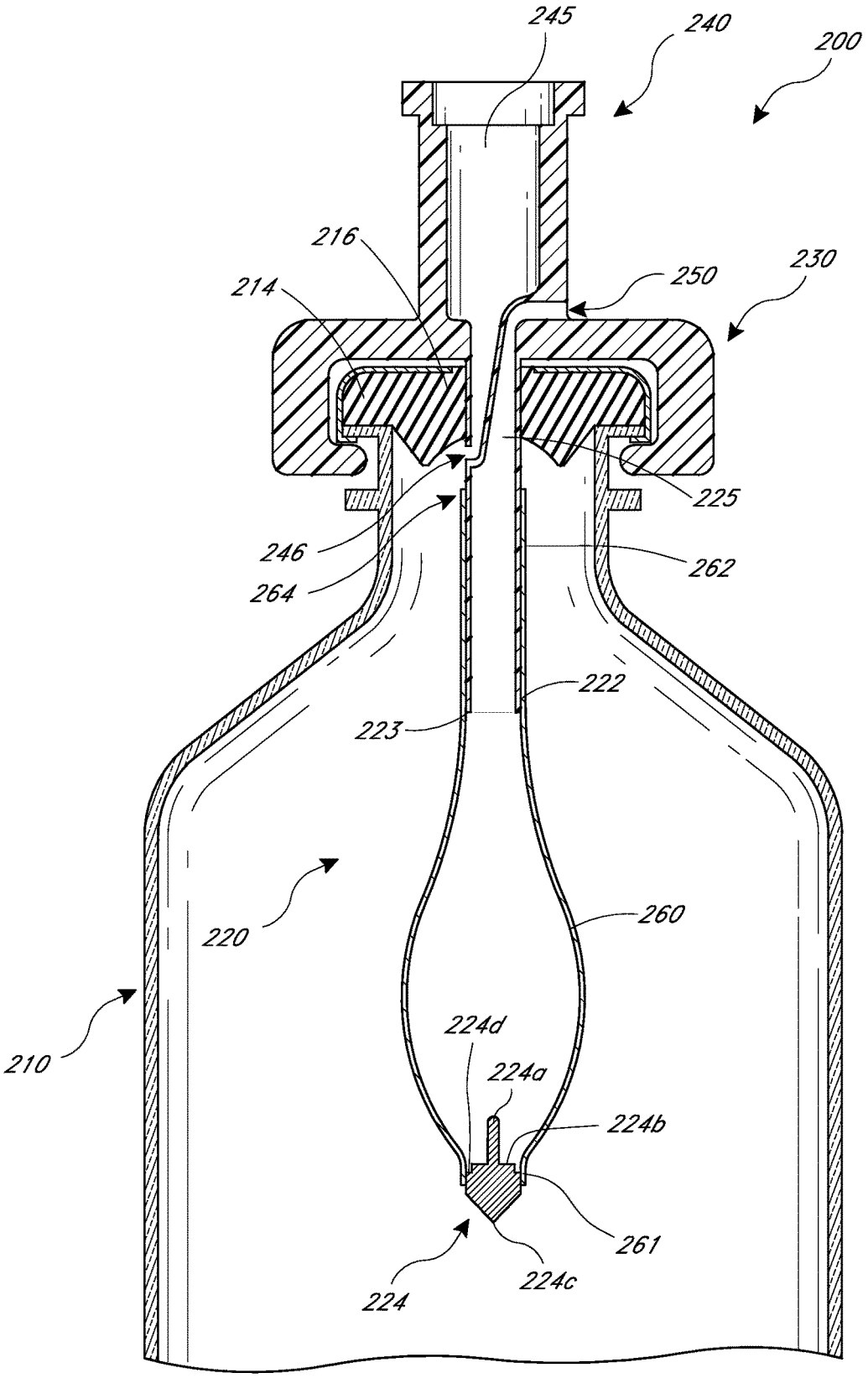
FIG. 7 is a partial cross-sectional view of the vial adaptor of FIG. 5 coupled with a vial and in a subsequent stage.

FIG. 7 illustrates an embodiment of the adaptor 200 with the bag 260 deployed. As shown, in some embodiments, the distal portion 261 of the bag 260 extends beyond the sheath 222. In certain embodiments, a portion of the bag 260 that contacts the sheath 222 is thicker than adjacent portions of the bag 260 in order to protect the bag 260 from ripping, puncturing, or tearing against the sheath 222.

In some embodiments, the bag 260 is sized and configured to substantially fill the vial 210, or to fill at least a volume within that vial 210 that is substantially equal to the volume of fluid that is expected to be withdrawn from a vial 210. For example, in some embodiments, the bag 260 comprises a flexible, expandable material sized and configured to expand to fill a substantial portion of the volume within the vial 210. In some instances, the bag 260 is expandable to substantially fill a range of volumes such that a single adaptor 200 can be configured to operate with vials 210 of various sizes. In some implementations, the bag 260 comprises a flexible, non-expandable material and is configured to unfold within the vial 210 to fill a portion thereof. In some embodiments, the bag 260 is configured to fill at least about 70 percent of the vial 210 to which the adaptor is expected to be coupled. In some embodiments, the bag 260 is configured to fill a volume equal to at least about 90 percent of the volume of liquid contained within the vial 210 prior to the coupling of the adaptor 200 and the vial 210. In some embodiments, the bag 260 is configured to fill a volume equal to about 70 percent of the volume of fluid contained within the vial 210 prior to the coupling of the adaptor 200 and the vial 210. In some embodiments, including those in which a single adaptor is configured to be used with vials of different volumes, the bag 260 is configured to fill at least about 70 percent of a first vial 210 having a first volume, and at least about 50 percent of a second vial 210 having a second volume larger than the first volume.

In some embodiments, as illustrated, the distal portion 261 of the bag 260 can be substantially bulbous. In some embodiments, the bulbous bag 260 comprises an expandable material. In various embodiments, at least a portion of the bag 260, such as the distal portion 261, in an unexpanded state has an outer diameter of at least about 0.05 and/or less than or equal to about 0.15 inches. In various embodiments, the distal portion 261 in an unexpanded state has a height of at least about 0.50 inches and/or less than or equal to about 1.0 inches.

In some embodiments, the distal portion is generally spherical. Various other embodiments of the distal portion 261 include, for example, generally conical, generally cylindrical, generally rectangular, and generally triangular. Some implementations of the bag 260, such as the illustrated embodiment, include a distal aperture 265 at the distal portion 261. In some embodiments, the distal aperture 265 is configured to receive a portion of the tip 224.

As noted above, in some instances the body 212 of the vial 210 comprises a substantially rigid material, such as glass or plastic. Accordingly, embodiments wherein the bag 260 is deployed within the vial 210 can shield the bag 260 from accidental snags, rips, or tears. Implementations in which the bag 260 is located within the vial 210 can have a lower center of mass than other configurations, which helps to prevent accidental tipping and spilling of the vial 210.

With continued reference to FIG. 7, certain processes for using the adaptor 200 comprise inserting the piercing member 220 through the septum 216 until the cap connector 230 is firmly in place. Accordingly, the coupling of the adaptor 200 and the vial 210 can be accomplished in one simple step. In certain instances, the medical connector 241 is coupled with the medical connector interface 240. A medical device or other instrument (not shown), such as a syringe, can be coupled with the interface 240 or, if present, with the medical connector 241 (see FIG. 4). For convenience, reference will be made hereafter only to a syringe as an example of a medical device suitable for attachment to the medical connector interface 240, although numerous medical devices or other instruments can be used in connection with the adaptor 200 or the medical connector 241. In some instances, the syringe is placed in fluid communication with the vial 210. In some instances, the vial 210, the adaptor 200, the syringe, and, if present, the medical connector 241 are inverted such that the cap 214 is pointing downward (e.g., toward the ground). Any of the above procedures, or any combination thereof, can be performed in any possible order.

In some instances, a volume of fluid is withdrawn from the vial 210 via the syringe. As described above, the pressure within the vial 210 decreases as the fluid is withdrawn. Accordingly, in some instances, pressure within the regulator channel 225 forces the tip 224 away from the sheath 222. In some instances, pressure at the interior of the bag 260 causes the bag 260 to expand outwardly from the sheath 222 and/or distally into the vial 210.

In some embodiments, the distal end 224*c* of the tip 224 is rounded such that it is sufficiently pointed to pierce the septum 216 when the adaptor 200 is coupled with the vial 210, but insufficiently pointed to pierce the bag 260 as the bag 260 is deployed or as it expands within the vial 210. In certain variants, the proximal extension 224*a* is rounded for similar purposes.

In some embodiments, it is also desirable that the proximal extension 224*a* not rigidly bear against the bag 260 as the bag 260 expands within the vial 210. Accordingly, in some embodiments, the proximal extension 224*a* comprises a flexible or compliant material, such as silicone rubber, butyl rubber, or closed cell foam. In certain embodiments, the proximal extension 224*a* comprises a joint, such as a hinge or a ball-and-socket, that allows the proximal extension 224*a* to bend when contacted by the bag 260.

In certain implementations, fluid withdrawn from the vial 210 flows through the extractor aperture 246 and through the extractor channel 245 to the syringe. In some embodiments, ambient air simultaneously flows from the surrounding environment, through the regulator aperture 250, through the regulator channel 225, and into the bag 260 to expand the bag 260. In certain embodiments, the increased volume of the bag 260 is approximately equal to the volume of liquid removed from the vial 210. In some variants, the volume of the bag 260 increases at a slower rate as greater amounts of fluid are withdrawn from the vial 210 such that the volume of fluid withdrawn from the vial 210 is greater than the increased volume of the bag 260. As noted above, the bag 260 can be configured to fill a substantial portion of the vial 210. In some implementations, the tip 224 is sized and configured such that it will not settle against the extractor aperture 246 and prevent fluid passage therethrough.

In some instances, more fluid than is desired may inadvertently be withdrawn from the vial 210 by the syringe. Accordingly, the excess fluid may be injected from the syringe back into the vial 210. In some embodiments, when the fluid is injected to the vial 210, the fluid flows from the syringe, through the extractor channel 245, and through the extractor aperture 246 into the vial 210. As the fluid is forced into the vial 210, the pressure within the vial 210 increases. Consequently, in some implementations, the bag 260 contracts to a smaller volume to compensate for the volume of the returned fluid. As the bag 260 contracts, ambient air flows from the bag 260, through the regulator channel 225, and through the regulator aperture 250 to the surrounding environment, in some embodiments.

Thus, in certain embodiments, the adaptor 200 accommodates the withdrawal of fluid from, or the addition of fluid to, the vial 210 in order to maintain the pressure within the vial 210. In various instances, the pressure within the vial 210 changes no more than about 1 psi, no more than about 2 psi, no more than about 3 psi, no more than about 4 psi, or no more than about 5 psi.

The adaptor 200 can allow a user to return unwanted liquid (and/or air) to the vial 210 without significantly increasing the pressure within the vial 210. As detailed earlier, the ability to inject air bubbles and excess fluid into the vial 210 is particularly desirable in the context of oncology drugs.

Certain embodiments of the adaptor 200 are configured to regulate the pressure within the vial 210 without introducing outside air into the vial 210. For example, in some embodiments, the bag 260 comprises a substantially impervious material that serves as a barrier, rather than a passageway, between the exterior and interior of the vial 210. Accordingly, such embodiments of the adaptor 200 substantially reduce the risk of introducing airborne contaminants into the bloodstream of a patient, as compared with the systems that employ, for example, Gortex® or Teflon® air filters, which can be prone to failure. Elimination of such filters can make EtO sterilization unnecessary. Consequently, more efficient and convenient forms of sterilization, such as gamma sterilization and electron beam sterilization, can be used to sterilize certain embodiments of the adaptor 200. Manufacturers can thereby benefit from the resulting cost savings and productivity increases. However, some embodiments of the adaptor 200 (or other variants described herein) use filters at one or more points between the bag 260 and the regulator aperture 250.

In certain embodiments, the bag 260 comprises an elastic material. Accordingly, as the bag 260 expands within the vial 210, a restorative force arises within the bag 260 that tends to contract the bag 260. In some instances the restorative force is fairly small, and can be balanced by a force within a syringe that is coupled to the adaptor 200. For example, the restorative force can be balanced by friction between the plunger and the interior wall of the syringe. Consequently, in some instances, the restorative force does not affect the withdrawal of an accurate amount of fluid from the vial 210. However, when the syringe is decoupled from the adaptor 200, the restorative force of the expanded bag 260 is no longer balanced. As a result, the bag 260 tends to contract, which encourages fluid within the extractor channel 245 to return to the vial 210. Accordingly, the adaptor 200 can reduce the likelihood that fluid will spurt from the vial 210 when the syringe is decoupled therefrom, which is particularly beneficial when oncology drugs are being removed from the vial 210. When the adaptor 200 is used with the medical connector 241 (see FIG. 4), such as the Clave® connector, attached to the medical connector interface 240, the adaptor 200 can be substantially sealed in a rapid manner after removal of the syringe from the proximal end of the medical connector 240.

In certain embodiments, a syringe or some other medical device can be decoupled from the adaptor 200 after a portion of fluid has been removed from the vial 210 and then re-coupled with the adaptor 200, such as to return unwanted or excess liquid or air to the vial 210.

In some embodiments, multiple doses can be removed from the vial 210 via the adaptor 200. For example, in some embodiments a first syringe is coupled with the adaptor 200 and a first dose is removed from the vial 210. The first syringe is then decoupled from the adaptor 200. Similarly, a second syringe is then coupled with the adaptor 200 (or the first syringe is coupled with the adaptor 200 for a second time), a second dose is removed from the vial 210, and the second syringe (or the first syringe) is decoupled from the adaptor 200. In like manner, numerous doses can be removed from the same vial 210 via the adaptor 200.

In some embodiments, the vial 210 contains a powder, a concentrated liquid, or some other substance that is diluted prior to administration thereof to a patient. Accordingly, in certain embodiments, a diluent is infused into the vial 210 via the adaptor 200. In some embodiments, a syringe containing the diluent is coupled with the adaptor 200. The vial 210 can be placed upright on a hard surface and the plunger of the syringe can be depressed to urge the diluent through the adaptor 200 and into the vial 210. The plunger can be released and allowed to back out of the syringe until pressure within the vial 210 is equalized. In some embodiments, the syringe is decoupled from the adaptor 200, the same or a different syringe or some other medical device is coupled the adaptor 200, and the diluted contents of the vial 210 are removed.

In certain embodiments, decoupling and re-coupling of a syringe or other medical device, removal of multiple doses from the vial 210 via a single adaptor 200, and/or infusing a diluent into the vial 210 is facilitated when the adaptor 200 comprises a medical connector 240, such as the Clave® connector.

As noted above, in some instances the vial 210 is oriented with the cap 214 pointing downward when liquid is removed from the vial 210. In certain advantageous embodiments, the extractor aperture 246 is located adjacent a bottom surface of the cap 214, thereby allowing removal of most or substantially all of the liquid in the vial 210. In some embodiments, the adaptor 200 comprises more than one extractor aperture 246 to aid in the removal of substantially all of the liquid in the vial 210. In some embodiments, the distal end 223 of the piercing member 220 is spaced away from the extractor aperture 246. Such arrangements can allow fluid to flow through the extractor aperture 246 unobstructed as the distal portion 261 of the bag 260 expands.

Figure 8:
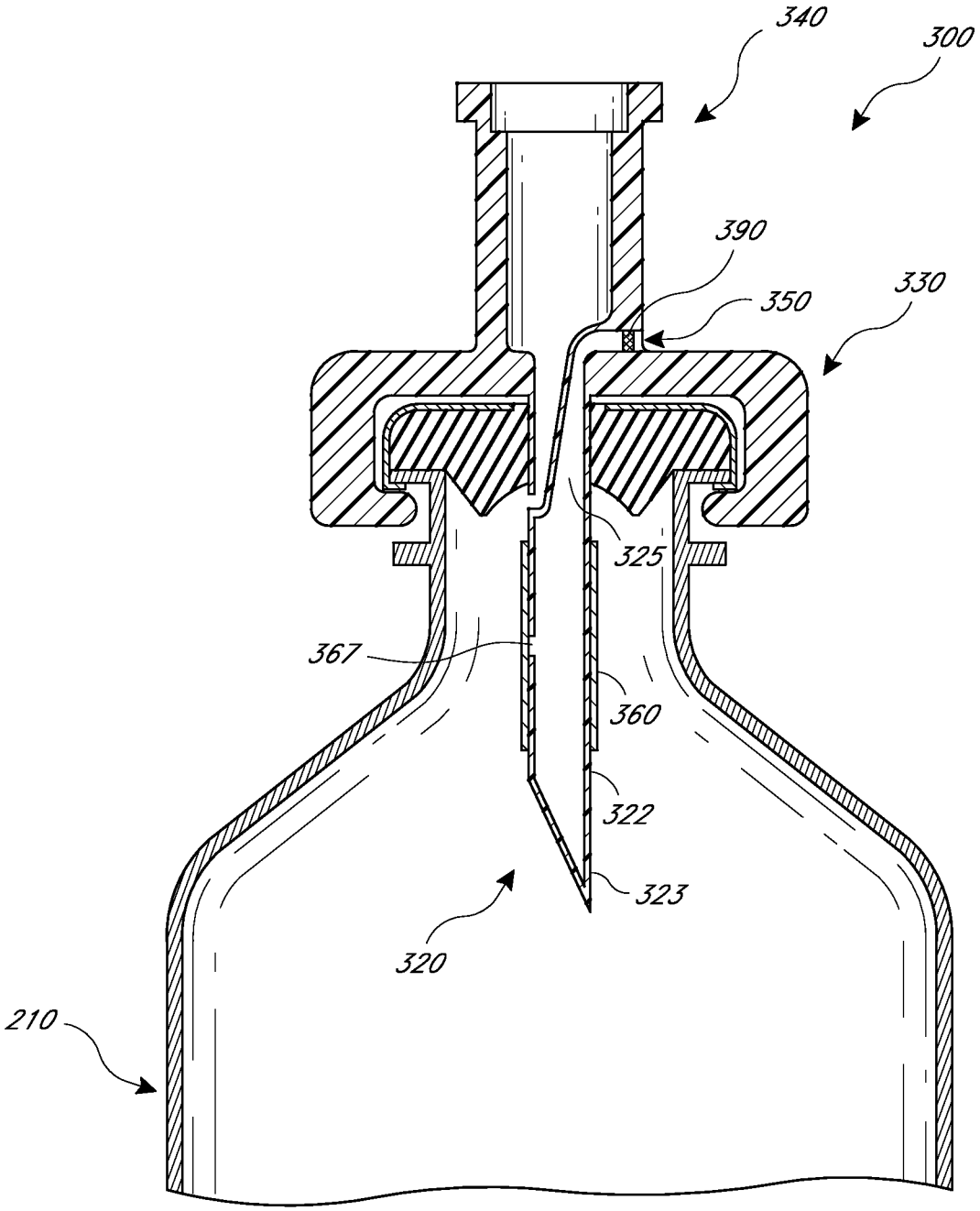
FIG. 8 is a partial cross-sectional view of a vial adaptor coupled with a vial.

FIG. 8 illustrates another embodiment of an adaptor 300. The adaptor 300 resembles the adaptor 200 discussed above in many respects. Accordingly, numerals used to identify features of the adaptor 200 are incremented by a factor of 100 to identify like features of the adaptor 300. This numbering convention generally applies to the remainder of the figures.

In certain embodiments, the adaptor 300 comprises a medical connector interface 340, a cap connector 330, and a piercing member 320. The cap connector comprises a regulator channel 325 and a regulator aperture 350. The piercing member comprises a bag 360 and a sheath 322, which in turn comprises a vent 367 and closed distal end 323. The piercing member 320 differs from the piercing member 220 in that it has, for example, a closed distal end 323 and the vent 367 and it does not comprise a separate tip. The closed distal end 323 is configured to pierce the septum 216 and to inhibit fluid passage through the distal end 323. In the illustrated embodiment, the distal end 323 is angled from one side of the sheath 322 to another. Other configurations and structures are also possible. Additionally, the vent 367 in the piercing member 320 can be in fluid communication with the inside of the bag 360 and the regulator channel 325. Thus, in certain embodiments, ambient fluid can flow through the regulator channel 325, through the vent 367, and into the bag 360 to expand the bag 360. The bag can be configured to expand outwardly from the sheath 322 and/or distally (e.g., away from the cap 214). In some instances, the distal end 323 is sufficiently sharp to pierce the septum 216 when the adaptor 300 is coupled with the vial 210, but insufficiently sharp to pierce or damage the bag 360 when the bag 360 is deployed or expanded within the vial 210. In some embodiments, the adaptor 300 also includes a filter 390. In some embodiments, the filter 390 is located in the regulator channel 325, at the regulator channel 350, or in the bag 360. In some embodiments, the filter 390 is a hydrophobic filter, which could prevent fluid from exiting the vial 210 in the unlikely event that the bag 360 ruptured during use.

Figure 9C:
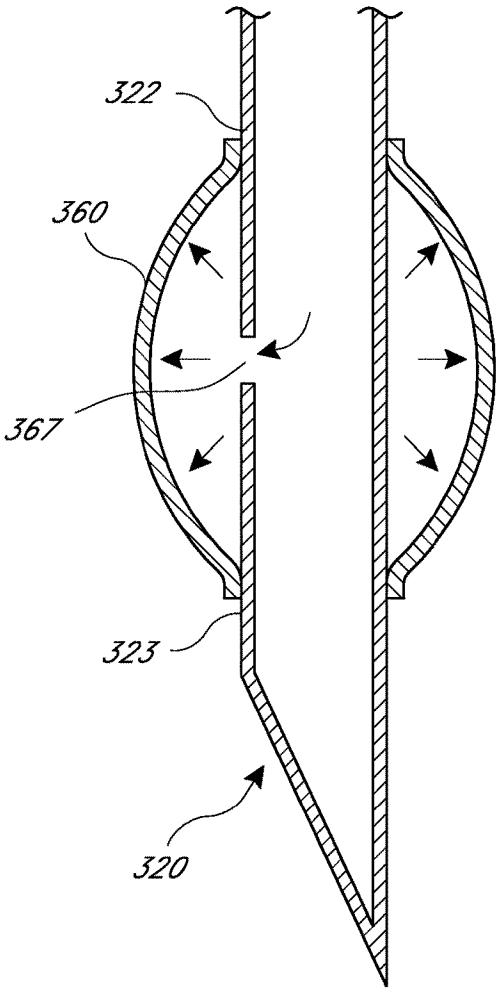
FIG. 9C is a cross-sectional view depicting the distal portion of the piercing member of the vial adaptor of FIG. 8.
Figure 9B:
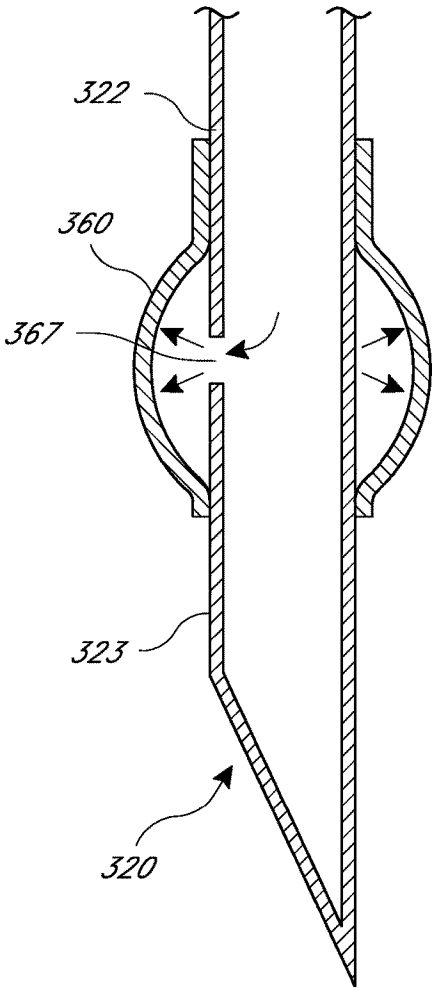
FIG. 9B is a cross-sectional view depicting the distal portion of the piercing member of the vial adaptor of FIG. 8.
Figure 9A:
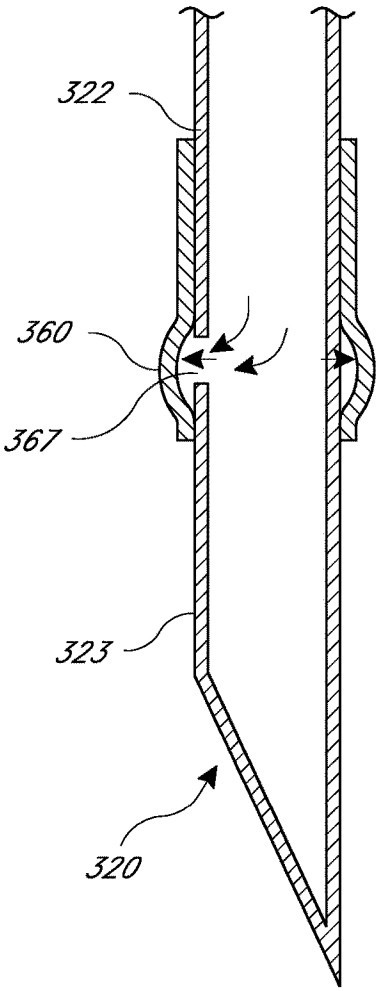
FIG. 9A is a cross-sectional view depicting a distal portion of a piercing member of the vial adaptor of FIG. 8.

FIGS. 9A-9C illustrate a distal portion of the sheath 322 of the adaptor 300 in various stages of deployment (e.g., expansion) of the bag 360. In certain scenarios, the adaptor 300 is coupled with a partially evacuated vial 210 (not shown) such that the pressure outside the vial 210 (e.g., atmospheric pressure) is higher than the pressure inside the vial 210. Accordingly, one side of the bag 360 can be exposed to the higher pressure outside the vial 210 and the other side of the bag 360 can be exposed to the lower pressure inside the vial 210. As a result of the pressure difference, ambient air can flow through the regulator aperture 350, through the regulator channel 325, through the vent 367, and into the bag 260 to thus expand the bag 260, as schematically depicted by various arrows.

Figure 10:
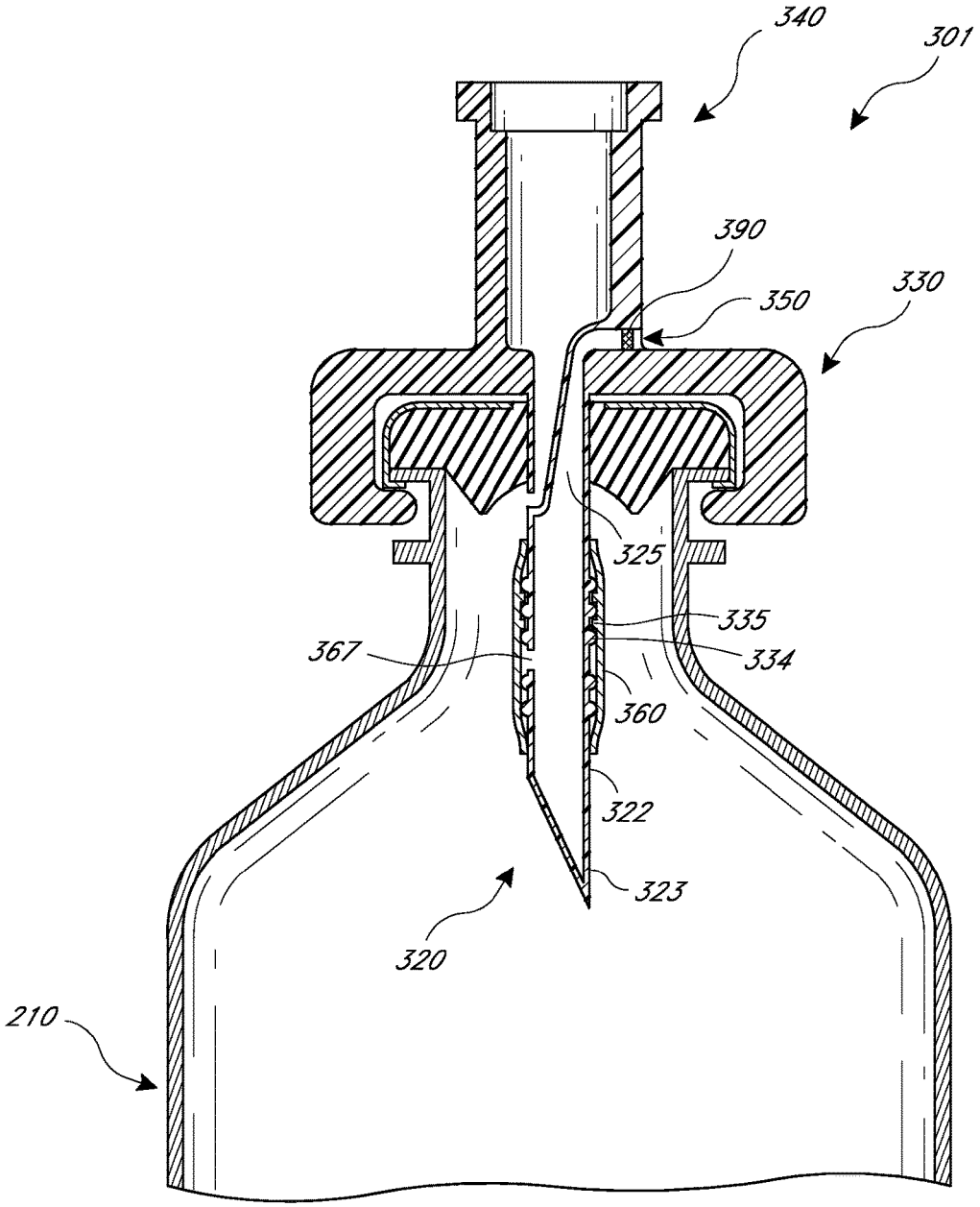
FIG. 10 is a partial cross-sectional view of a vial adaptor coupled with a vial.

FIG. 10 illustrates another embodiment of an adaptor 301. The adaptor 301 resembles the adaptor 300 discussed above in many respects, but comprises a sheath texture element 334 on an outer surface 332 of the sheath 322. The sheath texture element 334 can comprise, for example, one or more dimples, perforations, knobs, scratches, grooves, ridges, bumps, and the like. As shown, in some embodiments, the sheath texture element 334 includes projections, e.g., annular ribs. In certain embodiments, the sheath texture element 334 extends along substantially the entire axial length of the sheath 322. In some embodiments, the sheath texture element 334 extends along a portion of the axial length of the sheath 322, e.g., along a portion near the distal end 323 or a long a portion over which the bag 360 is attached. In some embodiments, the sheath texture element 334 provides a high-friction interface between the sheath 322 and the bag 360, which can inhibit axial displacement (e.g., bunching) of the bag 360 during insertion into the vial 210. Maintaining the placement of the bag 360 during insertion into the vial 210 can also reduce the likelihood of tearing or ripping of the bag 360.

In certain embodiments, the bag 360 comprises a bag texture element 335. The bag texture element 335 can be configured to contact the outer surface 332 of the sheath 322. In some case, the bag texture element 335 interfaces with the sheath texture element 334, so that the texture elements 334, 335 cooperate, as in mating teeth. In certain implementations, the bag texture element 335 is configured to interface with or be received in the vent 367. For example, in some embodiments the bag texture element 335 seals the vent 367. In certain embodiments, the bag texture element 335 extends along substantially the entire axial length of the bag 360. In some embodiments, the bag texture element 335 extends along a portion of the axial length of the bag 360, e.g., along a portion near a proximal portion 362. Similar to the discussion above concerning the sheath texture element 334, the bag texture element 335 can increase friction between the sheath 322 and the bag 360, thereby reducing the likelihood of bunching, tearing, or ripping of the bag 360 during insertion into the vial 210.

Figure 11:
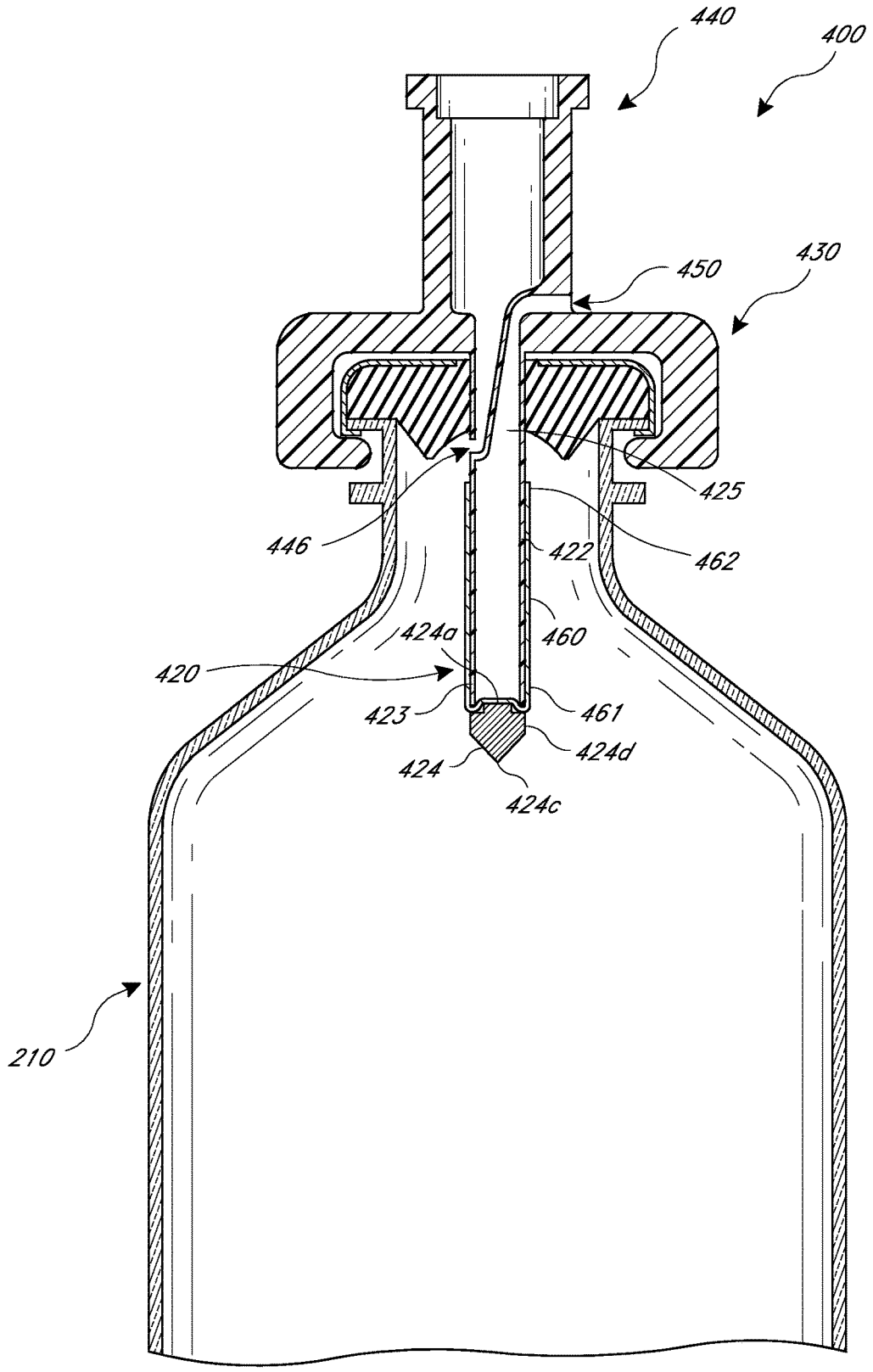
FIG. 11 is a partial cross-sectional view of a vial adaptor coupled with a vial.
Figure 12:
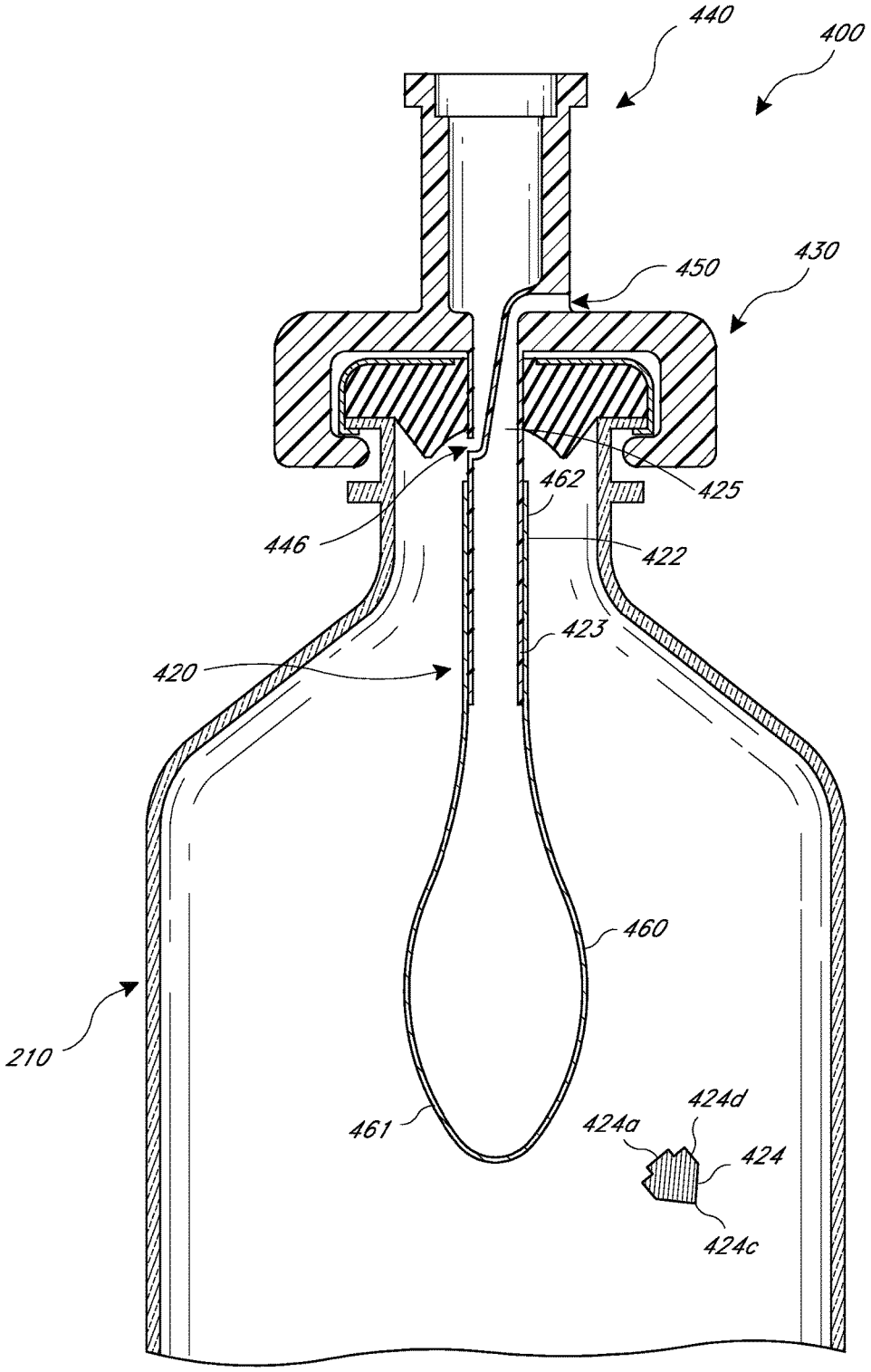
FIG. 12 is a partial cross-sectional view of the vial adaptor of FIG. 11 in a subsequent stage.

Another embodiment of an adaptor 400 is illustrated in FIGS. 11 and 12. FIG. 11 depicts the adaptor 400 in an undeployed state; FIG. 12 shows the adaptor 400 in a deployed state. The adaptor 400 comprises a medical connector interface 440, a cap connector 430, and a piercing member 420. The cap connector 430 comprises a regulator channel 425 and a regulator aperture 450. The piercing member comprises a tip 424, a bag 460, and a sheath 422 having a distal end 423. The adaptor 400 resembles the adaptors 200, 300 described above in many ways, but comprises a piercing member 420 and a bag 460 having a slightly different configuration than the piercing members 220, 320 and bags 260, 360, some of those differences being described below.

In certain implementations, the bag 460 comprises a closed distal end 461. The closed distal end 461 can facilitate ease of manufacturing of the bag 460 and can reduce the likelihood of leaks in the bag 460. As shown, the closed distal end 461 can be positioned between the distal end 423 of the sheath 422 and the tip 424. In some embodiments, the closed distal end 461 is compressed between the distal end 423 of the sheath 422 and the tip 424. Typically, the compression of the distal end 461 of the bag 460 is not of such magnitude as to rip or tear the bag 460.

In some embodiments, the tip 424 engages the sheath 422. Various techniques can be used to engage the tip 424 with the sheath 422, such as using a friction fit between the proximal extension 424*a* and the sheath 422 or using adhesive between the bag 460 and the tip 424. For example, since in certain embodiments the bag 460 is elastic or similar, as discussed above, the bag 460 can deform in the area of compression between the tip 424 and the sheath 422, thereby providing a tight interface between the tip 424 and the sheath 422. In some embodiments the compression of the tip 424 against the distal end 461 of the bag 460 maintains the tip 424 on the sheath 422 when the bag 460 is undeployed. In certain embodiments, the distal end 461 of the bag 460 is removably adhered to the distal end 423 of the sheath 422, such that during expansion of the bag 460 the adhesive force is overcome and the distal end 461 separates from the distal end 423.

In certain embodiments, the bag 460 protrudes into the regulator channel 425. Indeed, in some embodiments, the bag 460 folds or doubles-back on itself within the regulator channel 425. Such a folded configuration can facilitate, for example, use of a larger bag 460, compared to embodiments that do not use a folded configuration.

In certain of such instances, such as is shown in FIG. 12, as the bag 460 is deployed it moves distally, thus discharging and separating from the tip 424. The bag 460 is thus free to expand within the vial 210. In certain embodiments, therefore, it is desirable for the tip 424 to be engaged with the sheath 422 and/or bag 460 with sufficient strength to ensure that the tip 424 remains in place until the sheath 422 is inserted into the vial 210, yet with insufficient strength to prevent the tip 424 from separating from the sheath 422 and/or the bag 460 within the vial 410.

In some instances, it is desirable to prevent the bag 260 from bearing against the distal end 424*c* of the tip 424 as the bag 460 expands within the vial 210. Accordingly, in certain embodiments, the proximal extension 424*a* is configured such that the tip 424, once separated from the sheath 422, naturally settles with the distal end 424*c* pointed away from the bag 460. For example, in some instances, the distal end 424*c* settles against the septum 216 when the vial 210 is oriented with the cap 214 pointing downward (e.g., with the cap 214 located between a volumetric center of the vial 210 and the ground). In some embodiments, the proximal extension 424*a* is non-existent or is relatively lightweight such that the center of mass of the tip 424 is located relatively near the distal end 424*c*. Accordingly, in some instances, when the tip 424 contacts the septum 216, the tip 424 is generally able to pivot about an edge 424*d* to reach a stable state with the distal end 424*c* pointed downward. In some variants, the edge 424*d* comprises the perimeter of the largest cross-section of the tip 424.

In certain embodiments, the proximal extension 424*a* is configured to allow the tip 424 to pivot such that the distal end 424*c* ultimately points downward, even when the proximal extension 424*a* is pointed downward upon initial contact with some surface of the vial 210, such as the septum 216. In certain instances, the length and/or weight of the proximal extension 424*a* are adjusted to achieve this result. In some instances, the length of the proximal extension 424*a* is between about 30 percent and about 60 percent, between about 35 percent and about 55 percent, or between about 40 percent and about 50 percent of the full length of the tip 424. In certain embodiments, the length of the proximal extension 424*a* is less than about 60 percent, less than about 55 percent, or less than about 50 percent of the full length of the tip 424. In some embodiments, the length is greater than about 60 percent of the full length of the tip 424. In certain variants, the length is less than about 30 percent of the full length of the tip 424. In some implementations, the length is about 45 percent of the full length of the tip 424. Other arrangements are also possible to ensure that the distal end 424*c* does not bear against the bag 260 as the bag expands within the vial 210.

Figure 13:
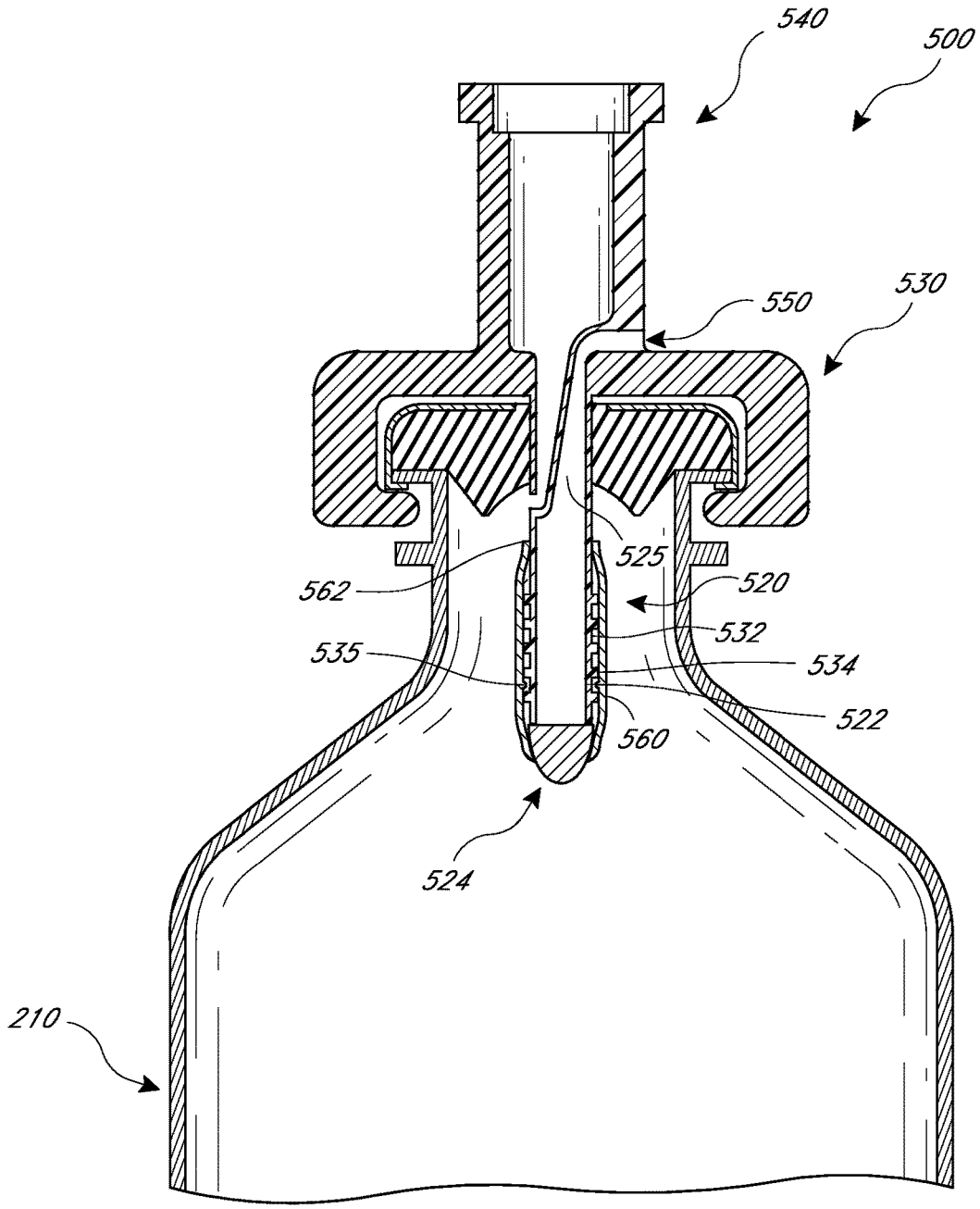
FIG. 13 is a partial cross-sectional view of a vial adaptor coupled with a vial.

FIG. 13 illustrates another embodiment of an adaptor 500 that resembles the adaptors 200-400 described above in many ways, but differs in others such as those noted hereafter. In certain embodiments, the adaptor 500 comprises a piercing member 520, a cap connector 530, and a medical connector interface 540. The cap connector 530 comprises a regulator channel 525 and a regulator aperture 550. The piercing member 520 comprises a sheath 522, a tip 524, and a bag 560. As shown, in some embodiments the tip 524 is rounded. In some embodiments, the sheath 522 includes a sheath texture element 534 on an outer surface 532 of the sheath 522. Similar to the discussion above (e.g., in connection with the adaptor 301), the sheath texture element 534 can comprise one or more dimples, perforations, knobs, scratches, grooves, ridges, bumps, and the like. In certain implementations, the sheath texture element 534 comprises projections, e.g., annular ribs. In some embodiments, the sheath texture element 534 extends along substantially the entire axial length of the sheath 522. Certain embodiments of the sheath texture element 534 extend along only a portion of the axial length of the sheath 522, e.g., along a portion near a proximal end 522.

Similarly, in some embodiments, the bag 560 can comprise a bag texture element 535. The bag texture element 535 can be configured to contact the outer surface 532 of the sheath 522. In certain embodiments, the bag texture element 535 and sheath texture element 534 are configured the same, e.g., both are shaped as annular ribs. In some variants, the bag texture element 535 and sheath texture element 534 are configured differently, e.g., one is configured as a step and one is configured as a groove. In some embodiments, the bag texture element 535 interfaces with the sheath texture element 534, so that the texture elements 534, 535 cooperate, as in mating teeth. The bag texture element 535 can be configured to extend along the entire or just a portion of the axial length of the bag 560.

Similar to the discussion concerning the adaptor 301, bag and/or sheath texture elements can increase the amount of friction between the sheath 522 and the bag 560. Such an increase in friction can reduce undesired movement of the bag 560 during insertion into the vial 210. In certain embodiments, the texture elements 534, 535 can decrease the chance of bunching, ripping, or tearing of the bag 560 during insertion into the vial 210.

In certain embodiments, the bag 560 is tapered. For example, in some embodiments the bag 560 comprises distal and proximal portions 561, 562 one or both of which are tapered. In some embodiments, as in the illustrated embodiment, the distal portion 561 is tapered distally, such that the thickness of the distal portion 561 decreases moving in the distal direction. Such a taper can reduce the likelihood of the bag 560 snagging or bunching during insertion into the vial 210. In some embodiments, the bag 560, or portions thereof, tapers proximally. In certain implementations, the bag 560 tapers along substantially its entire length.

Figure 14:
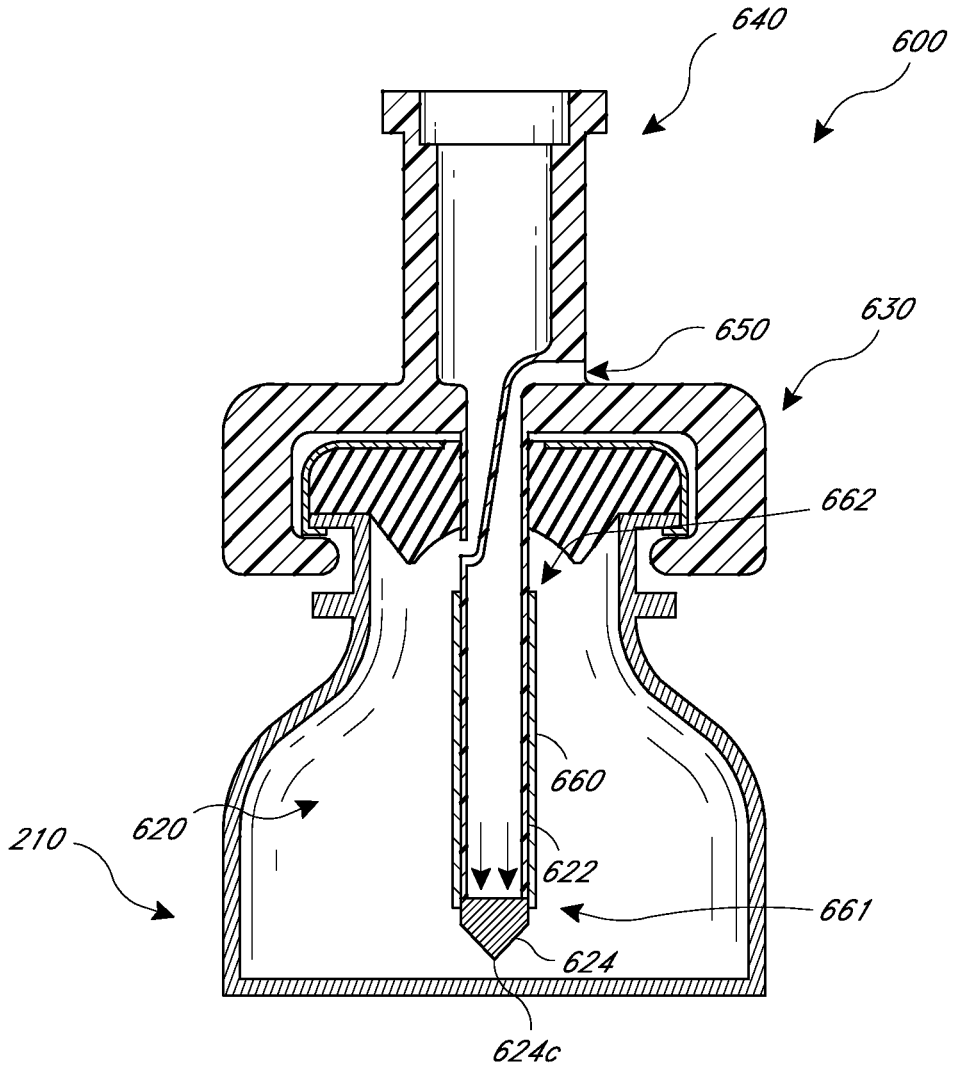
FIG. 14 is a partial cross-sectional view of a vial adaptor coupled with a vial.
Figure 15:
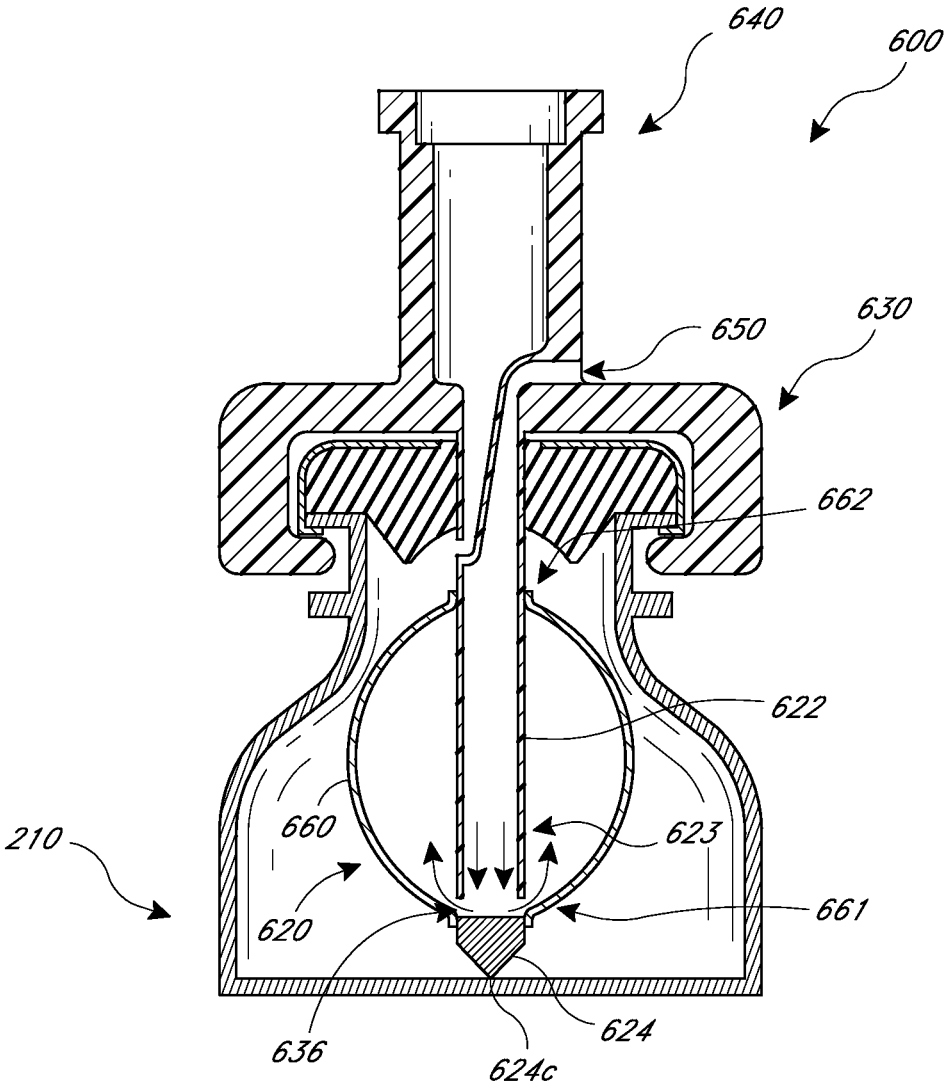
FIG. 15 is a partial cross-sectional view of the vial adaptor of FIG. 14 in a subsequent stage.

FIGS. 14 and 15 illustrate another embodiment of an adaptor 600. FIG. 14 illustrates the adaptor 600 in an undeployed state; FIG. 15 illustrates the adaptor 600 in a deployed state. The adaptor 600 resembles the adaptors 200-500 described above in some ways, but differs in certain other ways, some of which are discussed below. The adaptor 600 can be particularly favorable for use with embodiments of the vial 210 having reduced axial length, as discussed below. As also discussed below, in certain implementations, the adaptor 600 can be particularly useful with embodiments of the vial 210 having a reduced axial length, such as the embodiment of the vial 210 illustrated in FIGS. 14 and 15.

The adaptor 600 comprises a cap connector 630 that comprises a piercing member 620, a medical connector 640, a regulator aperture 650, and a regulator channel 625. The piercing member 620 comprises a sheath 622, a tip 624, and a bag 660. In some embodiments, a proximal portion 662 of the bag 660 is in substantially airtight engagement with the sheath 622. In certain implementations, a distal end 661 of the bag 660 is in substantially airtight engagement with the tip 624.

As illustrated, the adaptor 600 can be inserted into the vial 210. In certain embodiments, when the adaptor 600 is inserted into the vial 210, a distal end 624*c* of the tip 624 is positioned in close proximity to the distal end of the vial 210. For example, in some embodiments, when the adaptor 600 is inserted into the vial 210, the distance between the distal end 624*c* of the tip 624 and the distal end of the vial 210 is less than the axial length of the tip 624. In certain embodiments, when the adaptor 600 is inserted into the vial 210, the distance between the distal end 624*c* of tip 624 and the distal end of the vial 210 is less than about 0.5 inches.

Generally, when fluid is withdrawn from the vial 210 (e.g., through the extractor aperture and through the extractor channel as discussed above), the pressure outside the vial 210 (e.g., atmospheric pressure) is higher than the pressure inside the vial 210. Accordingly, one side of the bag 660 can be exposed to the higher pressure outside the vial 210 and the other side of the bag 660 can be exposed to the lower pressure inside the vial 210. As a result of the pressure difference, ambient air flows from the surrounding environment, through the regulator aperture 650 and through the regulator channel 625 and into contact with the tip 624. In certain embodiments, the pressure difference can force the tip 624 distally. Such distal movement of the tip 624 can open a passage 636 between the distal end 623 of the sheath 622 and the tip 624, thereby allowing the ambient air to flow into the bag 660 and expand the bag 660, as schematically depicted by various arrows in FIG. 15.

Various embodiments have various amounts of movement of the tip 624 toward the distal end of the vial 210. For example, in some embodiments, the tip 624 is moved distally less than about 0.5 inches. In some embodiments, the tip 624 is moved into contact with the distal end of the vial 210. In certain implementations, the tip 624 moves purely distally such that the passage 636 is perpendicular to the axial axis of the sheath 622, and no portion of the tip 624 contacts the sheath 622. In some embodiments, the tip 624 moves distally at an angle, such that the passage 636 is angled with respect to the axial axis of the sheath 622. In such instances, some portion of the tip 624 may remain in contact with the sheath 622. In some embodiments, the bag 660 is resilient such that after the fluid is no longer being withdrawn, the bag 660 relaxes proximally, thereby closing the passage 636 and/or reseating the tip 624 with the sheath 622.

As shown in the embodiment illustrated in FIG. 15, even if the distal movement of the tip 624 brings the tip 624 into contact with the distal end of the vial 210, the bag 660 is able to expand to regulate pressure changes in the vial 210 while fluid is withdrawn from the vial. Such a configuration can facilitate use of the adaptor 600 with embodiments of the vial 210 having reduced axial length, since only a small axial displacement of the tip 624 causes the passage 636 to open, thereby allowing ambient air to enter the space between the bag 660 and the sheath 622.

Figure 16:
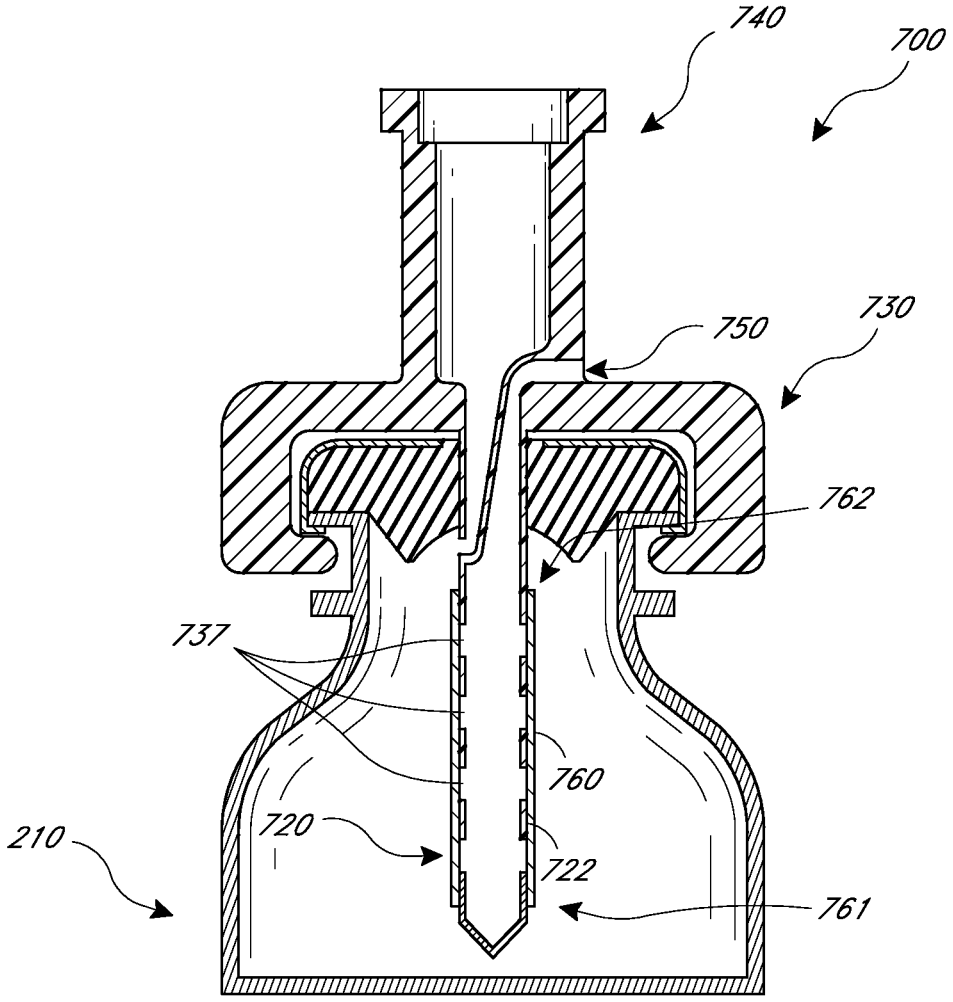
FIG. 16 is a partial cross-sectional view of a vial adaptor coupled with a vial.
Figure 17:
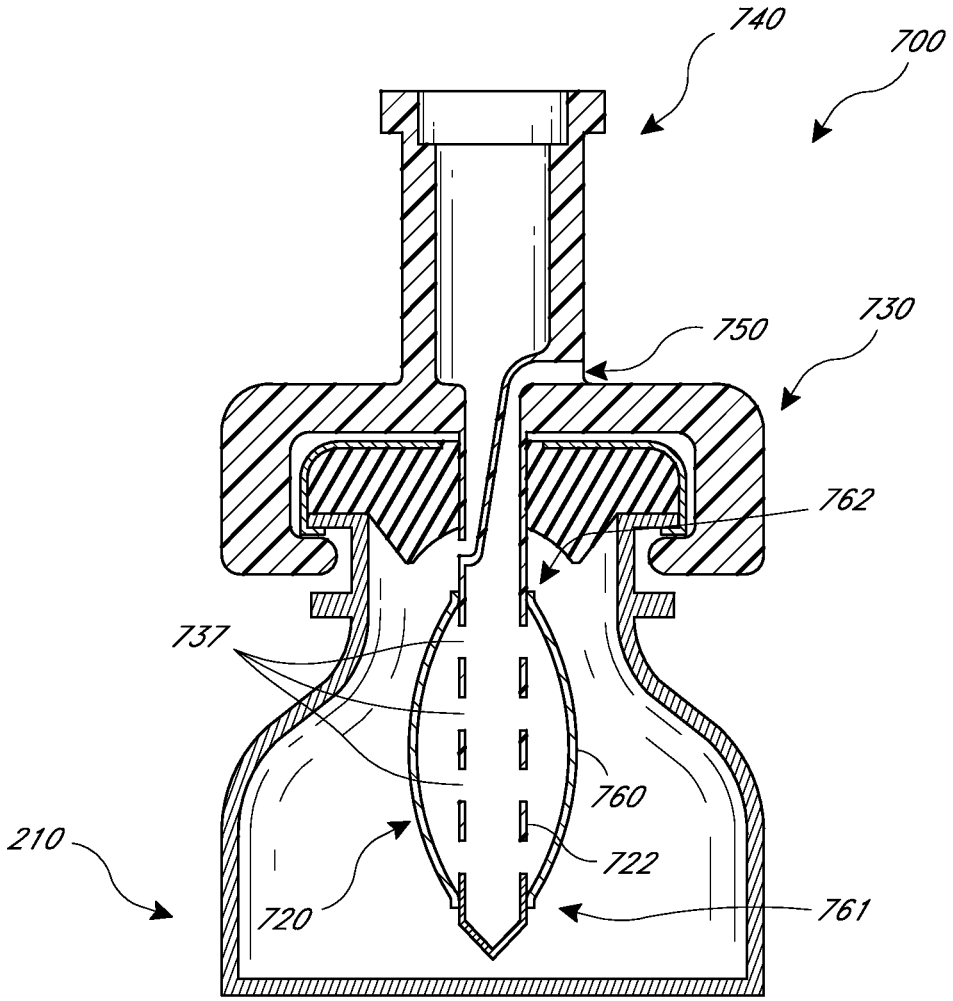
FIG. 17 is a partial cross-sectional view of the vial adaptor of FIG. 16 in a subsequent stage.

FIGS. 16 and 17 illustrate another embodiment of an adaptor 700. FIG. 16 illustrates the adaptor 700 in an undeployed state. FIG. 17 illustrates the adaptor 700 in a deployed state. The adaptor 700 comprises a cap connector 730, a medical connector interface 740, and a piercing member 720. The cap connector 730 comprises a regulator channel 725 and a regulator aperture 750. The piercing member 720 comprises a bag 760 and a sheath 722, which in turn can comprise a sidewall 728. In various embodiments, a distal end 761 and/or a proximal portion 762 of the bag 760 can be in substantially airtight engagement with the sheath 722. In some embodiments, the sheath 722 and/or the bag 760 comprise a texture element, e.g., annular ribs, as discussed above. In some aspects, the adaptor 700 resembles the adaptors 200-600 described above, but differs in certain other aspects, some of which are discussed below. In certain implementations, the adaptor 700 can be used with a vial 210 having a short axial length, such as, for example, a vial having an axial length that is not substantially greater or only a relatively small distance greater than length of the piercing member 720. An example of such a vial 210 is illustrated in FIGS. 16 and 17.

In certain embodiments, as in the illustrated configuration, the sheath 722 comprises a plurality of perforations 737. Generally, the perforations 737 extend through the sidewall 728 of the sheath 722. The perforations 737 can comprise various shapes, such as circular, elliptical, triangular, rectangular, diamond, star-shaped, polygonal, round, elongate, oblong, or otherwise. Also, the perforations 737 can be regularly or irregularly spaced from each other. In some embodiments, the perforations 737 are located substantially around the entire outer periphery of the sheath 722. In some embodiments, the perforations 737 are located on only one portion of the sheath 722.

In certain variants, the perforations 737 can provide a dual function. For example, during withdrawal of fluid from the vial 210, the perforations 373 can facilitate passage of ambient air between the regulator channel 725 and the bag 760, thereby expanding the bag, as shown in FIG. 17 and as noted above. In some embodiments, the perforations 737 enhance the friction between the sheath 722 and the bag 760, which can inhibit movement and tearing of the bag 760, as discussed above.

In the illustrated embodiment, the adaptor 700 includes a conical tip 724 that is monolithic and/or integrally formed of a unitary piece of material with the sheath 722. Such a configuration can facilitate stability of the adaptor 700 during insertion of the piercing member 720 into the vial 210, as the tip 724 is not configured to separate from the sheath 722. Such a design can also facilitate manufacturability of the piercing member, as the sheath 722 and tip 724 can be formed in a single process, e.g., injection molding. Embodiments of the adaptor 700 with a monolithic sheath 722 and tip 724 can facilitate use with embodiments of the vial 210 having reduced axial length, since the adaptor 700 is configured to permit ambient air to enter the bag 760 with little or no movement of the tip 724.

Figure 18:
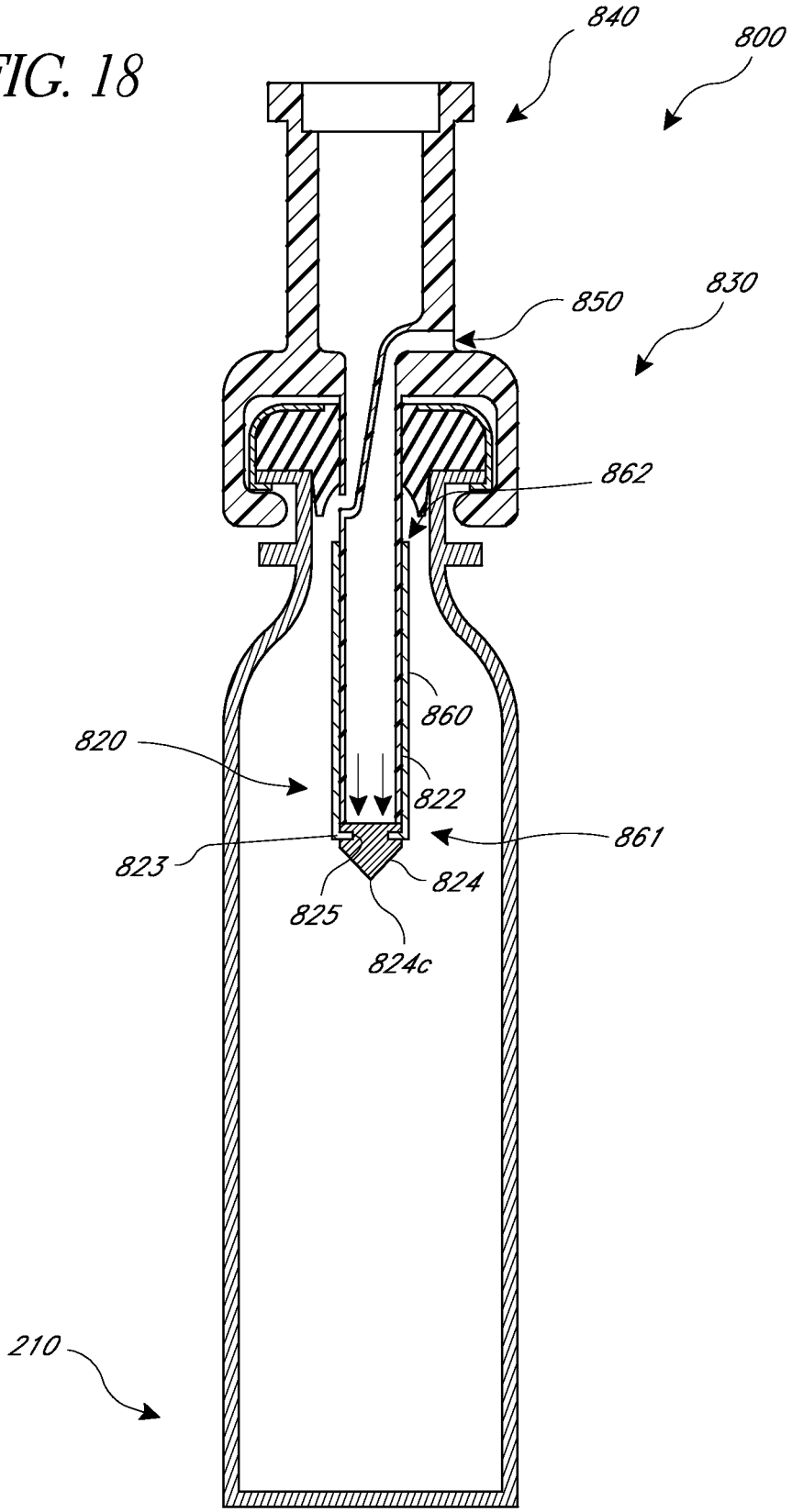
FIG. 18 is a partial cross-sectional view of a vial adaptor coupled with a vial.
Figure 19:
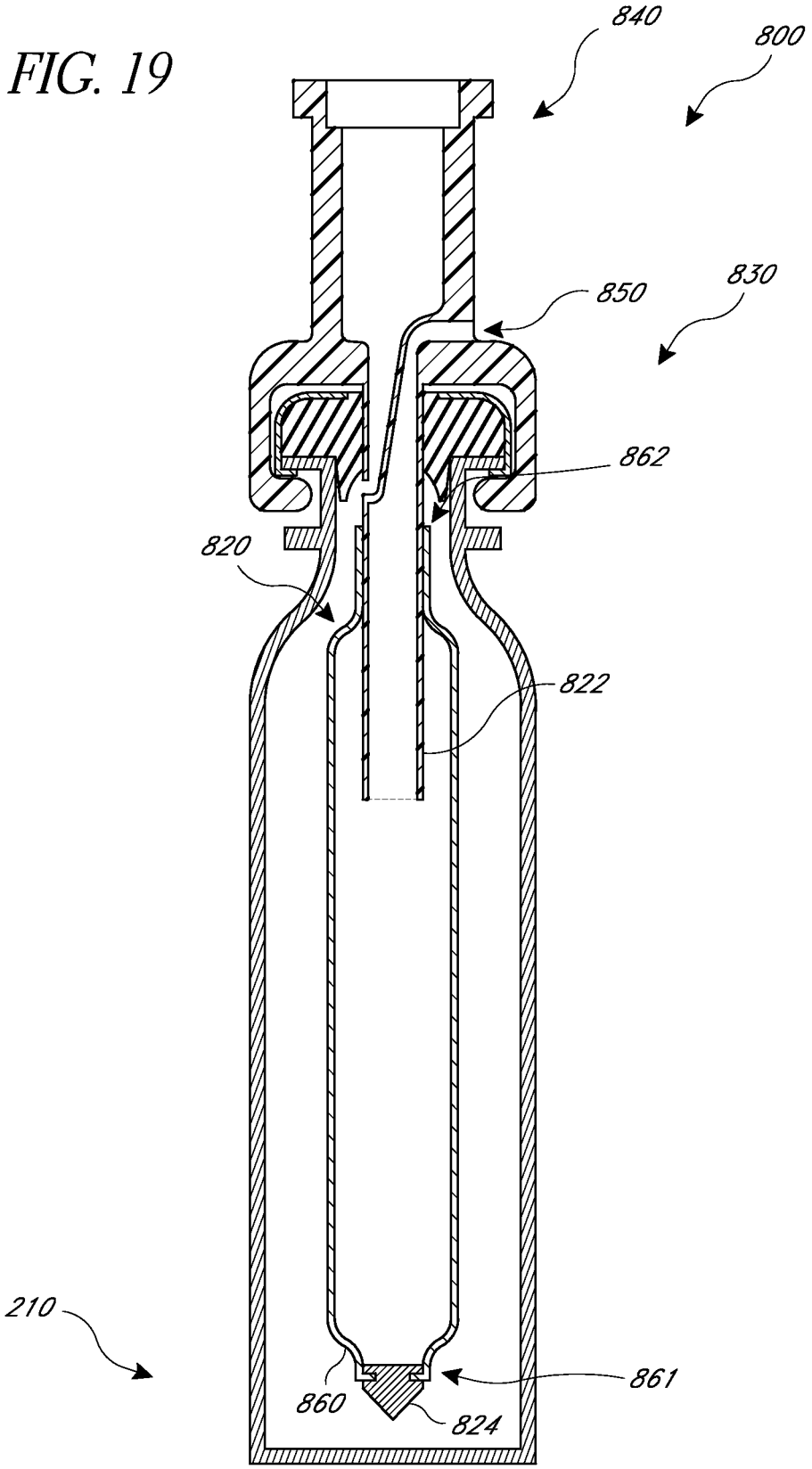
FIG. 19 is a partial cross-sectional view of the vial adaptor of FIG. 18 in a subsequent stage.

FIGS. 18 and 19 illustrate another embodiment of an adaptor 800. FIG. 18 illustrates the adaptor 800 in an undeployed configuration and FIG. 19 illustrates the adaptor 800 in a deployed configuration. The adaptor 800 comprises a cap connector 830, a medical connector interface 840, and a piercing member 820. The piercing member 820 can comprise a series of openings or perforations to permit passage of air at multiple points along its length into the bag 860. The cap connector 830 comprises a regulator channel 825 and a regulator aperture 850. The piercing member 820 comprises a sheath 822, a tip 824 with a first attachment structure 825, and a bag 860 with a second attachment structure 823.

The first attachment structure 825 on the piercing member 820 is configured to facilitate attachment with the second attachment structure 823 on the bag 860. In the illustrated example, the first attachment structure 825 comprises a generally annular groove on the outer surface of the tip 824. In some embodiments, including those in which there is no detachable tip, the first attachment structure 825 can be on the shaft of the piercing member 820. In some embodiments, the first attachment structure 825 can comprise one or more bumps or indentations or other structures. In the illustrated example, the second attachment structure 823 comprises a lip at or near a distal end of the bag 860 that is sized and oriented to fit within the groove on the outer surface of the tip 824. In its natural, unconnected configuration, the second attachment structure 823 can comprise an internal diameter that is smaller than the external diameter of the first attachment structure 825 so that the tip 824 is forced into place within the bag 860 and the second attachment structure 823 exerts a radially inwardly directed force against the first attachment structure 825 that is sufficient to help retain the tip 824 to the bag 860. As illustrated, the lip can extend radially inwardly in a direction generally perpendicular to the primary direction of expansion of the bag 860. In some embodiments, the second attachment structure 823 can comprise one or more bumps or indentations or other structures. The first and second attachment structures 825, 823 generally comprise corresponding or complimentary shapes to permit close, attaching contact. In some embodiments, as illustrated in FIG. 19, the first and second attachment structures 825, 823 facilitate retaining the tip 824 on the bag 860, even during and after expansion of the bag 860.

A proximal portion 862 of the bag 860 can be in substantially airtight engagement with the sheath 822. A distal end 861 of the bag 860 can be in substantially airtight engagement with the tip 824. In some embodiments, the sheath 822 and/or the bag 860 comprise a texture element, e.g., annular ribs, as noted above. In some aspects, the adaptor 800 is like the adaptors 200-700 described above, but differs in certain other aspects, some of which are discussed below. As discussed below, in certain implementations, the adaptor 800 can be particularly useful with embodiments of the vial 210 having a reduced diameter, such as the embodiment of the vial 210 illustrated in FIGS. 18 and 19.

In certain embodiments, the adaptor 800 can facilitate pressure-regulation in embodiments of the vial 210 that comprise a diameter that is substantially less than the length. For example, in some embodiments, the adaptor 800 is configured to be used with embodiments of the vial 210 having an internal length that is at least about 2 or about 3 or about 4 times larger than the internal diameter of the vial 210. In some contexts, the narrow diameter of the vial 210 can present a challenge, as there may be little radial space in which to expand the bag to offset the pressure change during withdrawal of fluid from the vial. In some embodiments, the bag 860 is configured to expand axially (e.g., toward the distal end of the vial 210) to a much greater extent than radially (e.g., toward the side of the vial 210). In certain variants, the bag 860 expands a first distance radially and a second distance axially, and the second distance is substantially greater than the first distance. For example, in some embodiments, the expanding portion of the bag 860 can expand in the axial direction at least about 4 times as much as in the radial direction. In some embodiments, the expansion radially is less than about 50% of the original radial size of the bag 860 and the expansion axially is at least about 75% or at least about 100% of the original radial size of the bag 860. As illustrated, the additional cross-sectional width of the bag 860 after expansion is approximately the same as or less than the cross-sectional width of the piercing member 820.

In some embodiments, as illustrated in FIG. 18, a portion of the bag 860 can be permanently connected to the piercing 820 and a portion of the bag 860 can be in temporary overlapping contact with the piercing member 820 in the undeployed state. After expansion of the bag 860, the portion in temporary overlapping contact can move radially outwardly to provide a space between the outer surface of the piercing member 820 and the inner surface of the balloon (see FIG. 19), thereby enabling more of the balloon material to be radially free so as to permit further expansion in the axial direction.

In some embodiments, the bag 860 expands radially to a limited degree that still permits passage of fluids between the wall of the vial 210 and the wall of the bag 860, and/or the bag 860 expands axially by nearly the entire length of the interior of the vial 210. In some embodiments, the bag 860 expands axially by an amount that is greater than the length of the piercing member 820 and/or the bag 860 expands radially to a point where the wall of the bag comes close to the interior wall of the vial 210 without touching. Some embodiments of the bag 860 are configured so as not to contact the internal sidewalls of the vial 210 when the bag is expanded. In some embodiments, the bag 860 expands axially to a stage where it contacts the distal end of the interior of the vial 210. In certain embodiments, during and after expansion, the bag 860 can retain a generally cylindrical shape along virtually its entire length as illustrated in FIG. 19 rather than a bulbous or spheroid shape. As illustrated, the expanded shape of the bag 860 can be substantially uniform along substantially its entire length. In certain embodiments, the bag 860 expands distally but does not contact the distal end of the vial 210.

In certain variants, the bag 860 is configured to expand to fill substantially the entire vial 210. In some embodiments, the bag 860 is expandable such that the distal end 861 of the bag 860 is near the distal end of the vial 210. In some embodiments, such expansion of the bag 860 is facilitated by the bag 860 comprising an elastic material. In certain implementations, the axial expansion of the bag 860 is facilitated by the bag 860 comprising one or more folds or the bag 860 otherwise being doubled-back on itself.

Figure 20:
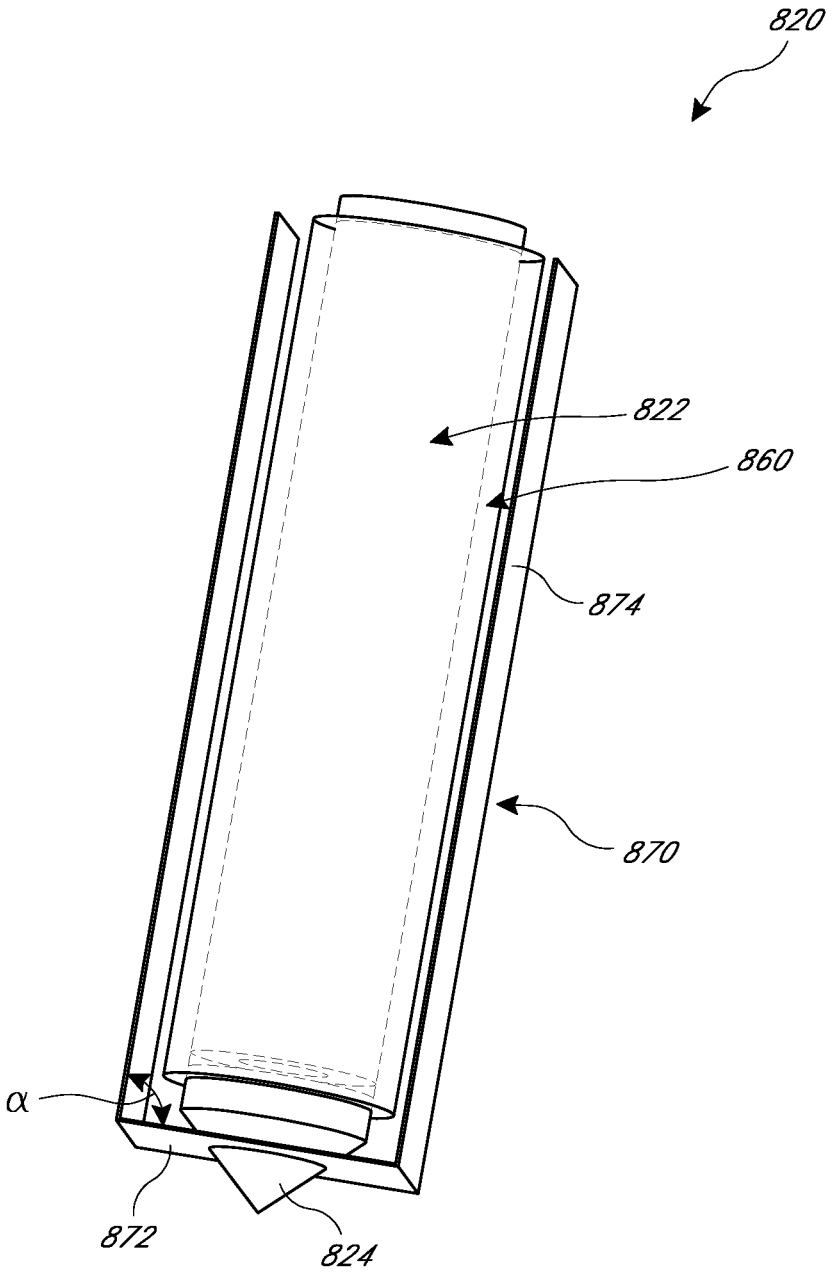
FIG. 20 is a partial perspective view of an embodiment of a piercing member of the vial adaptor of FIGS. 18 and 19, including an insertion facilitating member.

In some embodiments, the adaptor 800 includes an insertion facilitating member 870, such as is illustrated in FIG. 20. The insertion facilitating member 870 can be configured to promote penetration (e.g., sliding) of the bag 860 and/or the piercing member 820 through the septum of the vial 210. Certain variants are configured to reduce the likelihood of damage to the bag 860 or mispositioning of the bag 860 occurring during the insertion process, such as bunching or tearing of the bag 860 during passage of at least some of the bag 860 through the septum of the vial 210. In some embodiments, the insertion facilitating member 870 avoids or reduces the need for a lubricant to be applied to the bag 860. The insertion facilitating member 870 can comprise a lubricant, such as by way of a coating or within the matrix of the material of the insertion facilitating member 870.

In some implementations, the insertion facilitating member 870 is coupled with or positioned near the tip 824. For example, the insertion facilitating member 870 can include a distal portion 872 with an opening configured to receive a portion of the tip 824 or configured to permit the tip 824 to pass there through. In some embodiments, the distal portion 872 and the tip 824 are joined, such as by adhesive or welding. In certain variants, the opening of the distal portion 872 is received in a receiving structure (such as a groove (not shown)) in the tip 824, thereby mechanically fastening or positioning the distal portion 872 relative to the tip 824.

In some embodiments, the insertion facilitating member 870 includes one or more (e.g., 2, 3, 4, 5, 6, or more) axially extending members, such as arms 874. In some variants, the arms 874 are positioned generally equidistant from each other around the circumference of the bag 860, in generally opposing regions of the bag 860. For example, in some embodiments with two arms, the arms 874 can be located generally radially opposite each other around the circumference of the bag 860.

In certain implementations, the arms 874 extend along some or all of the axial length of the sheath 822 and/or the piercing member 820. In some variants, the arms 874 extend generally parallel with the axial axis of the sheath 822, at least during some portion of the insertion phase. In some embodiments, the arms 874 extend at an angle $\alpha$ with respect to a line perpendicular to the axial axis of the sheath 822. In certain variants, the angle $\alpha$ is about 90°. According to certain implementations, the angle $\alpha$ is obtuse (e.g., at least about: 95°, 100°, 110°, 120°, values in between, and otherwise). In some embodiments, the angle $\alpha$ is acute (e.g., less than about: 89°, 80°, 70°, 60°, values in between, and otherwise). In some implementations, the radial distance between distal ends of the arms 874 is less than the radial distance between proximal ends of the arms 874.

As shown, some embodiments of the arms 874 are radially spaced apart from the bag 860. In some embodiments, the arms 874 contact at least a portion of the bag 860. In certain variants, the insertion facilitating member 870 is configured to expand with and/or separate from the bag 860 when the bag 860 expands within the vial 210 (e.g., during removal of fluid from the vial). For example, in some embodiments, when the tip 824 moves distally during expansion of the bag 860, the insertion facilitating member 870 moves (e.g., slides) distally relative to the bag 860. As illustrated, a proximal region of one or more arms 874 can be unconnected, moveable, and/or free-floating with respect to the bag 860, the cap connector, and/or the piercing member 820.

In some embodiments, a radial outer surface area of the insertion facilitating member 870 is substantially less than a radial outer surface area of the bag 860, such that a majority of the outer surface area of the bag is not adjacent to or near an arm 874. For example, the ratio of the total radial outer surface area of the arms 874 compared to the radial outer surface area of the bag 860 can be less than or equal to about: 1/10, 1/5, 1/3, 1/2, values in between, or otherwise. In some embodiments, the radial outer surface area of the insertion facilitating member 870 is about equal to or greater than the radial outer surface area of the bag 860. For example, the insertion facilitating member 870 can be substantially cylindrically shaped and can be sized such that the radial outer surface area of the cylinder is about equal to or greater than the radial outer surface area of the bag 860. In certain implementations, the insertion facilitating member 870 has a generally continuous radially outer surface. In some variants, the insertion facilitating member 870 generally surrounds the circumference of the sheath 822.

In certain embodiments, the insertion facilitating member 870 is configured to reduce the amount of friction between the septum of the vial 210 and the adaptor 800 during passage of at least some of the bag 860 through the septum. For example, the insertion facilitating member 870 can be made of a material or otherwise configured such that the coefficient of friction between the insertion facilitating member 870 and the septum is less than the coefficient of friction between the bag 860 and the septum. Thus, when the bag 860 is inserted through the septum, the amount of friction between the septum and the adaptor 800 can be reduced. Such a configuration can, for example, promote penetration (e.g., sliding) of the bag 860 and/or the piercing member 820 through the septum of the vial 210 and/or can reduce the likelihood of the bag 860 bunching or tearing during passage of at least some of the bag 860 through the septum of the vial 210. In some embodiments, the insertion facilitating member 870 can avoid or reduce the need for a lubricant to be applied to the bag 860. In certain implementations, the facilitating member 870 is configured to reduce the amount of friction between the septum of the vial 210 and the adaptor 800 by at least about: 3%, 5%, 9%, 15%, 20%, values in between, and otherwise, as compared to using a bag 860 alone (either a lubricated or unlubricated bag). In some embodiments, the insertion facilitating member 870 comprises plastic (e.g., polyamide, polytetrafluoroethylene, etc.) or Mylar®. In certain variants, the insertion facilitating member 870 includes a coating. For example, at least some of the insertion facilitating member 870 can be coated with a fluoropolymer, such as polytetrafluoroethylene.

The following is a partial list of some examples of embodiments that are within the scope of this disclosure. The example embodiments that are listed should in no way be interpreted as limiting the scope of the embodiments, nor of including all inventions that are described or enabled by this disclosure, nor of including all of the inventions that are contemplated within the scope of this disclosure. Rather, this disclosure includes many structures, features, steps, and methods, all of which can be used alone or in any combination with any other structures, features, steps, and methods, that are disclosed herein or otherwise, not all of which are listed below. Also, various features of the example embodiments that are listed can be removed, added, or combined to form additional embodiments, which are considered part of this disclosure:

1. A vial adaptor comprising:

a housing member comprising a piercing member having a proximal end and a distal end, the distal end of the piercing member configured to pierce a septum of a vial;

a connector configured to couple the housing member with the vial;

an extractor channel formed in the housing member, the extractor channel configured to facilitate withdrawal of a medical fluid from the vial when the adaptor is coupled to the vial;

a regulator channel formed in the piercing member, the regulator channel configured to facilitate a flow of a regulating fluid therethrough during withdrawal of the medical fluid; and an expansion member connected with an external surface of the proximal end of the piercing member and in fluid communication with the regulator channel, the expansion member configured to expand to receive the flow of the regulating fluid as the medical fluid is withdrawn from the vial.

2. The vial adaptor of embodiment 1, wherein the expansion member is configured to regulate pressure in the vial when fluid is withdrawn from the vial.

3. The vial adaptor of embodiment 1 or embodiment 2, wherein the piercing member comprises a terminal member.

4. The vial adaptor of embodiment 3, wherein the terminal member is detachable from a remainder of the piercing member.

5. The vial adaptor of embodiment 3, wherein the terminal member comprises brass or aluminum.

6. The vial adaptor of embodiment 3, wherein the terminal member comprises polypropelene, polycarbonate, or glass impregnated Valox™.

7. The vial adaptor of embodiment 3, wherein the terminal member is in airtight engagement with the expansion member.

8. The vial adaptor of any of the preceding embodiments, wherein the expansion member comprises polyisoprene or silicone rubber.

9. The vial adaptor of any of the preceding embodiments, wherein the piercing member is configured to have a total axial length that is about equal to a total axial length of the vial.

10. The vial adaptor of any of the preceding embodiments, wherein a distal-most end of the piercing member is configured to be positioned adjacent a distal end of the vial.

11. The vial adaptor of any of the preceding embodiments, wherein a distal end of the piercing member is closed.

12. The vial adaptor of any of the preceding embodiments, wherein the piercing member comprises a vent in fluid communication with the regulator channel.

13. The vial adaptor of any of the preceding embodiments, wherein the piercing member comprises a plurality of perforations in fluid communication with the regulator channel.

14 The vial adaptor of any of the preceding embodiments, wherein the piercing member comprises a plurality of annular ribs.

15 The vial adaptor of any of the preceding embodiments, further comprising a lubricant applied to at least one of the piercing member and the expansion member.

16. The vial adaptor of embodiment 15, wherein the lubricant comprises fluorosilicone oil.

17. The vial adaptor of any of the preceding embodiments, wherein the expansion member is bonded to the piercing member with an adhesive.

18. The vial adaptor of embodiment 17, wherein the adhesive comprises a RTV silicone adhesive.

19. The vial adaptor of any of the preceding embodiments, wherein the expansion member is connected with a proximal-most end of the piercing member.

20. The vial adaptor of any of the preceding embodiments, wherein the expansion member is connected with the piercing member a distance from a proximal-most end of the piercing member.

21. The vial adaptor of embodiment 20, wherein the distance is about 10% of an axial length of the piercing member.

22. The vial adaptor of any of the preceding embodiments, wherein the expansion member further comprises a proximal portion that does not include a proximal-most end of the expansion member.

23. The vial adaptor of any of the preceding embodiments, wherein the expansion member further comprises a distal portion that does not include a distal-most end of the expansion member.

24. The vial adaptor of any of the preceding embodiments, wherein the external surface of the proximal end of the piercing member is positioned radially outward of the piercing member with respect to an axial center of the piercing member.

25. A pressure-regulating vial adaptor comprising:

a body comprising a connector and a piercing member, the connector configured to couple with a vial, the piercing member configured to pierce a septum of the vial;

an extractor channel formed in the body, the extractor channel configured to allow withdrawal of a medical fluid from the vial when the adaptor is coupled to the vial;

a regulator channel formed in the piercing member, the regulator channel configured to allow a flow of ambient air therethrough during withdrawal of the medical fluid; and an expansion member in fluid communication with the regulator channel and configured to expand to receive the flow of ambient air, a first portion of the expansion member in airtight engagement with a first region of the piercing member, a second portion of the expansion member in airtight engagement with a second region of the piercing member, the first region being spaced apart from the second region.

26. The vial adaptor of embodiment 25, wherein the expansion member is configured to regulate a pressure in the vial.

27. The vial adaptor of embodiment 25 or embodiment 26, wherein the first portion comprises a proximal end of the expansion member and the second portion comprises a distal end of the expansion member.

28. The vial adaptor of any of embodiments 25-27, wherein the first region is located on an outside surface of the piercing member.

29. The vial adaptor of any of embodiments 25-28, wherein a distal end of the piercing member is closed.

30. The vial adaptor of any of embodiments 25-29, wherein the piercing member comprises a sidewall, the sidewall comprising a vent, the vent in fluid communication with the regulator channel and the expansion member.

31. The vial adaptor of any of embodiments 25-30, wherein the expansion member comprises polyisoprene or silicone rubber.

32. The vial adaptor of any of embodiments 25-31, wherein the piercing member is configured to have a total axial length that is about equal to a total axial length of the vial.

33. The vial adaptor of any of embodiments 25-32, wherein a distal-most end of the piercing member is configured to be positioned adjacent a distal end of the vial.

34. The vial adaptor of any of embodiments 25-33, wherein the vent comprises a plurality of apertures.

35. The vial adaptor of any of embodiments 25-34, wherein the piercing member comprises a plurality of annular ribs.

36. The vial adaptor of any of embodiments 25-35, further comprising a lubricant applied to at least one of the piercing member and the expansion member.

37. The vial adaptor of embodiment 25, wherein the lubricant comprises fluorosilicone oil.

38. The vial adaptor of any of embodiments 25-37, wherein the expansion member is bonded to the piercing member with an adhesive.

39. The vial adaptor of any of embodiments 25-38, wherein the adhesive comprises a RTV silicone adhesive.

40. A vial adaptor comprising:

a housing member comprising a piercing member, the piercing member having an axial length and configured to pierce a septum of a vial;

a connector configured to couple the housing member with the vial;

an extractor channel formed in the housing member, the extractor channel configured to facilitate withdrawal of a medical fluid from the vial when the adaptor is coupled to the vial;

a regulator channel formed in the piercing member, the regulator channel configured to facilitate a flow of a regulating fluid therethrough during withdrawal of the medical fluid; and an expansion member in fluid communication with the regulator channel, the expansion member comprising at least one aperture and containing a generally cylindrical or spheroidal volume, the expansion member configured to receive through the aperture and into the volume a substantial portion of the axial length of the piercing member, wherein the expansion member is configured to expand to receive the flow of the regulating fluid as the medical fluid is withdrawn from the vial.

41. The vial adaptor of embodiment 40, wherein the expansion member is configured to receive at least 50% of the axial length of the piercing member.

42. The vial adaptor of embodiment 40 or embodiment 41, wherein the expansion member encompasses a prolate or oblate spheroid volume.

43. The vial adaptor of any of embodiments 40-42, wherein the expansion member further comprises an axial intermediate region in contact with the piercing member.

44. The vial adaptor of any of embodiments 40-43, wherein the expansion member is connected with the external surface of the piercing member.

45. The vial adaptor of any of embodiments 40-44, wherein the expansion member is configured to regulate a pressure in the vial.

46. The vial adaptor of any of embodiments 40-45, wherein the expansion member is connected to an external surface of the piercing member.

47. The vial adaptor of any of embodiments 40-46, wherein the expansion of the expansion member regulates a pressure in the vial.

48. The vial adaptor of any of embodiments 40-47, wherein the piercing member comprises a terminal member.

49. The vial adaptor of embodiment 40, wherein the terminal member is detachable from a remainder of the piercing member.

50. The vial adaptor of embodiment 40, wherein the terminal member comprises brass or aluminum.

51. The vial adaptor of embodiment 40, wherein the terminal member comprises polypropelene, polycarbonate, or glass impregnated Valox™.

52. The vial adaptor of embodiment 40, wherein the terminal member is in airtight engagement with the expansion member.

53. The vial adaptor of any of embodiments 40-52, wherein the expansion member comprises polyisoprene or silicone rubber.

54. The vial adaptor of any of embodiments 40-53, wherein the piercing member is configured to have a total axial length that is about equal to a total axial length of the vial.

55. The vial adaptor of any of embodiments 40-54, wherein a distal-most end of the piercing member is configured to be positioned adjacent a distal end of the vial.

56. The vial adaptor of any of embodiments 40-55, wherein a distal end of the piercing member is closed.

57. The vial adaptor of any of embodiments 40-56, wherein the piercing member comprises a vent in fluid communication with the regulator channel.

58. The vial adaptor of any of embodiments 40-57, wherein the piercing member comprises a plurality of perforations in fluid communication with the regulator channel.

59. The vial adaptor of any of embodiments 40-58, wherein the piercing member comprises a plurality of annular ribs.

60. The vial adaptor of any of embodiments 40-59, further comprising a lubricant applied to at least one of the piercing member and the expansion member.

61. The vial adaptor of embodiment 40, wherein the lubricant comprises fluorosilicone oil.

62. The vial adaptor of any of embodiments 40-61, wherein the expansion member is bonded to the piercing member with an adhesive.

63. The vial adaptor of embodiment 40, wherein the adhesive comprises a RTV silicone adhesive.

64. A method of maintaining a substantially constant pressure within a vial, the method comprising:

coupling a housing member to a vial, the housing comprising a piercing member;

piercing a septum of the vial with a distal end of the piercing member;

permitting a medical fluid to flow through an extractor channel formed in the housing member, the extractor channel configured to facilitate withdrawal of a medical fluid from the vial when the adaptor is coupled to the vial; and permitting a regulating fluid to flow through a regulator channel during withdrawal of the medical fluid, the regulator channel formed in the piercing member, the regulating fluid being received in an expansion member connected to a proximal end of the piercing member, the expansion member being configured to expand in as the medical fluid is withdrawn.

65. The method of embodiment 64, wherein the expansion member is connected to the external surface of the piercing member.

66. The method of embodiment 64 or embodiment 65, wherein the expansion member is configured to regulate a pressure in the vial.

67. The method of any of embodiments 64-66, wherein the piercing member comprises a tip member.

68. The method of embodiment 64, wherein the tip member is detachable from remainder of the piercing member.

69. The method of embodiment 64, wherein the tip member comprises polypropelene, polycarbonate, or glass impregnated Valox™.

70. The method of embodiment 64, wherein the tip member is in airtight engagement with the expansion member.

71. The method of any of embodiments 64-70, wherein the expansion member comprises polyisoprene or silicone rubber.

72. The method of any of embodiments 64-71, wherein the piercing member is configured to have a total axial length that is about equal to a total axial length of the vial.

73. The method of any of embodiments 64-72, wherein a distal-most end of the piercing member is configured to be positioned adjacent a distal end of the vial.

74. The method of any of embodiments 64-73, wherein a distal end of the piercing member is closed.

75. The method of any of embodiments 64-74, wherein the piercing member comprises a vent in fluid communication with the regulator channel.

76. The method of any of embodiments 64-75, wherein the piercing member comprises a plurality of perforations in fluid communication with the regulator channel.

77. The method of any of embodiments 64-76, wherein the piercing member comprises a plurality of annular ribs.

78. The method of any of embodiments 64-77, further comprising applying a lubricant to at least one of the piercing member and the expansion member.

79. The method of embodiment 64, wherein the lubricant comprises fluorosilicone oil.

80. The method of any of embodiments 64-79, wherein the expansion member is bonded to the piercing member with an adhesive.

81. The method of embodiment 64, wherein the adhesive comprises a RTV silicone adhesive.

82. A method of manufacturing a pressure-regulating vial adaptor, the method comprising:

providing a body comprising a connector, an extractor channel, and an elongate piercing member, the connector configured to couple with a vial, the extractor channel configured to allow withdrawal of a medical fluid from the vial when the adaptor is coupled to the vial, the piercing member configured to pierce a septum of the vial and comprising:

a first region;

a second region non-adjacent the first region, the second region spaced longitudinally along the length of the piercing member from the first region; and a regulator channel configured to allow a flow of ambient air therethrough during withdrawal of the medical fluid;

providing an expansion member configured to expand to receive the flow of ambient air, the expansion member comprising a first portion and a second portion;

connecting the first portion of the expansion member with the first region of the piercing member; and connecting the second portion of the expansion member with the second region of the piercing member.

83. The method of manufacturing of embodiment 82, further comprising lubricating the expansion member.

84. The method of manufacturing of embodiment 82 or embodiment 83, wherein the first region is located on an outside surface of the piercing member.

85. A pressure regulating vial adaptor comprising:

a housing adapted to couple with a vial, the housing comprising a piercing member, the piercing member configured to pass through a septum of the vial when the housing is coupled with the vial; and an expansion member connected with the piercing member, the expansion member configured to contact the septum when the piercing member is passed through the septum;

wherein the expansion member is configured to move between a first orientation, in which the expansion member is substantially folded or unexpanded, and a second orientation, in which the expansion member is substantially unfolded or expanded, when medicinal fluid is withdrawn from the vial while the vial adaptor is coupled with the vial, thereby regulating pressure within the vial.

86. The vial adaptor of embodiment 85, further comprising a lubricant applied to at least one of the piercing member and the expansion member.

87. The vial adaptor of embodiment 86, wherein the lubricant comprises fluorosilicone oil.

88. The vial adaptor of embodiment 85, wherein at least one of the piercing member and the expansion member comprises a texture element configured to promote friction between the piercing member and the expansion member and thereby inhibit movement of expansion member relative to the piercing member when the piercing member is passed through the septum.

89. The vial adaptor of embodiment 88, wherein the texture element comprises a plurality of annular ribs.

90. The vial adaptor of embodiment 88, wherein the texture element comprises a plurality of grooves.

91. The vial adaptor of embodiment 88, wherein the texture element comprises a plurality of dimples.

92. The vial adaptor of embodiment 88, wherein the texture element comprises a plurality of perforations in the piercing member.

93. The vial adaptor of any of embodiments 85-92, wherein the piercing member further comprises an outside surface and an inside surface, the inside surface forming a fluid flow channel in the piercing member, the textured element disposed on the outside surface.

94. The vial adaptor of any of embodiments 85-93, wherein the piercing member further comprises a smooth region.

95. A pressure regulating vial adaptor comprising:

a housing adapted to couple with a vial configured to contain a volume of medical fluid, the housing comprising a piercing member configured to pierce a septum of the vial when the housing is coupled with the vial, the piercing member comprising an axial length, an outer surface, and an expansion member, the expansion member connected with the outer surface and configured to expand from a first state to a second state at least partly in response to a change in the volume of medical fluid contained the vial, wherein the axial length of the piercing member is substantially the same when the expansion member is in the first state and the second state.

96. The pressure regulating vial adaptor of embodiment 95, wherein the expansion member expands substantially transverse to the axial length of the piercing member.

97. The pressure regulating vial adaptor of embodiment 95 or embodiment 96, wherein the piercing member further comprises a plurality of apertures.

98. The pressure regulating vial adaptor of any of embodiments 95-97, wherein the adaptor is configured to couple with a vial having a vial width that is greater than a vial height, the vial height being measured from a base of the vial to the septum, the vial width being measured transverse to the height.

99. A pressure regulating vial adaptor comprising:

a housing adapted to couple with a vial configured to contain a volume of medical fluid, the housing comprising a piercing member assembly configured to pierce a septum of the vial when the housing is coupled with the vial, the piercing member assembly comprising a longitudinal axis, a sheath, and an expansion member, the expansion member connected with an outside surface of the piercing member assembly and configured to expand substantially orthogonal to the longitudinal axis at least partly in response to a change in the volume of medical fluid contained the vial.

100. The pressure regulating vial adaptor of embodiment 99, wherein the expansion member is further configured to expand toward a base of the vial positioned opposite the septum, and wherein the expansion of the expansion member is not impeded by the base.

101. The pressure regulating vial adaptor of embodiment 99 or embodiment 100, wherein the expansion member is configured to not expand along the direction of the longitudinal axis.

102. The pressure regulating vial adaptor of any of embodiments 99-101, wherein the expansion member is configured to not contact walls of the vial that extend substantially parallel to the longitudinal axis.

103. The pressure regulating vial adaptor of any of embodiments 99-102, wherein the expansion member is configured to expand a first distance in a direction generally parallel to the longitudinal axis and a second distance in a direction generally orthogonal to the longitudinal axis, the first distance being at least four times the second distance.

104. The pressure regulating vial adaptor of any of embodiments 99-103, wherein the expansion member is configured to inflate from an initial unexpanded state to an expanded state, in the unexpanded state the expansion member having a first outermost diameter and a first longitudinal length, in the expanded state the expansion member having a second outermost diameter and a second longitudinal length, the second longitudinal length being at least five times the second outermost diameter.

105. The pressure regulating vial adaptor of embodiment 104, wherein the second outermost diameter is less than or equal to three times the first outermost diameter.

106. The pressure regulating vial adaptor of any of embodiments 99-105, wherein the piercing member has a longitudinal length that is at least three times the largest inside diameter of the vial.

107. The device of any of the previous embodiments, further comprising lubricant on the expansion member.

Although the vial adaptor has been disclosed in the context of certain embodiments and examples, it will be understood by those skilled in the art that the vial adaptor extends beyond the specifically disclosed embodiments to other alternative embodiments and/or uses of the embodiments and certain modifications and equivalents thereof. For example, some embodiments can be configured to use a fluid other than ambient air to fill the bag, e.g. sterilized air, nitrogen, water, saline, or other fluids. As another example, certain embodiments comprise a plurality of bags, wherein each bag is coupled with and configured to expand radially outwardly from one of the perforations. It should be understood that various features and aspects of the disclosed embodiments can be combined with or substituted for one another in order to form varying modes of the vial adaptor. For example, the closed distal end and vent of FIG. 8 can be incorporated into the embodiment of FIGS. 18 and 19. Accordingly, it is intended that the scope of the vial adaptor herein-disclosed should not be limited by the particular disclosed embodiments described above, but should be determined only by a fair reading of the claims that follow.

The following is claimed:

1. A vial adaptor comprising:

a housing member comprising a piercing member having a proximal end and a distal end, the distal end of the piercing member configured to pierce the septum of a vial;

a connector configured to couple the housing member with the vial;

an extractor channel formed in the housing member, the extractor channel configured to facilitate withdrawal of a medical fluid from the vial when the adaptor is coupled to the vial;

a regulator channel formed in the piercing member, the regulator channel configured to facilitate a flow of a regulating fluid therethrough during withdrawal of the medical fluid; and an expansion member connected with an external surface of the proximal end of the piercing member and in fluid communication with the regulator channel, the expansion member configured to contact the septum during insertion of the piercing member into the vial and to expand to receive the flow of the regulating fluid as the medical fluid is withdrawn from the vial.

2. The vial adaptor of claim 1, wherein the expansion member is configured to regulate pressure in the vial when fluid is withdrawn from the vial.

3. The vial adaptor of claim 1, wherein the piercing member comprises a terminal member.

4. The vial adaptor of claim 3, wherein the terminal member is detachable from a remainder of the piercing member.

5. The vial adaptor of claim 3, wherein the terminal member comprises brass or aluminum.

6. The vial adaptor of claim 3, wherein the terminal member comprises polypropelene, polycarbonate, or glass impregnated polybutylene terephthalate.

7. The vial adaptor of claim 3, wherein the terminal member is in airtight engagement with the expansion member.

8. The vial adaptor of claim 1, wherein the expansion member comprises polyisoprene or silicone rubber.

9. The vial adaptor of claim 1, wherein the piercing member is configured to have a total axial length that is about equal to a total axial length of the vial.

10. The vial adaptor of claim 1, wherein a distal-most end of the piercing member is configured to be positioned adjacent a distal end of the vial.

11. The vial adaptor of claim 1, wherein a distal end of the piercing member is closed.

12. The vial adaptor of claim 1, wherein the piercing member comprises a vent in fluid communication with the regulator channel.

13. The vial adaptor of claim 1, wherein the piercing member comprises a plurality of perforations in fluid communication with the regulator channel.

14. The vial adaptor of claim 1, wherein the piercing member comprises a plurality of annular ribs.

15. The vial adaptor of claim 1, further comprising a lubricant applied to at least one of the piercing member and the expansion member.

16. The vial adaptor of claim 15, wherein the lubricant comprises fluorosilicone oil.

17. The vial adaptor of claim 1, wherein the expansion member is bonded to the piercing member with an adhesive.

18. The vial adaptor of claim 17, wherein the adhesive comprises a RTV silicone adhesive.

19. The vial adaptor of claim 1, wherein the expansion member is connected with a proximal-most end of the piercing member.

20. The vial adaptor of claim 1, wherein the expansion member is connected with the piercing member a distance from a proximal-most end of the piercing member.

21. The vial adaptor of claim 20, wherein the distance is about 10% of an axial length of the piercing member.

22. The vial adaptor of claim 1, wherein the expansion member further comprises a proximal portion that does not include a proximal-most end of the expansion member.

23. The vial adaptor of claim 1, wherein the expansion member further comprises a distal portion that does not include a distal-most end of the expansion member.

24. The vial adaptor of claim 1, wherein the external surface of the proximal end of the piercing member is positioned radially outward of the piercing member with respect to an axial center of the piercing member.

25. The vial adaptor of claim 1, wherein the expansion member further comprises at least one aperture and containing a volume, the expansion member configured to receive through the aperture and into the volume at least 25% of the axial length of the piercing member.

26. The vial adaptor of claim 25, wherein the volume comprises a generally cylindrical shape.

27. The vial adaptor of claim 25, wherein the expansion member is configured to receive at least 50% of the axial length of the piercing member.

28. The vial adaptor of claim 1, wherein the expansion member is configured to expand axially at least about 4 times as much as the expansion member expands radially.

29. The vial adaptor of claim 1, wherein the piercing member further comprises a plurality of texture elements configured to inhibit axial displacement of the expansion member during insertion of the piercing member into the vial.

30. The vial adaptor of claim 1, wherein the expansion member comprises a bag.

31. The vial adaptor of claim 1, wherein the piercing member further comprises a midpoint that is located about halfway along the longitudinal length of the piercing member, and wherein the expansion member is connected with the external surface of the proximal end of the piercing member at a location that is proximal of the midpoint.

32. The vial adaptor of claim 1, further comprising a lubricant on an exterior surface of the expansion member.

33. A method of maintaining a substantially constant pressure within a vial, the method comprising:

coupling a housing member to a vial, the housing comprising a piercing member;

piercing a septum of the vial with a distal end of the piercing member, wherein piercing the septum of the vial with the distal end of the piercing member comprises contacting the septum with an expansion member;

permitting a medical fluid to flow through an extractor channel formed in the housing member, the extractor channel configured to facilitate withdrawal of a medical fluid from the vial when the adaptor is coupled to the vial; and permitting a regulating fluid to flow through a regulator channel during withdrawal of the medical fluid, the regulator channel formed in the piercing member, the regulating fluid being received in the expansion member, the expansion member being connected to an external surface of the piercing member at a proximal end of the piercing member, the expansion member being configured to expand as the medical fluid is withdrawn.

34. The method of claim 33, wherein the expansion member is connected to the proximal-most end of the piercing member.

35. The method of claim 33, wherein the expansion member is configured to regulate a pressure in the vial.

36. The method of claim 33, wherein the piercing member comprises a tip member.

37. The method of claim 36, wherein the tip member is detachable from remainder of the piercing member.

38. The method of claim 36, wherein the tip member comprises polypropelene, polycarbonate, or glass impregnated polybutylene terephthalate.

39. The method of claim 36, wherein the tip member is in airtight engagement with the expansion member.

40. The method of claim 33, wherein the expansion member comprises polyisoprene or silicone rubber.

41. The method of claim 33, wherein the piercing member is configured to have a total axial length that is about equal to a total axial length of the vial.

42. The method of claim 33, wherein a distal-most end of the piercing member is configured to be positioned adjacent a distal end of the vial.

43. The method of claim 33, wherein a distal end of the piercing member is closed.

44. The method of claim 33, wherein the piercing member comprises a vent in fluid communication with the regulator channel.

45. The method of claim 33, wherein the piercing member comprises a plurality of perforations in fluid communication with the regulator channel.

46. The method of claim 33, wherein the piercing member comprises a plurality of annular ribs.

47. The method of claim 33, further comprising applying a lubricant to at least one of the piercing member and the expansion member.

48. The method of claim 47, wherein the lubricant comprises fluorosilicone oil.

49. The method of claim 33, wherein the expansion member is bonded to the piercing member with an adhesive.

50. The method of claim 49, wherein the adhesive comprises a RTV silicone adhesive.

51. The method of claim 33, further comprising applying a lubricant to an exterior surface of the expansion member.

52. A vial adaptor comprising:

a housing member comprising a piercing member having a proximal end, a distal end, and a plurality of annular ribs, the distal end of the piercing member configured to pierce the septum of a vial;

a connector configured to couple the housing member with the vial;

an extractor channel formed in the housing member, the extractor channel configured to facilitate withdrawal of a medical fluid from the vial when the adaptor is coupled to the vial;

a regulator channel formed in the piercing member, the regulator channel configured to facilitate a flow of a regulating fluid therethrough during withdrawal of the medical fluid; and an expansion member connected with an external surface of the proximal end of the piercing member and in fluid communication with the regulator channel, the expansion member configured to expand to receive the flow of the regulating fluid as the medical fluid is withdrawn from the vial.

53. The vial adaptor of claim 52, further comprising a lubricant on an exterior surface of the expansion member.

54. The vial adaptor of claim 52, wherein the expansion member is configured to expand axially at least about 4 times as much as the expansion member expands radially.

55. The vial adaptor of claim 52, wherein the piercing member further comprises a midpoint that is located about halfway along the longitudinal length of the piercing member, and wherein the expansion member is connected with the external surface of the proximal end of the piercing member at a location that is proximal of the midpoint.

* * * * *